US012421652B2

(12) United States Patent
Schechter et al.

(10) Patent No.: US 12,421,652 B2
(45) Date of Patent: Sep. 23, 2025

(54) AUTONOMOUS TIERED LAUNDRY FOLDING DEVICES, SYSTEMS, AND METHODS OF USE

(71) Applicant: Monotony.ai, Inc., Watertown, MA (US)

(72) Inventors: Stuart E. Schechter, Newton, MA (US); Benjamin D. Bixby, Newton Highlands, MA (US); Samuel Duffley, Somerville, MA (US); Madeline R. Hickman, Arlington, MA (US); Wilson J. Mefford, Watertown, MA (US); Jesse Sielaff, Norfolk, MA (US); John Appleberry, Boston, MA (US)

(73) Assignee: MONOTONY.AI, INC., Arlington, MA (US)

( * ) Notice: Subject to any disclaimer, the term of this patent is extended or adjusted under 35 U.S.C. 154(b) by 100 days.

(21) Appl. No.: 18/341,898

(22) Filed: Jun. 27, 2023

(65) Prior Publication Data

US 2023/0416975 A1 Dec. 28, 2023

Related U.S. Application Data

(60) Provisional application No. 63/374,106, filed on Aug. 31, 2022, provisional application No. 63/355,803, filed on Jun. 27, 2022.

(51) Int. Cl.
*D06F 89/00* (2006.01)
*A41H 43/02* (2006.01)
(Continued)

(52) U.S. Cl.
CPC ..... *D06F 89/00* (2013.01); *B65B 35/24* (2013.01); *B65B 63/045* (2013.01); *D06F 89/02* (2013.01); *D06F 95/00* (2013.01); *A41H 43/025* (2013.01)

(58) Field of Classification Search
CPC .. A41H 43/025; A41H 43/0257; D06F 89/00; D06F 89/02; D06F 95/00; B65B 35/24; B65B 63/045
See application file for complete search history.

(56) References Cited

U.S. PATENT DOCUMENTS 3,774,903 A * 11/1973 Sjoman ..... B65B 25/20 493/428
5,300,007 A * 4/1994 Kober ..... D06F 89/00 493/450

(Continued)

FOREIGN PATENT DOCUMENTS

WO 2022094034 A1 5/2022
WO 2022094181 A1 5/2022

OTHER PUBLICATIONS

International Search Report and Written Opinion corresponding to PCT/US/2023/069141, Nov. 7, 2023, (20 pages).

(Continued)

*Primary Examiner* — F Griffin Hall
(74) *Attorney, Agent, or Firm* — Myers Bigel, P.A.

(57) ABSTRACT

Devices, systems, and methods for autonomously shuffling a plurality of platters through a plurality of tiered folding bays are described. Each of the platters includes a platter coupling, and the plurality of tiered folding bays each include a bidirectionally driven receiving coupling, at least one of a sliding folding rod and blade, and a lifting mechanism configured to separate the platter coupling from the receiving coupling. The system includes a loading elevator for loading a platter and unfolded laundry article disposed thereon into a bay, and an unloading elevator for lowering a platter and a folded laundry article thereon to an unloading station for handing off to packing. A return conveyor returns each emptied platter to a repositioning station for receiving another spread laundry article for folding. The loading (Continued)

elevator, unloading elevator and each of the plurality of folding bays includes a pair of driven conveyors for transferring platters.

21 Claims, 45 Drawing Sheets

(51) Int. Cl.

| | |
|---|---|
| ***B65B 35/24*** | (2006.01) |
| ***B65B 63/04*** | (2006.01) |
| ***D06F 89/02*** | (2006.01) |
| ***D06F 95/00*** | (2006.01) |

(56) References Cited

U.S. PATENT DOCUMENTS

| | | | | |
|---|---|---|---|---|
| 5,540,647 | A * | 7/1996 | Weiermann | D06F 89/00 493/938 |
| 5,996,861 | A * | 12/1999 | Propach | B65B 63/04 223/37 |
| 6,915,929 | B2 * | 7/2005 | Rauch | D06F 89/00 223/37 |
| 9,752,277 | B2 * | 9/2017 | Nakahara | D06F 69/00 |
| 11,198,969 | B2 * | 12/2021 | Rozov | D06F 89/02 |
| 11,214,916 | B2 * | 1/2022 | Maeshima | B65G 21/14 |
| 11,225,753 | B2 * | 1/2022 | Naor | D06F 89/00 |
| 11,261,562 | B2 * | 3/2022 | Nitschmann | B65H 37/06 |
| 11,408,118 | B2 * | 8/2022 | Yano | B25J 15/0028 |
| 11,408,119 | B2 * | 8/2022 | Matarasso | D06F 89/023 |
| 12,024,814 | B2 * | 7/2024 | Maeshima | D06F 89/023 |
| 12,104,314 | B2 * | 10/2024 | Kim | D06F 89/02 |
| 2019/0292718 | A1 | 9/2019 | Maeshima | |
| 2021/0370517 | A1 | 12/2021 | Bixby et al. | |
| 2022/0002936 | A1 | 1/2022 | Schechter et al. | |
| 2022/0090312 | A1 * | 3/2022 | Hansen | D06F 89/00 |

OTHER PUBLICATIONS

International Preliminary Report on Patentability corresponding to PCT/US/2023/069141; mailed Jan. 9, 2025, (13 pages).

* cited by examiner

AUTONOMOUS TIERED LAUNDRY FOLDING DEVICES, SYSTEMS, AND METHODS OF USE

CROSS-REFERENCE TO RELATED APPLICATIONS

This application claims priority under 35 U.S.C. § 119(e) to U.S. Provisional Patent Application Ser. No. 63/355,803 filed Jun. 27, 2022, titled "Autonomous Tiered Laundry Folding Devices, Systems, And Methods of Use," and U.S. Provisional Patent Application Ser. No. 63/374,106 filed Aug. 31, 2022, titled "Autonomous Tiered Laundry Folding Devices, Systems, And Methods of Use," the entirety of which applications are hereby incorporated by reference.

BACKGROUND

The present disclosure is directed to robotic laundry devices, systems, and methods.

Automating and outsourcing mundane, time-consuming household chores to robotic devices is increasingly common. Time-saving home robots include, for example, floor vacuuming and floor washing robots. Outsourcing responsibilities include, for example, engaging grocery shopping and delivery, and manually operated and human-operator dependent laundry washing and dry-cleaning pick up and return services.

Many homes are appointed with a dedicated washer and dryer for family use. Domestic washers and dryers are increasingly sophisticated and include IoT connectivity features and push notifications for alerting users about cycle progress and energy and resource usage. These technologically advanced machines, however, require human interaction and cannot eliminate the time and manual labor required for processing loads of laundry in the home. Although more modern, "high efficiency" machines are equipped with sensors for metering water usage and dryer temperatures, the efficiency gains are capped by the constraints of sequentially processing single loads of laundry. Additionally, grey water is output to the city water and sewer system for mitigation with each load of laundry processed, and energy is consumed with each load of laundry washed and dried.

Households can outsource laundry chores to laundromat facilities for a fee in exchange for time. Laundromats offering residential mixed load laundering services, however, require human interaction for intake and sorting of dirty laundry, transferring loads from washer to dryer, and then manually folding clean laundry. These are costly processes as measured in time, energy consumption, water consumption, and wastewater output, and they rely on human intervention to keep the process running at every transition and throughout several process steps. This invites delays at every stage. Because these processes are human-dependent and inefficient, the costs are passed along to the customers outsourcing their laundry for cleaning. Human-reliant laundering services also require that employees touch the belongings of the customer, potentially exposing the employee to contaminants in the dirty laundry and potentially exposing the clean laundry to transferable pathogens, dust, hair, and other debris emanating from a laundromat employee. In addition to potentially introducing undesirable contact contamination from the employees processing the loads of laundry, a privacy barrier is breached. Outsourcing household laundry to a laundromat involves employees interacting with customers' personal belongings including bodily worn garments.

Industrial laundry services exist for handling uniform business-related items, such as hospital bed sheets, medical scrubs, and hotel towels. Such industrial machines are tailor-made to accept one type of laundry item of one size or style. For example, unique folding machines exist to accept one of washed flat sheets, fitted sheets, hotel towels, and hotel bathrobes. These machines require human operators to load the washed article into its dedicated machine, which is sized and designed to fold that one type and/or size of article. This type of process line relies on a human operator for properly aligning and loading the clean article into the machine, which could introduce bodily contaminants, bacteria, and viral matter into the clean articles. Like laundromat services, these industrial services rely on human intervention and potentially introduce bio-contaminants into clean loads of laundry. Because these services are only profitable by processing large volumes of like items, these industrial processors are generally subscription-based services for large clients like hotels and hospitals producing standard-size, repeat laundry articles and are not available to consumers at an individual household level. Additionally, these services are configured to combine laundry from more than one source and are not configured to isolate and process separate loads for individual households.

Autonomous robotic devices are provided to process loads of household laundry. Such devices eliminate human contact with deformable laundry articles and autonomously process batches of disparate article types and sizes. As such, the devices need to be designed to be efficient and reliable for replacing the common, human-dependent chore of laundry.

SUMMARY

In one example, an autonomous folding device includes: a plurality of tiered folding bays configured to independently and simultaneously fold a plurality of household laundry articles. Each of the plurality of folding bays includes a rotatable coupling configured to receive a rotatable platter in reversible engagement, the rotatable coupling being in operative engagement with a drive motor, an extendable and retractable support configured to transit the rotatable platter into and out of the folding bay in a level orientation and align a protrusion extending from an underside surface of the rotatable platter with the rotatable coupling, and at least one of a folding blade and folding rod configured to engage a laundry article disposed on a top surface of the rotatable platter engaged with the rotatable coupling. The device includes at least one elevator configured to raise and lower the rotatable platter into and out of one of the plurality of folding bays. The rotatable platter is one of a plurality of rotatable platters, and two or more rotatable platters of the plurality of platters are configured to occupy simultaneously two or more of the plurality of tiered folding bays.

Implementations of the device may include one or more of the following features.

In examples, the plurality of tiered folding bays are vertically stacked to form a tower occupying an area footprint on the floor of one folding bay.

In examples, the extendable and retractable support further includes a pair of spaced apart transfer conveyers configured to support in an extending state the rotatable platter thereon with the platter therebetween. The pair of spaced apart transfer conveyers further include centering pins configured to abut one or more edge locations of the platter and center the platter in X-Y planar directions such that the platter protrusion extending therefrom aligns with the receiving coupling for successfully mating. The centering pins can include at least two along a leading edge (e.g., in the direction of platter travel) of the platter and two along a trailing edge of the platter.

In examples, the platter protrusion includes a conical shape and the receive coupling includes a conically shaped receiving bore.

In examples, each folding bay of the plurality of bays includes a first open end opposite a second open end, and the open ends are disposed adjacent the ends of the pair of spaced apart transfer conveyers. The at least one elevator can include a loading elevator adjacent the first open end and an unloading elevator adjacent the second open end. The device can further include a pair of driven support rails extending from the first open end configured to transit a platter and spread laundry article thereon onto a pair of spaced apart driven transfer conveyors disposed on the extendable and retractable support. The pair of driven support rails can be spaced either closer together or further apart than the pair of spaced apart drive transfer conveyors so that the pairs of conveyors are nested. The pair of driven support rails can abut the ends of the pair of spaced apart drive transfer conveyors. Alternatively, the pair of driven support rails can overlap in length at least partially with the ends of the pair of spaced apart drive transfer conveyors In examples, the loading elevator is configured to raise and lower a rotatable platter to an unoccupied bay for transiting the platter onto the driven support rails.

In examples, the unloading elevator includes a pair of unloading conveyors configured to transit the rotatable platter at least one of into and out of the folding bay in a level orientation and deliver the folding article to an unloading station.

In examples, the unloading station includes a retrieval arm configured to retrieve for delivery to a packing robot. The retrieval arm can include at least one of a 3 or more degree of freedom robotic arm and gripper, a movable conveyor disposed on a gantry, one or more suction elements, and one or more clamps configured scoop and clamp the folded article from a top surface of the platter.

In examples, the device further includes a return conveyor disposed between the loading elevator and the unloading elevator for returning an empty platter from the unloading station to the loading elevator, wherein the return conveyor is disposed on a floor at least one of below or aside the tower. The loading elevator is configured to raise an empty platter to a repositioning station for receiving a spread apart laundry article to deliver to an unoccupied one of the plurality of tiered folding bays.

In examples, the at least one of the folding blade and folding rod is configured to raise from, lower to, and move along the surface of the rotatable platter to at least one of fold, sweep, and clamp the laundry article. The device can further include a compression sensor configured to detect an amount of downward force applied by the at least one of the folding blade and folding rod to at least one of a top surface of the rotatable platter and the laundry article thereon.

In examples, a total number of platters of the plurality of platters is equal to or greater than the number of folding bays of the plurality of tiered folding bays to enable simultaneously folding laundry articles within every bay.

In examples, the device further includes a plurality of support wheels disposed throughout each folding bay of the plurality of bays, the plurality of support wheels being configured to support thereon the rotatable platter when the extendable and retractable support is in a retracted state. The retracted state includes the extendable and retractable support not touching the platter while the platter protrusion is engaged with the rotatable coupling.

In examples, the device further includes one or more sensors configured to output a signal indicative of a folding state of the laundry article.

In examples, the device further includes a controller in operative communication with the one or more sensors and one or more drives of the at least one elevator and the at least one extendable and retractable support, the controller being configured to determine, based on received output signals of the one or more sensors, an unoccupied bay and article folding completion, and to instruct the at least one elevator to retrieve a platter and folded laundry article thereon for delivery to the unloading station.

In one example, an autonomous tiered folding system includes a plurality of rotatable platters, a plurality of tiered folding bays, a loading elevator, a pair of loading conveyors at least partially disposed within the loading elevator, an unloading elevator, and a return conveyor. Each one of the plurality of rotatable platters includes a platter coupling configured to reversibly engage a receiving coupling affixed within a tiered folding bay. The receiving coupling is configured to rotate the platter about a spin axis. The platter coupling is affixed to an underside surface of the platter, and a top surface of the platter is configured to receive thereon a laundry article, wherein the received laundry article is at least one of spread apart and partially folded. Each one of the plurality of tiered folding bays is configured to receive any one of the plurality of platters through a first open end. Each of the plurality of tiered folding bays includes: a receiving coupling configured to receive and retain the platter coupling such that the top surface and a laundry article disposed thereon are level in an engaged state, a drive motor operably connected to the receiving coupling, the drive motor being configured to bi-directionally rotate the received platter about the spin axis, one or more sliding rods configured to at least one of clamp and fold the spread laundry article onto itself, a pair of transfer conveyors disposed at least partially within each one of the plurality of tiered folding bays configured to receive the platter through the first open end and discharge the platter through a second open end opposite the first open end, and a lifting mechanism (e.g., a pair of extendable linkages) configured to separate the platter coupling from the receiving coupling. The loading elevator is disposed adjacent the first open end, the loading elevator being configured to raise the platter to an unoccupied one of the plurality of tiered folding bays from a spreading height at which the laundry article is received in at least one of a spread state and a partially folded state. The pair of loading conveyors is at least partially disposed within the loading elevator. The pair of loading conveyors are configured to support a platter disposed thereon. The loading conveyors of the pair of loading conveyors are spaced apart to receive the platter coupling therebetween. The pair of loading conveyors are engaged with the loading elevator for raising the platter and laundry article disposed thereon to one of the plurality of tiered folding bays, lowering to receive an empty platter of the plurality of rotatable platters from a return conveyor, and raising the empty platter within the loading elevator to the spreading height. The unloading elevator is disposed adjacent the second open end of the plurality of tiered folding bays. The unloading elevator is configured to retrieve and lower the platter with a folded laundry article disposed thereon to an unloading station. The return conveyor is disposed at least one of below and adjacent the plurality of tiered bays. The return conveyor is configured to at least one of receive and store an empty platter from the unloading elevator, and return the empty platter to the loading elevator for raising to the spreading height and receiving a next spread laundry article.

Implementations of the system may include one or more of the following features.

In examples, the platter coupling is disposed at a center of the platter and includes a tapered profile enabling self-centering mating within the receiving coupling. The receiving coupling can include a pull stud gripper configured to receive and reversibly retain a pull stud extending from a point of the tapered platter coupling. In implementations the system further includes a pneumatic actuator configured to drive the pull stud gripper both to release and close about a retention feature of the pull stud. The receiving coupling can further include a plurality of Belleville spring washers stacked in series. In implementations, the plurality of Belleville spring washers are configured to overcome at least 1000 lbf.

In examples, the return conveyor is configured to support a plurality of empty platters of the plurality of rotatable platters. In examples, the return conveyor is configured to store a queue of one or more empty platters of the plurality of platters. In examples, the plurality of platters includes a total number of platters equal to at least a total number of tiered folding bays. In examples, the return conveyor includes a pair of parallel conveyors spaced apart to receive the platter coupling therebetween.

In examples, the unloading elevator includes a pair of spaced apart unloading conveyors disposed thereon configured to receive the platter coupling therebetween.

In examples, the system further includes a pair of spaced apart support rails cantilevered from a first open end of one of the plurality of tiered folding bays, the support rails configured to receive a platter from the loading conveyors and transit the platter to the pair of transfer conveyers within the folding bay. The loading conveyors, support rails, transfer conveyors, and unloading conveyors are horizontally oriented to hold the platter level during raising, lowering, and loading and unloading into and out of one of the plurality of tiered folding bays such that the laundry article disposed thereon does not dislodge and/or unfold. The transfer conveyors can be configured to overlap length with the support rails and unloading conveyors for level loading and unloading of the platter from one of the plurality of tiered folding bays. The transfer conveyors are at least one of wider apart and closer together than of each one of the pair of unloading conveyors and the pair of support rails. In other examples, an end of each of the pair of transfer conveyors abuts at least one of the ends of the support rails and the ends of the unloading conveyors. In examples, the return conveyor includes a pair of parallel conveyors spaced apart to receive the platter coupling therebetween.

In examples, the transfer conveyors in each one of the plurality of tiered folding bays are configured to raise to the height of the pair of support rails for receipt of a platter having disposed thereon a laundry article, and lower the platter coupling into a receiving coupling for mated engagement. A lifting mechanism includes at least one actuator to raise and lower the transfer conveyors. In examples, the pair of transfer conveyors are disposed on the pair of extendable linkages, and the extendable linkages further include at least one actuator to raise and lower the transfer conveyors and a platter thereon. In examples, a piston actuated lifter is configured to raise the pair of transfer conveyors and lift the platter coupling from the receiving coupling in one of the plurality of folding bays once a folding end state is reached and the platter coupling is disengaged from the receiving coupling.

In examples, the transfer conveyors further include a plurality of centering pins configured to abut an edge of platter to center the platter coupling concentrically with the receiving coupling inside one of the plurality of tiered folding bays.

In examples, the laundry article is at least one of spread and at least partially folded by a plurality of lifters configured to lift and spread the laundry article above the spreading height at a repositioning station. The plurality of lifters are disposed about the top surface of the platter disposed within the loading elevator at the spreading height within the spreading station. In examples, the spreading height coincides with a bottom plane of a work volume within which a plurality of lifters receive the laundry article, spread the laundry article, and lay the spread laundry article flat on the top surface in a spread state for folding. One or more sensors disposed about the work volume are configured to detect at least one of a presence, orientation, and spread status of a laundry article disposed within the work volume. In examples, each one of the plurality of lifters includes an arm configured to at least one of pan, tilt, and extend from a stationary support, each arm terminating in an actuatable gripper.

In examples, each platter of the plurality of platters is interchangeable in each of the plurality of tiered folding bays.

In examples, two or more platters are configured to be disposed in at least two or more of the plurality of tiered folding bays and at least one of the loading elevator, unloading elevator, unloading station, and return conveyor.

In examples, each one of the plurality of platters has a thickness of between about 25 mm and 45 mm. In examples, each one of the plurality of platters has a diameter of between about 75 cm to 260 cm.

In examples, each bay of the plurality of tiered folding bays includes at least two of the one or more sliding folding rods (e.g., sweep rods), at least one sliding clamp rod (hereinafter referred to interchangeably as a clamp rod), and a tiltable folding blade configured to clamp, smooth, and fold the laundry article disposed on the top surface of the platter. One or more sensors disposed about each bay of the plurality of tiered folding bays is configured to detect at least one of a presence and a folded state of the laundry article disposed on the top surface of the platter. The one or more sensors includes at least one of a 3-D camera, an IR sensor, a 2-D camera, LIDAR, LADAR, a sonar proximity sensor, an ultrasonic ranging sensor, a radar sensor, and a pair of stereo depth cameras. In examples, the system further includes one or more light sources configured to illuminate the laundry article disposed on the top surface of the platter.

In examples, that system includes one or more light panels disposed along a top surface of the folding bay, the one or more light panels being configured to illuminate the laundry article disposed on the top surface of the platter.

In examples, the system further includes a controller in operable communication with the one or more sensors of each of one of the plurality of tiered folding bays, one or more sensors disposed about the spreading height, one or more elevator drives, the drive motor of the pair of transfer conveyors each of the plurality of tiered folding bays, and at least one drive configured to move of each of the at least two of one or more sliding sweep rods, at least one sliding clamp rod, and a tiltable folding blade. The controller is configured to determine, based on input received from the one or more sensors, the presence or absence of one of the plurality of rotatable platters in each one of the plurality of tiered folding bays, identify an unoccupied bay, and instruct the loading elevator to raise one of the plurality of rotatable platters and a laundry article thereon to the unoccupied folding bay. In examples, the system further includes an attachment sensor in operative communication with the controller. The attachment sensors are configured to detect the platter coupling successfully engaging the receiving coupling and provide an output signal to the controller indicative of one of a successful and an unsuccessful engagement or release.

In one example, a method of shuffling a plurality of rotatable platters into and out of a plurality of tiered laundry folding bays includes receiving an output signal of one or more sensors disposed about a first platter disposed at a repositioning station adjacent the plurality of tiered folding bays and an output signal of one or more folding sensors disposed within each one of the plurality of tiered folding bays, the first platter being one of the plurality of rotatable platters. The method includes determining the first platter has disposed thereon a spread laundry article ready for folding, identifying, based on the received output signal of the one or more folding sensors, an unoccupied bay of the plurality of tiered folding bays, and instructing a first elevator drive of a pair of loading conveyors disposed at the repositioning station to at least one of raise and lower the pair of loading conveyors and the first platter and spread laundry article disposed thereon to a height of at least one of a pair of support rails cantilevered from the unoccupied bay and a pair of transfer conveyors at least partially disposed within the identified unoccupied bay. The method includes instructing a circulation drive of the pair of loading conveyors and a circulation drive of the at least one of the pair of support rails and the pair of transfer conveyors to rotate and convey the first platter into the unoccupied bay through a first open end, and receiving an output signal of one or more folding sensors indicative of a presence of a folded laundry article disposed within an identified occupied one of the plurality of tiered folding bays. The method includes instructing a second elevator drive of a pair of unloading conveyors to: raise or lower to align with the pair of transfer conveyors at an open opposite the first open end, retrieve, in response to receiving a signal indicative of folding completion, one of the plurality of platters and a folded laundry article disposed thereon from an identified occupied one of the plurality of tiered folding bays, and align the retrieved platter and a folded article thereon within an unloading station. The method includes determining whether the folded article is aligned with a folded article retrieval conveyor suspended within the an unloading station and instructing, based on determining the folded article is not aligned with a front edge of the folded article retrieval conveyor, a rotational spin drive motor of the unloading station to rotate the platter and folded article thereon to align an edge of the folded article substantially parallel to a leading edge of the retrieval conveyor, wherein the retrieved platter is one of the first platter and another of the plurality of platters disposed within the plurality of tiered folding bays.

Implementations of the method may include one or more of the following features.

In examples, the method further includes instructing, once the folded article is retrieved by the folded article retrieval conveyor, the second elevator drive to raise the unloading conveyors to lift the platter from the unloading station and align them with a pair of return conveyors for delivery to the repositioning station.

In examples, the first elevator drive and second elevator drive are configured to operate concurrently to deliver the first platter of the plurality of platters to the identified unoccupied bay and retrieve another platter of the plurality of platters and the folded laundry article thereon from the identified occupied bay.

In examples, the repositioning station includes a plurality of grippers disposed about an outer bound of the repositioning station, the plurality of grippers configured to spread a laundry article and lower the spread article onto the platter in a spread configuration. The method further includes instructing the second elevator drive to lower the pair of unloading elevators and an empty platter thereon from a height of the folded article retrieval conveyor to a height of a return conveyor configured to receive the empty platter and at least one of store and return the empty platter to the repositioning station.

In examples, the return conveyor is configured to store a queue of one or more empty platters of the plurality of platters. A total number of platters of the plurality of platters is equal to at least a total number of tiered folding bays.

In examples, the laundry article is one of a plurality of laundry articles. A controller is in operative communication with a plurality of system drivers and is configured to simultaneously orchestrate (e.g., instruct execution of) at least two of: spreading one laundry article of the plurality of laundry articles, folding at least one other laundry article of the plurality of laundry articles in one or more folding bays, aligning vertically one of the plurality of platters and yet another folded laundry of the plurality of laundry articles disposed thereon with the folded article retrieval conveyor, and conveying an empty platter of the plurality of platters on a return conveyor disposed at least one of below and adjacent the plurality of tiered folding bays for at least one of storage and return to the repositioning station.

In examples, the method further includes instructing the first elevator drive, upon transfer of the platter into the identified unoccupied bay, to lower the pair of loading conveyors to at or below the repositioning station, retrieve an empty platter of the plurality of platters, and raise the empty platter to the repositioning station. The method further includes instructing one or more of a pan drive, a tilt drive, and an extend drive of a plurality of grippers disposed about the repositioning station to move within a work volume above the platter received at the repositioning station to spread a laundry article suspended by and spread between two of the plurality grippers. In examples, the method further includes determining the laundry article is spread apart, and instructing one or more of a pan drive, a tilt drive, and an extend drive of the two of the plurality of grippers to lower the spread apart laundry article flat onto the platter at the bottom of the work volume in a repositioned (e.g., spread) state. In examples, the method further includes instructing one or more of a pan drive, a tilt drive, and an extend drive to store the plurality of grippers outside a boundary of the platter disposed at repositioning station before instructing the first elevator drive to raise the pair of loading conveyors and the platter and repositioned laundry article laid flat thereon to the identified unoccupied folding bay.

In examples, the method further includes determining, based on at least one of the one or more sensor signals of a folding bay and a user input, that a folded laundry article disposed in one of the plurality of tiered folding bays includes one or more unacceptable folding conditions. The method further includes, upon receipt of a signal indicative of one or more unacceptable folding conditions, instructing the pair of transfer conveyors to transfer the platter and laundry article disposed thereon to the pair of loading conveyors for return to the repositioning station. In examples, the one or more unacceptable folding conditions include at least one of folding dimensions not matching an acceptable bounding box limit, a top surface tilt angle exceeding a threshold, and unacceptable appearance as determined by a person viewing a remotely transmitted image.

In examples, the folded laundry article retrieval conveyor is disposed within an unloading station. The unloading conveyors are configured to extend into the unloading station, align a descending platter coupling of the platter within a receiving coupling of unloading station for rotating the platter for the retrieval conveyor to retrieve the folded article, and transfer an empty platter to a return conveyor configured to receive the empty platter and at least one of store and return the empty platter to the repositioning station. In examples, the method further includes instructing a spin drive motor of the unloading station to rotate the platter and folded article thereon to align a folded edge of the folded article substantially parallel to a leading edge of the retrieval conveyor.

In examples, the method further includes instructing a spin drive motor of a folding bay to rotate a platter and a folded laundry article thereon to align an edge of the folded article substantially parallel to a leading edge of the retrieval conveyor before transferring the platter and folded laundry article thereon to the pair of unloading conveyors.

DETAILED DESCRIPTION

This disclosure relates to autonomous robotic devices, systems, and methods for handling residential loads of laundry. The system includes one or more autonomous process lines comprising a plurality of robotic devices configured to work in concert to process a dirty load of household laundry from a mass of dirty, non-uniform articles to individually separated, cleaned, and folded laundry articles. The plurality of robotic devices operate without human intervention to efficiently and effectively launder a customer's dirty items. This disclosure relates to autonomous robotic devices configured to autonomously fold clean, deformable laundry articles for introduction to an autonomous packing robot. The autonomous robotic devices are configured to fold a plurality of loads of laundry each comprising a plurality of deformable article types. The laundry articles are collected from a household and delivered to the process line for cleaning. The autonomous processes are time and cost efficient, eliminate human intervention-based delays, eliminate line workers and associated introduction of human contaminants introduced by line workers, and eliminate any concerns with having private personal items handled by strangers.

In particular, this disclosure relates to a system of autonomous robotic devices comprising at least one stacked tower comprising a plurality of tiered folding bays configured to independently and simultaneously fold a plurality of household laundry articles. In implementations, the simultaneously folded household laundry articles comprise disparate characteristics (e.g., type, size, and material). Each one of the plurality of tiered folding bays is configured to receive a therein a movable platter with a spread laundry article disposed thereon, the movable platter being configured to reversibly engage with a rotatable drive mechanism disposed within the bay. The movable platter is aligned with an empty bay by a first elevator and retrieved from the bay following folding by the first elevator or second elevator. Each elevator and bay comprise a conveyor (e.g., a pair or rails and/or conveyor belts) configured to pass the movable platter into and out of the bay in a level orientation for folding and deliver to an unloading station at which the folded laundry article disposed on the movable platter is robotically retrieved for delivery to a packing robot. Each folding bay of the tiered folding bays comprises one or more folding mechanisms including at least one of a folding blade, at least one sweep rod, and at least one clamp rod configured to move within their dedicated bay.

Figure 1:
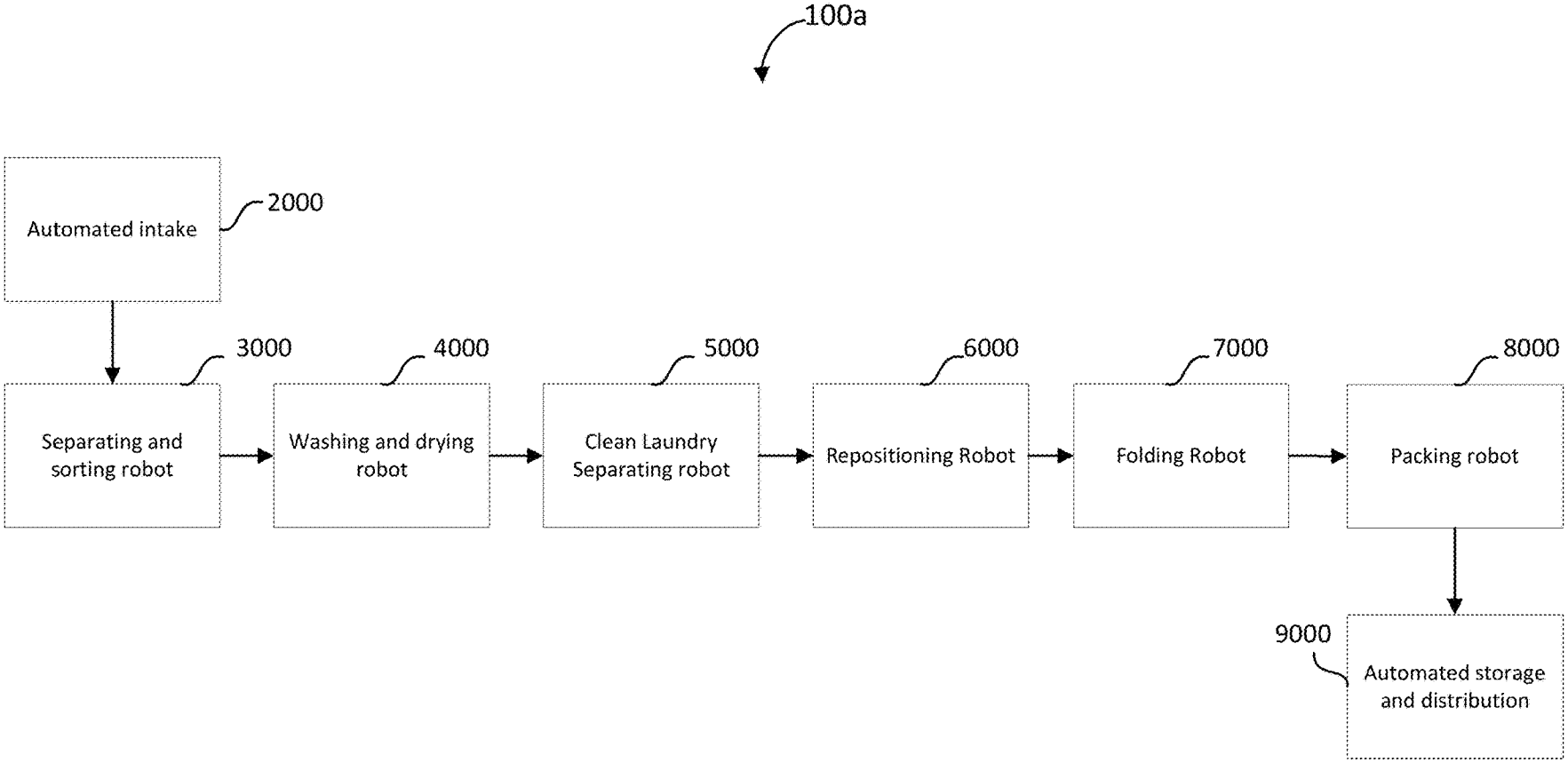
FIG. 1 depicts a schematic of an example autonomous robotic laundry process line.

As shown in FIG. 1, in implementations of the system, a process line 100*a* comprises a plurality of autonomous robots configured to operate in series without human intervention to process and transport dirty laundry through the cleaning process and fold and repack the clean laundry for return to a household. In one implementation, the process line 100*a* comprises an autonomous intake robot 2000 for receiving a load of dirty household laundry comprising a plurality of deformable laundry articles. The deformable laundry articles can be non-uniform in type, size, shape, color, and fabric and can require particular treatment and handling. For example, the plurality of deformable laundry articles can include items commonly laundered in homes, such as sheets, towels, tablecloths, and adult and children's garments, for example, tee shirts, pants, socks, undergarments, hooded sweatshirts, baby socks, wash cloths, dresses, open front dress shirts, and blouses. The autonomous intake robot 2000 is configured to introduce the plurality of deformable laundry articles to a separating and sorting robot 3000 configured to separate out each one of the deformable laundry articles of the plurality of deformable laundry articles pertaining to a single customer and/or household. In implementations, the separating and sorting robot 3000 is configured to sort each one of the separated deformable laundry articles into one or more related batches for washing. In implementations, the separating and sorting robot 3000 is configured to intelligently batch the separated each one of the deformable laundry articles into its own dedicated load or into a load with at least one other separated deformable laundry article according to a programmed sorting algorithm. The programmed sorting algorithm can be based, for example, on criteria including at least one of material color, material type, customer washing preference, water temperature requirements, and load size. In implementations, the separating and sorting robot 3000 is configured to identify and record the number and types of garments in the load of laundry and provide this information to one or more robots in the process line 100*a*.

The separating and sorting robot 3000 outputs one or more intelligently sorted batches of deformable laundry articles to one or more washing and drying robots 4000 for laundering. The one or more washing and drying robots 4000 output the clean laundry articles to a clean laundry separating robot 5000. Implementations of the clean laundry separating robot 5000 can be similar or identical to the separating and sorting robot 3000. The clean laundry separating robot 5000 is configured to separate a load of clean laundry into individual deformable laundry articles for introduction into a repositioning robot 6000. In implementations to be described herein in detail, the repositioning robot 6000 receives a single deformable laundry article and manipulates and repositions it for automated introduction into a folding robot 7000, which automatically folds the laundry article for introduction to a packing robot 8000. In implementations, the packing robot 8000 automatically packs the clean load of laundry comprising the plurality of clean and folded deformable laundry articles in a shipping container for automated redistribution to the customer. In implementations, the shipping container is a reusable container. In implementations, the shipping container is a disposable container. In implementations, the shipping container is a non-deformable container with an ingress protection rating that includes an intrusion protection rating of 5 or 6 and a moisture protection rating of any and all of 1 through 6 in accordance with the Ingress Protection Code, IEC standard 60529.

Figure 2:
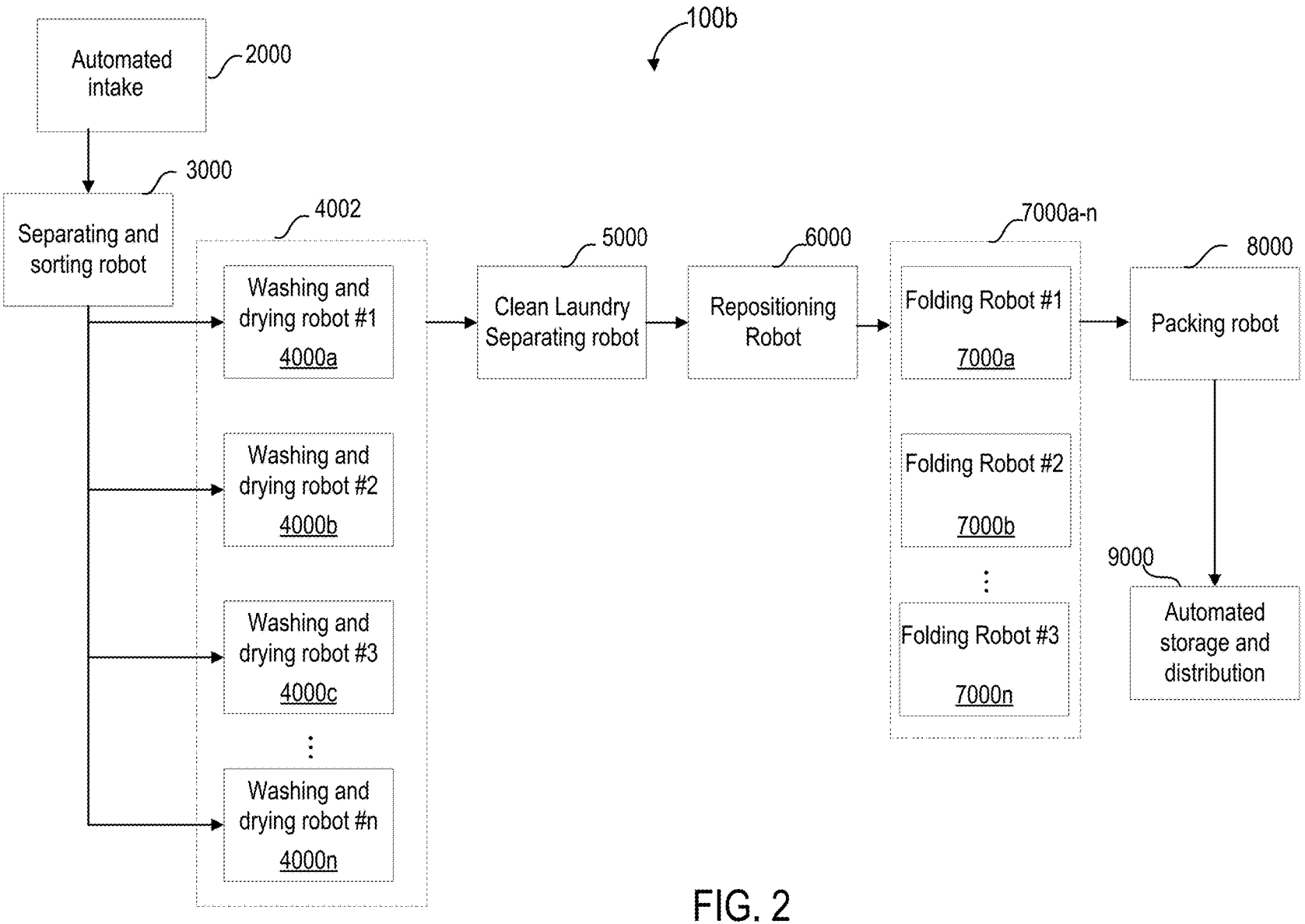
FIG. 2 depicts a schematic of an example autonomous robotic laundry process line comprising a plurality of washing a drying robots and a plurality of folding robots.

Implementations of the process line 100*a* of household laundry cleaning robots can comprise one or more of each of the robots depicted in FIG. 1. For example, as shown in FIG. 2, each autonomous process line 100*b* can include a plurality of washing and drying robots 4000*a-n*, wherein "n" represents a total number of robots in the cluster 4002. (Throughout the description herein "n" is used to indicate a non-determinative number of units greater than two (2) and is not intended to be limited to the number of elements shown in figures with a limited number of elements.) In implementations, the plurality of washing and drying robots 4000*a-n* comprises one or more clusters 4002 of washing and drying robots 4000*a-n* accessing shared services (e.g., water, air, washing chemicals, etc.) delivered to each cluster 4002. Additionally or alternatively, in implementations, the autonomous process line 100*b* includes a plurality of washing and drying robots 4000*a-n* shared by two or more sets of automated intake robots 2000 and dirty laundry separating and sorting robots 3000 and two or more sets of clean laundry separating robots 5000, repositioning robots 6000, folding robots 7000, and packing robots 8000. Additionally or alternatively, the process line 100*b* can include a plurality of folding robots 7000*a-n* (where "n" represents a count of robots greater than 1) configured to receive spread apart and/or repositioned clean laundry articles from one or more repositioning robots 6000. In implementations, having the number of folding robots 7000*a-n* exceed a number of repositioning robots can prevent a process bottleneck at the folding step. In implementations, having one repositioning robot 6000 delivering spread laundry articles to at least 2 folding robots results in a throughput time savings in a range of between about 30% to 50% over a one-to-one pairing of a repositioning robot 6000 to a single folding robot 7000. Additionally or alternatively, in implementations, a plurality of folding robots 7000*a-n* can be stacked, or tiered, to reduce overall floor space (e.g., floor 10) occupancy of the process line 100, 100*a-b* within a facility. Additionally, two or more of the robots in a process line 100, 100*a-b* (collectively referred to hereinafter as "the process line 100") can be combined in a single module in alternate implementations. In implementations, one or more of the robots 2000-9000 in the process line 100 are configured to communicate over wired connections or wireless communication protocols. For example, in implementations, one or more robots in the process line 100 can communicate with another one or more robots in the process line 100 over a wired BUS, LAN, WLAN, 4G, 5G, LTE, Ethernet, BLUETOOTH, or other IEEE 801.11 standard.

Figure 3:
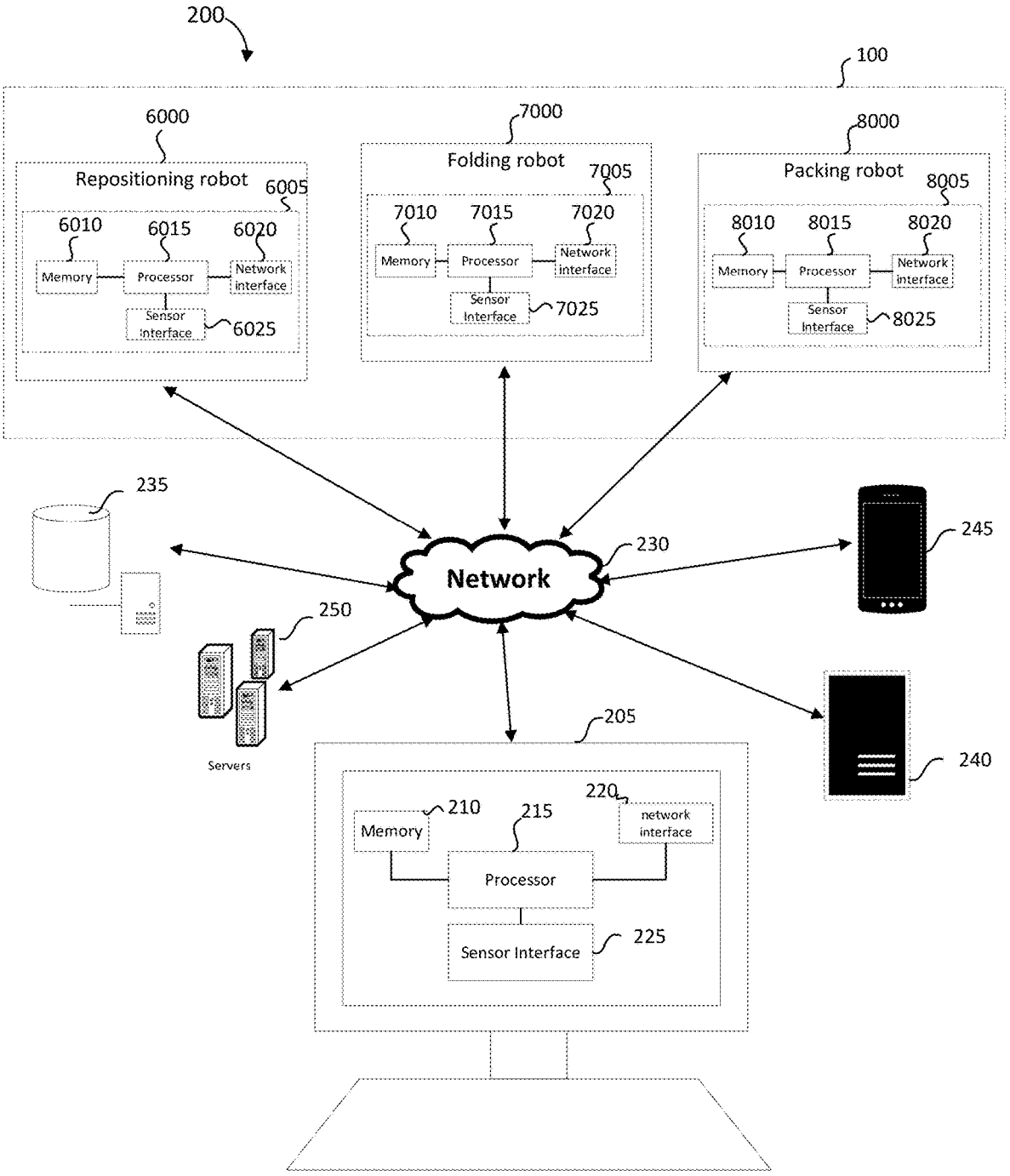
FIG. 3 depicts a schematic example of a system for controlling an autonomous robotic process line.

Referring to FIG. 3, an example of a system 200 of operatively connected autonomous robots is shown. FIG. 3 depicts a schematic implementation of a portion of an autonomous robotic process line 100 that processes the clean deformable laundry articles. Although each robot is referred to in singular form with regard to the schematic of FIG. 3, this is by way of example only, and, in implementations, each representative robot can represent a plurality of robots. A folding robot 7000 is in operative communication with a repositioning robot 6000 configured to output a repositioned, or substantially spread (e.g., uncrumpled and laid flat), deformable laundry article to the folding robot 7000, and the folding robot is in communication with a packing robot 8000 configured to receive the folded article for packing for return to the customer. In implementations, each robot 6000, 7000, 8000 includes at least one controller 6005, 7005, 8005 configured to operate the associated robot.

For example, in implementations, the folding robot 7000 includes a controller 7005. The controller 7005 includes a processor 7015 in communication with a memory 7010, a network interface 7020, and a sensor interface 7025. The processor 7015 can be a single microprocessor, multiple microprocessors, a many-core processor, a microcontroller, and/or any other general purpose computing system that can be configured by software and/or firmware. In implementations, the memory 7010 contains any of a variety of software applications, algorithms, data structures, files and/or databases as appropriate to address the requirements of repositioning a plurality of non-uniform (e.g., different article types, shapes, sizes, materials, etc.) deformable laundry articles. In one implementation, the controller 7005 includes dedicated hardware, such as single-board computers, one or more GPUs, application specific integrated circuits (ASICs), and field programmable gate arrays (FPGAs).

A network interface 7020 is configured to couple the controller 7005 to a network 230. The network 230 may include both private networks, such as local area networks, and public networks, such as the Internet. It should be noted that, in some examples, the network 230 may include one or more intermediate devices involved in the routing of packets from one endpoint to another. In implementations, the network interface 7020 is coupled to the network 230 via a networking device, such as a bridge, router, or hub. In other implementations, the network 230 may involve only two endpoints that each have a network connection directly with the other. In implementations, the network interface 7020 supports a variety of standards and protocols, examples of which include USB (via, for example, a dongle to a computer), TCP/IP, Ethernet, Wireless Ethernet, BLUETOOTH, ZigBee, M-Bus, CAN-bus, IP, IPV6, UDP, DTN, HTTP, FTP, SNMP, CDMA, NMEA and GSM. To ensure data transfer is secure, in some examples, the controller 7005 can transmit data via the network interface 7020 using a variety of security measures including, for example, TLS, SSL or VPN. In implementations, the network interface 7020 includes both a physical interface configured for wireless communication and a physical interface configured for wired communication. According to various embodiments, the network interface 7020 enables communication between the controller 7005 of the repositioning robot and at least one of the plurality of robots 2000, 3000, 4000, 5000, 6000, 8000, 9000 of the process line 100.

Additionally or alternatively, the network interface 7020 is configured to facilitate the communication of information between the processor 7020 and one or more other devices or entities over the network 230. For example, in implementations, the network interface 7020 is configured to communicate with a remote computing device such as a computing terminal 205, database 235, server 240, smartphone 245, and server farm 250. In implementations, the network interface 7020 can include communications circuitry for at least one of receiving data from a database 235 and transmitting data to a remote server 240, 250. In some implementations, the network interface 7020 can communicate with a remote server over any of the wired protocols previously described, including a WI-FI communications link based on the IEEE 802.11 standard.

In some examples in accordance with FIG. 3, the network 230 may include one or more communication networks through which the various robots and computing devices illustrated in FIG. 3 may send, receive, and/or exchange data. In various implementations, the network 230 may include a cellular communication network and/or a computer network. In some examples, the network 230 includes and supports wireless network and/or wired connections. For instance, in these examples, the network 230 may support one or more networking standards such as GSM, CMDA, USB, BLUETOOTH®, CAN, ZigBee®, Wireless Ethernet, Ethernet, and TCP/IP, among others. In implementations, the network 230 can implement broadband cellular technology (e.g., 2.5 G, 2.75 G, 3 G, 4 G, 5 G cellular standards) and/or Long-Term Evolution (LTE) technology or GSM/EDGE and UMTS/HSPA technologies for high-speed wireless communication.

Although an embodiment of a controller 7005 of the folding robot 7000 is described herein in particular, one or more of the plurality of robots 2000, 3000, 4000, 5000, 6000, 8000, 9000 of the process line 100 includes similar components having similar functionality.

Figure 4:
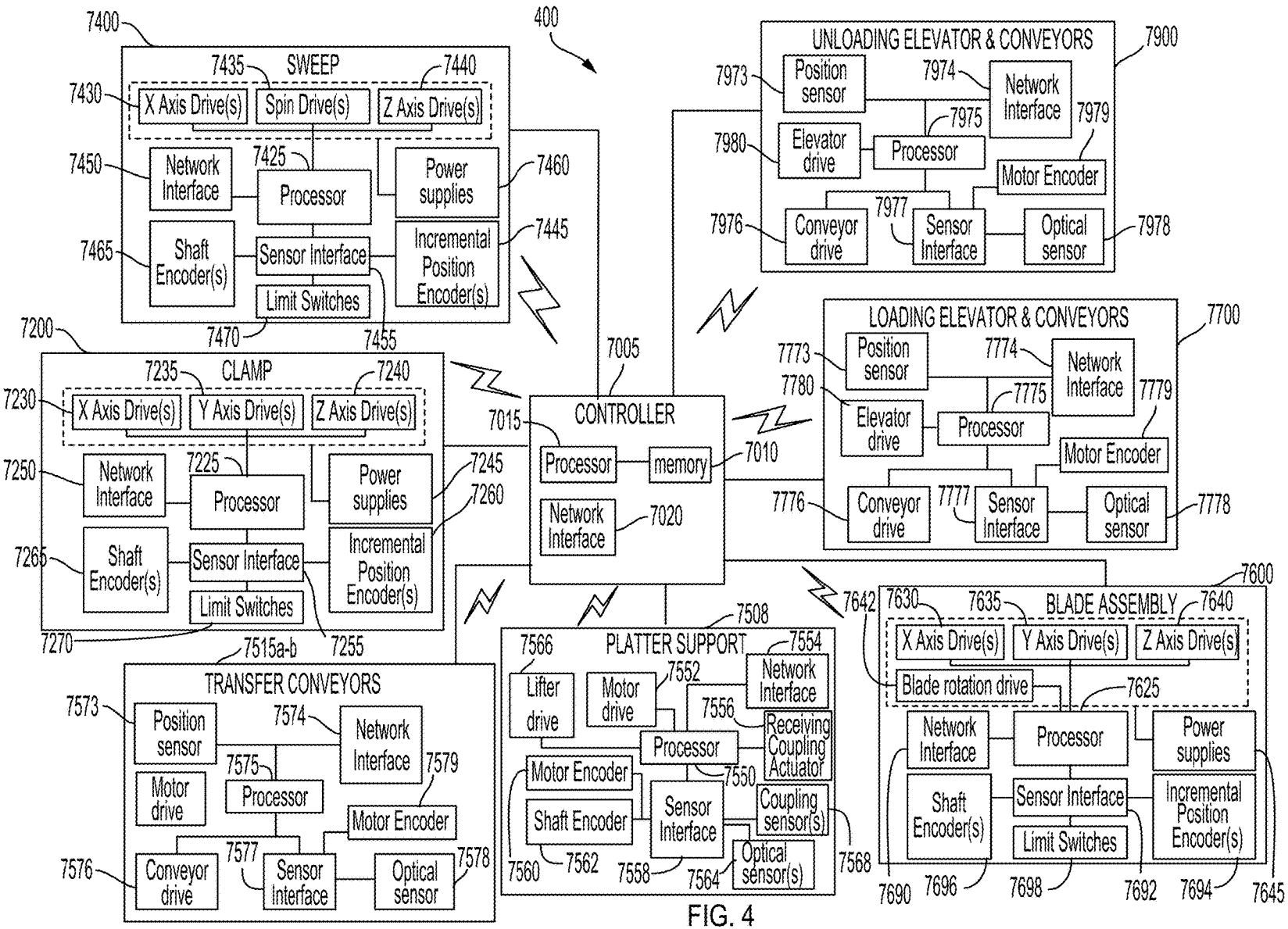
FIG. 4 depicts an example control system schematic for an autonomous tiered folding system.

Turning to FIG. 4, a schematic implementation of a controls system 400 of an autonomously operated tiered folding system 500 is shown. FIG. 4 depicts an implementation of concurrently monitored and/or autonomously controlled components of each one of the plurality of folding robots 7000*a-n* and folding platter transfer elements in operable control with the one or more controllers 6005, 7005, 8005 of the controls system 400. In implementations, each of the components comprises one or more elements having similar or identical functionality to the components described with regard to FIG. 3, such as processors, sensor interfaces, and networking interfaces for communicating with a controller 7005 and other components of the controls system 400 via at least one of a wired and wireless network 230. The controls system 400 includes one or more of the features described with regard to the embodiments of FIGS. 1-3, and includes drivers, processors, and other components in operable communication for autonomously handling and folding laundry articles via the folding system 500 depicted in implementations in FIGS. 5-8. Various components of the control system 400 will be described subsequently in detail with regard to various folding system 500 implementations. Although various processors are depicted communication with a controller 7005 of the system, in implementations, one or more controllers (e.g., repositioning robot controller 6005, packing robot controller 8005, computing terminal 205) can facilitate communication between two or more of the various components of the control system 400.

Turning to FIGS. 5-8, implementations of an autonomous tiered folding system 500 comprises a plurality of rotatable platters 7100*a-n* (where "n" represents a total number of platters greater than 1) configured to be conveyed into and out of a folding device 7500. As shown in FIGS. 5-9, the folding device 7500 comprises a plurality of tiered folding bays 7505*a-n* (where "n" represents a total number of bays equal to or greater than 2 and equal to or greater than the total number of platters in the system 500) for folding a laundry article 7300 disposed on each of the plurality of platters 7100*a-n*. (In implementations described herein with regard to a single folding bay 7505, it is intended that like elements exist within the other bays of the plurality of folding bays 7505*a-n*. Descriptions provided with regard to a single folding bay 7505 are intended as examples applicable to all folding bays 7505*a-n*.) In implementations, the plurality of platters 7100*a-n* disposed within the system 500 is equal to at least a total number of tiered folding bays 7505*a-n* such that the autonomous assemblies (e.g., a folding robot 7000) disposed within folding bay 7505 can be simultaneously operating to fold laundry articles 7300*a-n*. Additionally, in implementations, two or more of the plurality of platters 7100*a-n* are configured to be disposed in at least two or more of the plurality of tiered folding bays 7505*a-n* and the loading elevator 7700. Each platter 7100 of the plurality of platters 7100*a-n* is interchangeable in each one of the plurality of tiered folding bays 7505*a-n*. The plurality of platters 7100*a-n* comprise identical platter couplings 7165*a-n* for mating with any of the plurality of receiving couplings 7510*a-n* as will be described subsequently with regard to implementations. In implementations, the plurality of platters 7100*a-n* are identical and interchangeable. In implementations, each one of the plurality of platters 7100*a-n* comprises a thickness of between about 5 mm and 45 mm. In implementations, each one of the plurality of platters 7100*a-n* comprises a thickness of between about 10 mm and 30 mm. In implementations, each one of the plurality of platters 7100*a-n* comprises a thickness of about 15 mm. In implementations, each one of the plurality of platters 7100*a-n* comprises a diameter of between about 75 cm to 304 cm. In implementations, each of the plurality of platters 7100*a-n* comprises a diameter of about 214 cm. Each one of the above-described plurality of elements is hereinafter referred to in examples in the singular interchangeably with and without particular designation (e.g., "the laundry article 7300," "the folding bay 7505," "the platter 7100," "the platter coupling 7165".)

At least one controller 7005 of the autonomously operating system 500 is configured to identify an unoccupied folding bay 7505 of the plurality of folding bays 7505*a-n* and instruct a loading elevator 7700 to deliver one of the plurality of platters 7100*a-n* and an unfolded laundry article 7300 thereon to the identified one of the plurality of folding bays 7505*a-n*. Once a laundry article 7300 is autonomously folded, an unloading elevator 7900 of the autonomously operating system 500 is configured to deliver one of the plurality of platters 7100*a-n* and the folded laundry article 7300 thereon from one of the plurality of folding bays 7505*a-n* to an unloading station 7950 for packing and return to a customer (e.g., residential household). The system 500 autonomously transfers each emptied platter 7100 back to a spreading station 7705 for receiving a next spread laundry article 7300 in a load of clean laundry articles 7300*a-n*. Because the spreading process at the spreading station 7705 can take less time than a folding cycle, having more than one folding station 7505*a-n* available for concurrently folding a plurality of laundry articles 7300*a-n* prevents a production bottleneck in the process line 100. This ensures the system 500 efficiently delivers a load of cleaned and folded laundry to a packing robot 8000 for an expeditious return to a customer. Implementations of various autonomous robotic assemblies of the system 500 subsequently will be described in detail. As depicted in the implementation of FIGS. 5-9, the plurality of tiered folding bays 7505*a-n* comprises two bays, a lower folding bay 7505*a* and an upper folding bay 7505*b* and the number of platters 7100*a-n* in the system 5000 comprises at least four platters 7100*a-d* distributed throughout the various robotic stations (e.g., 7705, 6000, 7700, 7500, 7950, 7900) of the system 500.

As shown in FIGS. 10A-12, in implementations, each of the plurality of rotatable platters 7100*a-n* comprises a platter coupling 7165 configured to reversibly engage with a receiving coupling 7510 disposed with in a folding bay 7505, the receiving coupling 7510 being configured to rotate a received platter 7100 about a spin axis Tz (e.g., vertical axis Tz). The receiving coupling is one of a plurality of receiving couplings 7510*a-b*, each one of which is disposed within a single folding bay 7505 of the plurality of folding bays. (Each one of these plurality of elements is hereinafter referred to in examples in the singular interchangeably with and without particular designation.) In implementations, the spin axis Tz is vertically aligned through the center 7107 of the platter 7100. The platter coupling 7165 is configured to be disposed on an underside surface 7106 of the platter 7100. In implementations, as will be described subsequently in detail with regard to FIGS. 12 and 22-24, the platter coupling 7165 is a protrusion configured to extend from the underside surface 7106 of the platter 7100 and the receiving coupling 7510 is configured to receive the protruding platter coupling 7165 in a bore 7513 formed therein. In implementations, platter coupling 7165 can be affixed to an underside surface of the platter 7100 with one or more mechanical fasteners such as bolts, screws, rivets, clamps, and a press fit interlock. Alternatively, the platter coupling 7165 can be formed monolithically with the platter 7100. In implementations, the platter coupling 7165 is a protrusion extending from the bottom surface 7106 of the platter 7100 for engaging a bore disposed within the receiving coupling. Alternatively, in implementations, the receiving coupling is configured to comprise a protrusion and the platter coupling comprises a bore configured to receive the protrusion.

Returning now to the system 500, a top surface 7105 of the platter 7100 is configured to receive thereon a laundry article 7300 of the plurality of laundry articles 7300*a-n* in a load of cleaned household laundry. The received laundry article 7300 is at least one of spread apart and partially folded by a preceding spreading station 7705 servicing the plurality of tiered folding bays 7505*a-n*. The spreading station 7705 functions as a repositioning robot 6000 when a rotatable platter 7100 is disposed therewithin, such as a repositioning robot described in U.S. Patent Publication No. US20210370517, "ROBOTIC LAUNDRY DEVICES AND METHODS OF USE," herein incorporated by reference in its entirety.

Within the spreading station 7705, the laundry article is at least one of spread and at least partially folded by a plurality of lifters 6100*a-n* configured to lift and spread the laundry article 7300 above the spreading height Hsp (e.g., the vertical distance measured from the surface upon which the spreading station is mounted (e.g. a ground floor 10 or mezzanine floor) to a top surface 7105 of the platter 7100. In implementations, the plurality of lifters 6100*a-n* comprises at least three lifters. In implementations, the plurality of lifters 6100*a-n* comprises four lifters 6100*a-d*. Additionally, in implementations, no more than two the plurality of lifters 6100*a-n* are disposed along a straight line. In implementations, the plurality of lifters 6100*a-n* comprises four lifters 6100*a-d* disposed at each of four corners of a polygon (e.g., a rectangle, a square, a diamond, a trapezoid) defined by a straight lines connecting each lifter to the next as traced in a sequential order. Each of the plurality of lifters 6100*a-n* perform at least one of a grab, lift, pan, tilt, extend, and release of portions of the article to unfurl and spread apart the laundry article for folding as described in US20210370517. The plurality of lifters 6100*a-n* are disposed about the top surface 7105 of the platter 7100 disposed within the loading elevator 7700 at the spreading height Hsp. The spreading height Hsp coincides with a bottom plane of a work volume 7707 (FIGS. 5-8) within which a plurality of lifters 6100*a-n* receive the laundry article, spread the laundry article, and lay the spread laundry article on the top surface 7105 of the platter 7100 in a spread state. Each one of the plurality of lifters 6100*a-n* comprises an arm 6110 configured to at least one of pan, tilt, and extend from a stationary support 6102. The arm 6110 terminates in an actuatable gripper 6105. In implementations, the stationary two supports 6102*c-d* closest to the loading elevator 7700 can comprise a jog, or approximately 90 degree inward bend coupled with an upward 90 degree bend disposed above the spreading height Hsp, that places an upper portion of the support closer to the spreading station 7705 than the lower portion attached to the floor 10 beneath the spreading station 7705. This jog enables a platter 7100 that is wider than the bases of the supports 6102*a-n* to move under the supports closest to the plurality of tiered folding bays 7505*a-n* from a return conveyor 7990 and lift up to the spreading height within the loading elevator 7700 without requiring the lifters closest to the tiered folding bays 7505*a-n* be placed further away from the platter 7100 than the other lifters.

Figure 5:
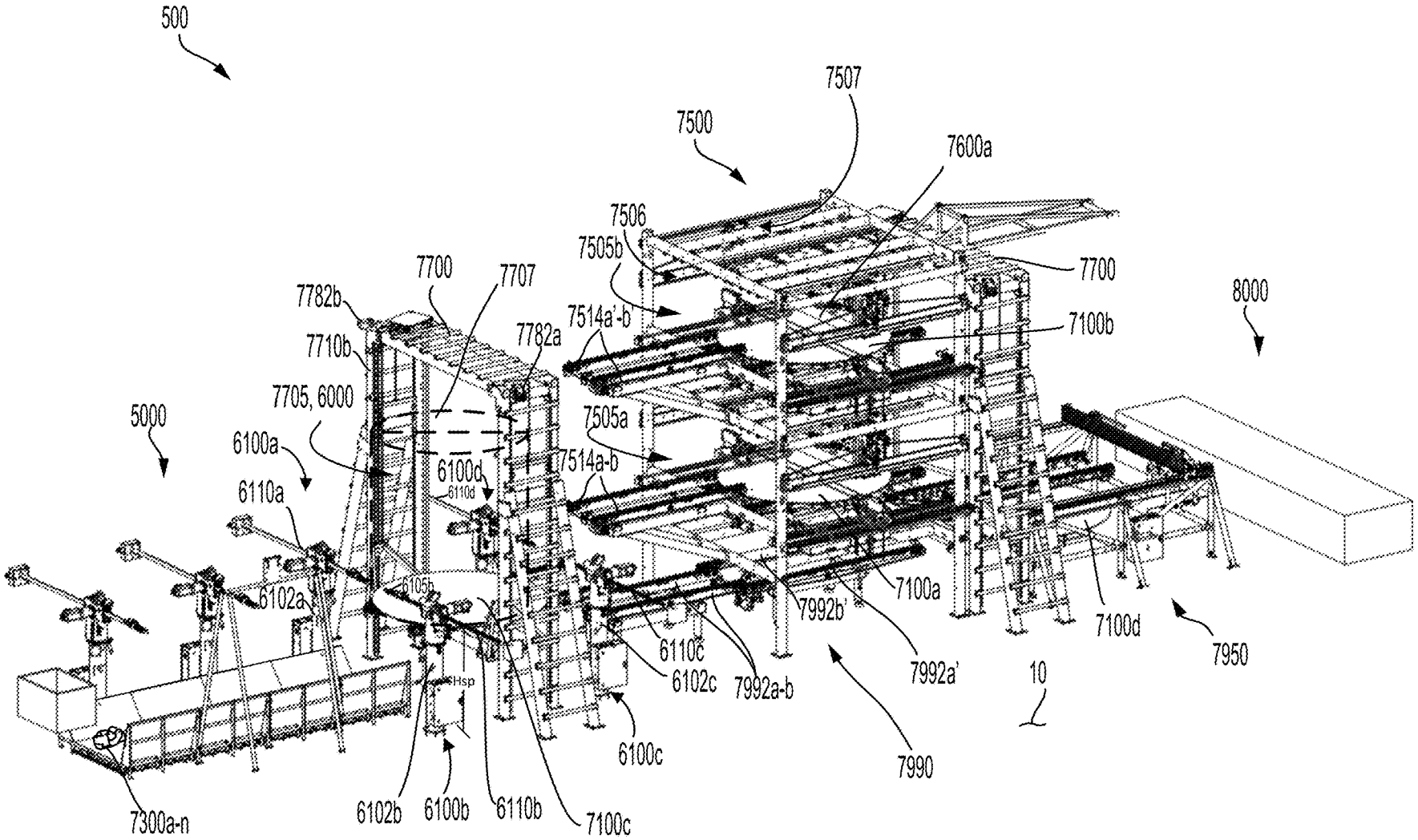
FIG. 5 depicts an end perspective view of an example of an autonomous tiered folding system.
Figure 6:
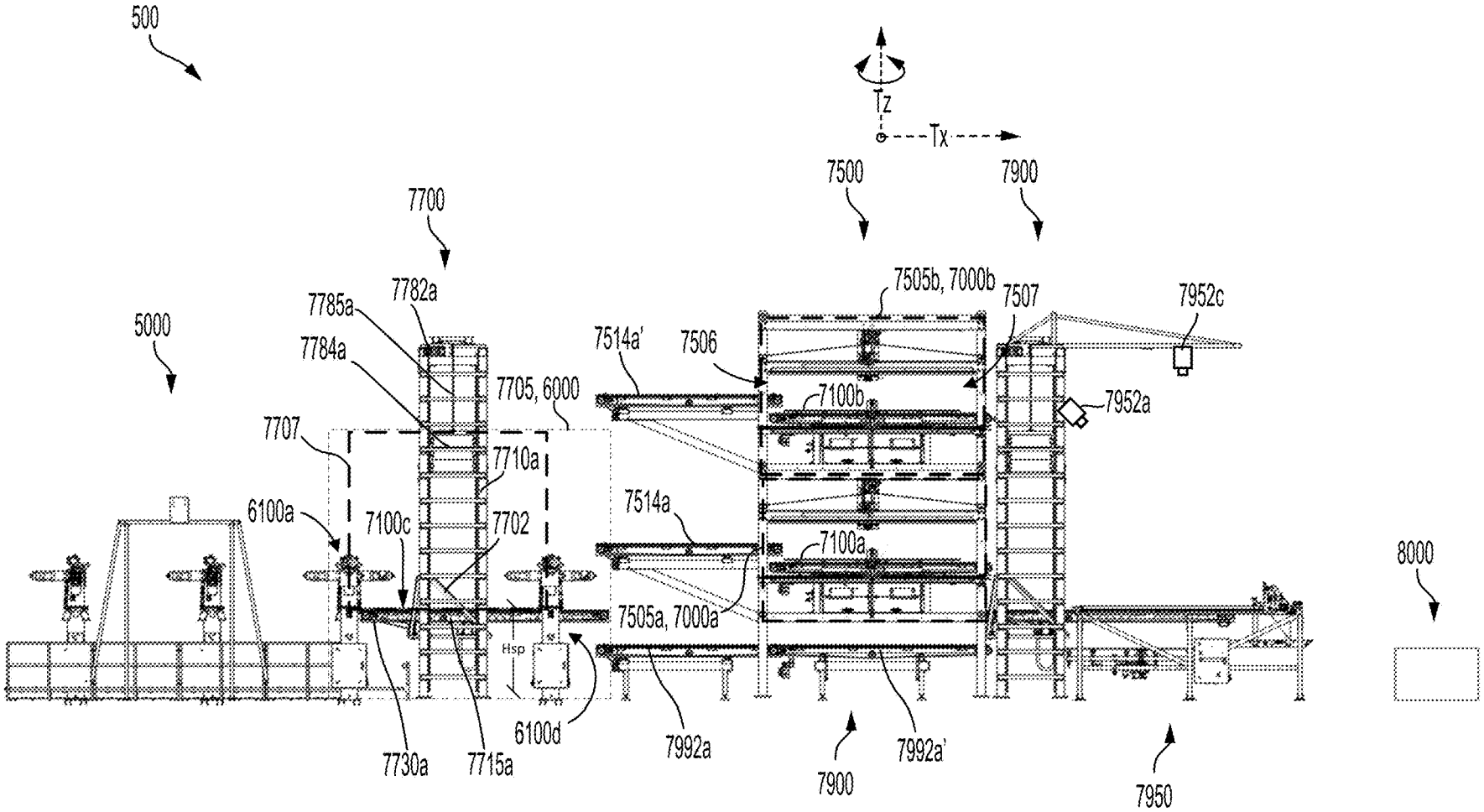
FIG. 6 depicts a side view of the example autonomous tiered folding system of FIG. 5.
Figure 8:
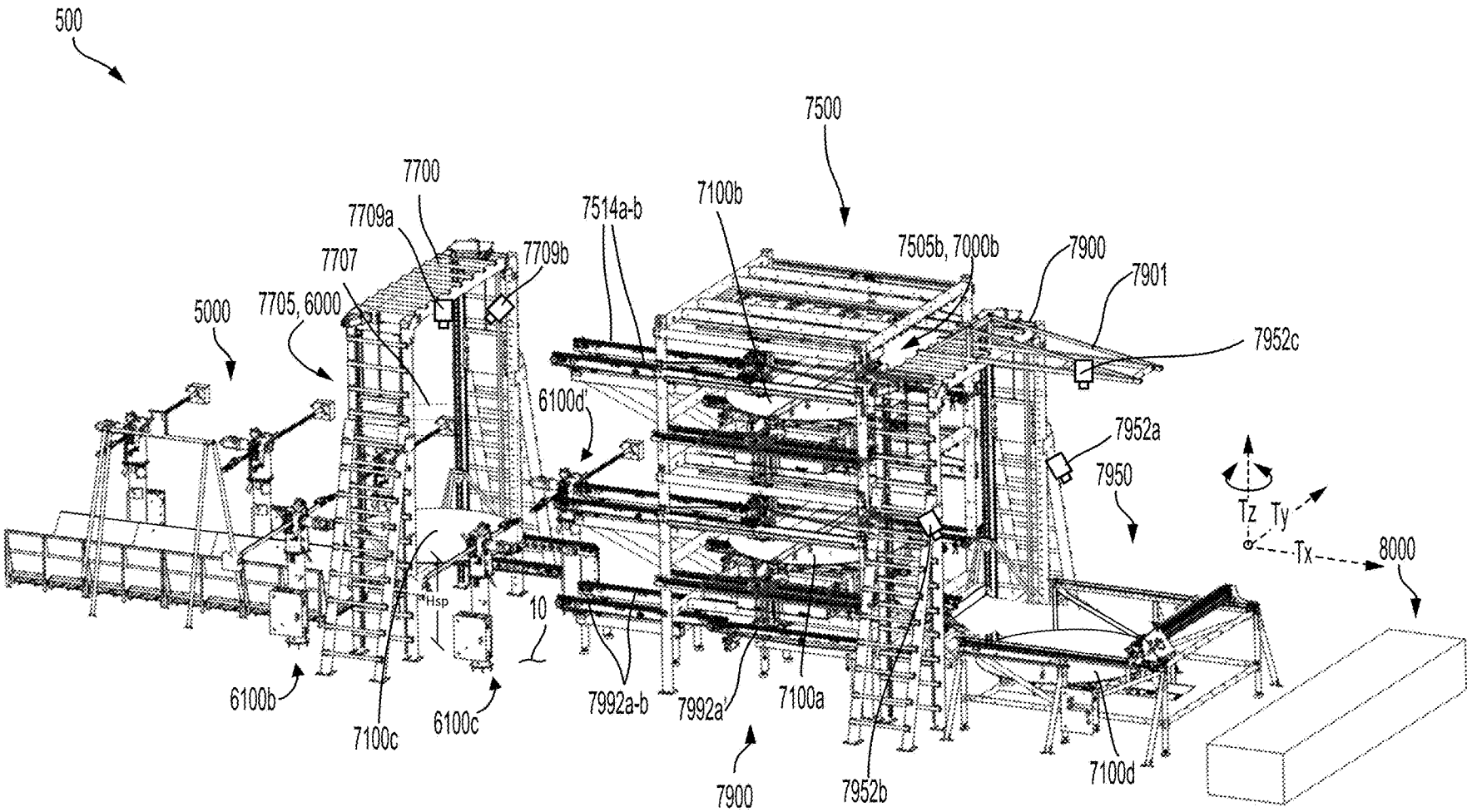
FIG. 8 depicts an end perspective view of the example autonomous tiered folding system of FIGS. 5-7.

As shown in FIGS. 5-6 and 8, when a platter 7100 is received into the spreading station 7705, the platter 7100 defines a bottom surface of a work volume 7707 and is analogous to the platter at the bottom of the work volume of the repositioning robot 6000 of US20210370517. Additionally in implementations, as described in US20210370517, one or more sensors are disposed about the work volume 7707. The one or more sensors 7709*a-n* are configured to detect at least one of a presence, orientation, and spread status of a laundry article disposed within the work volume 7707. In implementations, the one or more sensors 7709*a-n* are disposed on at least one of one or more supports 6102*a-n* of the lifters 6100*a-n* and on the loading elevator 7700.

Figure 9:
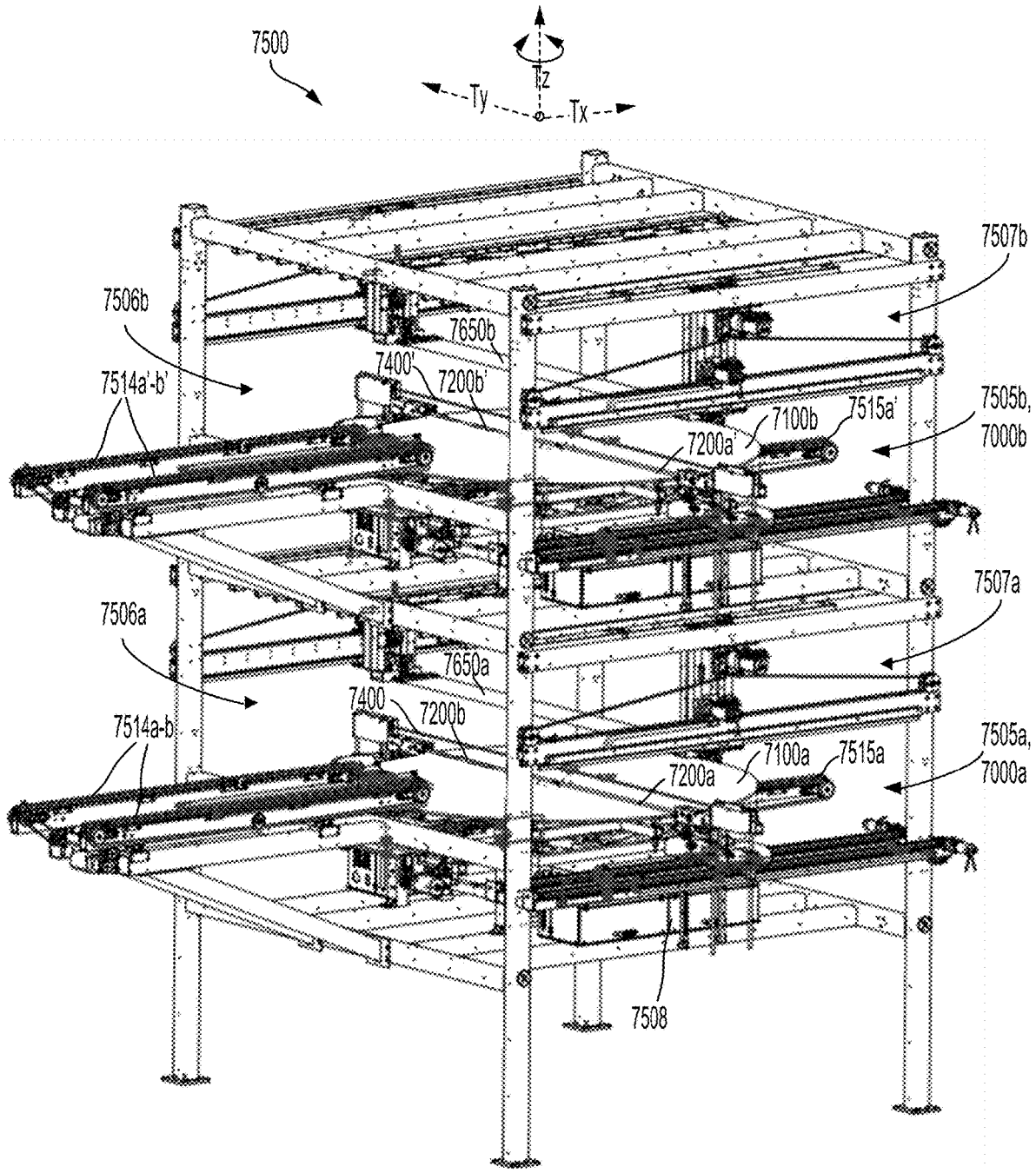
FIG. 9 depicts a perspective side view of a tiered folding bay portion of an example autonomous tiered folding system of FIGS. 5-8.

Following the spreading station 7705, the system 500 comprises the plurality of tiered folding bays 7505*a-n*. As shown in FIG. 9, in implementations, the plurality of tiered folding bays 7505*a-n* comprise two or more folding bays 7505*a-n* stacked vertically atop one another in a tower formation. This reduces floorspace occupied by the plurality of tiered folding bays 7505*a-n* to an area footprint of a single folding robot 7000. The process line 100 therefore comprises increased throughput of folded articles without increased cost associated with occupied square footage on a facility floorplan. Each bay of the plurality of tiered folding bays 7505*a-n* functions as a folding robot 7000*a-n* when a rotatable platter is disposed therewithin, such as a folding robot 7000 described in U.S. Pat. No. 11,486,084, "AUTONOMOUS LAUNDRY FOLDING DEVICES, SYSTEMS, AND METHODS OF USE", herein incorporated by reference in its entirety.

Figure 10A:
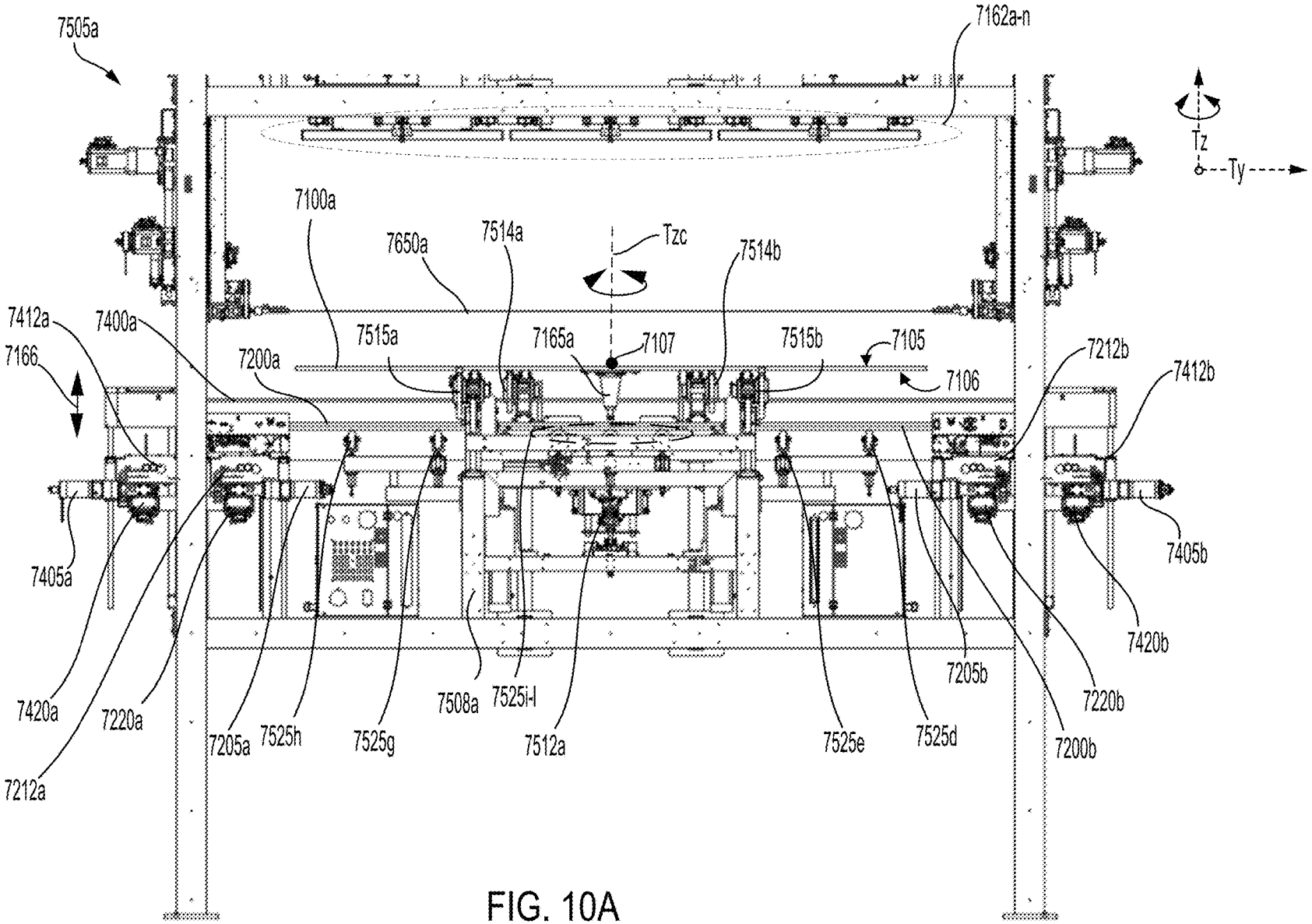
FIG. 10A depicts an end view from a second open end of a single folding bay of the exampled tiered folding system of FIG. 9 depicting a rotatable, releasable platter raised above a receiving coupling within the bay.
Figure 10B:
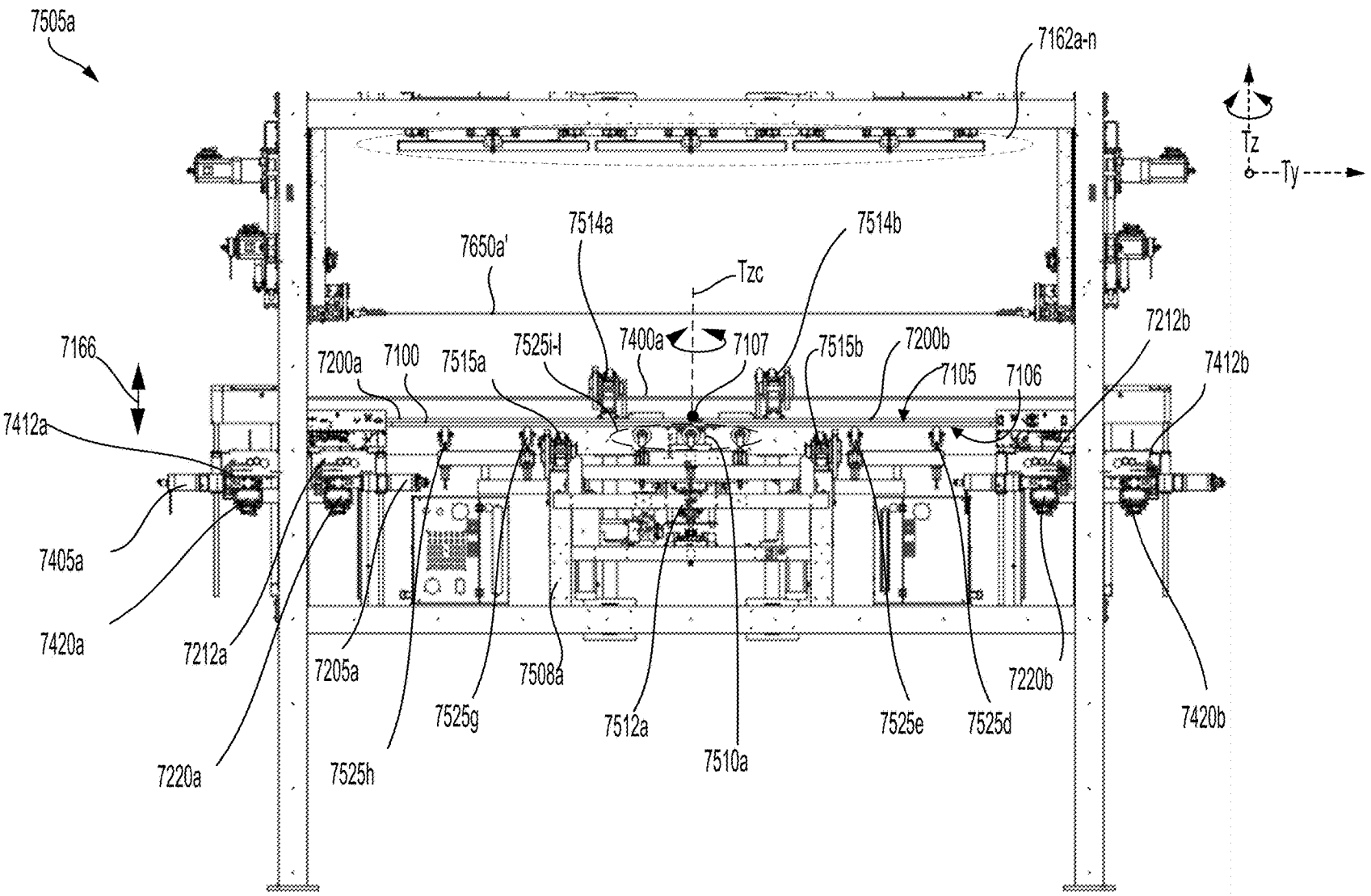
FIG. 10B depicts the end view of FIG. 10A depicting the rotatable platter lowered into engagement with a receiving coupling within the bay.
Figure 11A:
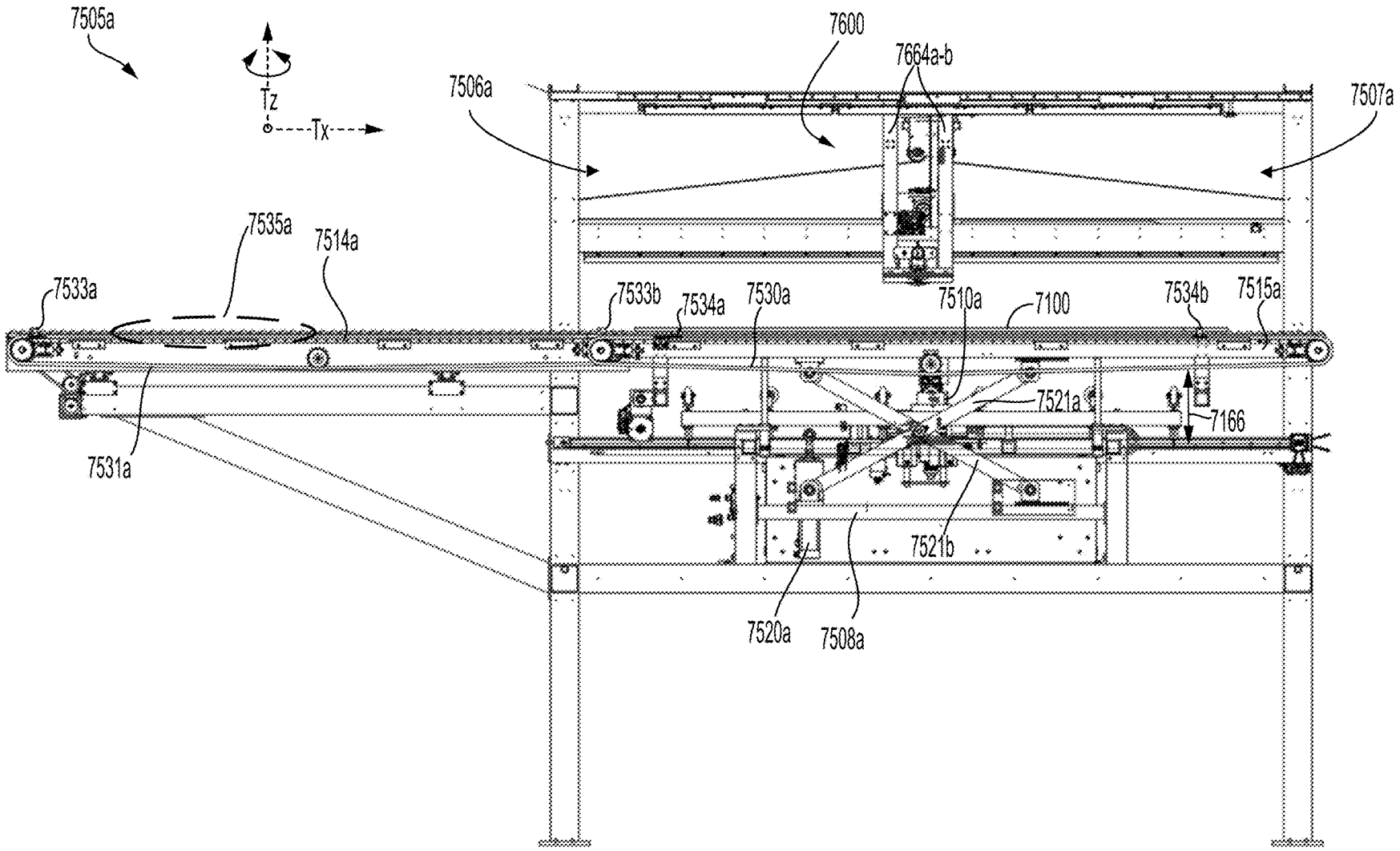
FIG. 11A depicts a cross sectional side view of the example rotatable platter and folding bay of FIG. 10A.

As shown for example in FIG. 9, in implementations, the plurality of tiered folding bays 7505*a-n* comprises two folding bays, 7505*a-b* vertically stacked to define a folding device 7500 in the form of a tower. In implementations each bay 7505, 7505*a-b* (hereinafter referred to interchangeably with and without designation in the singular as "the folding bay 7505") is configured to receive any one of the plurality of platters 7100*a-n* through a first open end 7506, 7506*a-b* (hereinafter referred to interchangeably with and without particular designation as the singular as "the open end 7506"). As depicted in FIGS. 10B and 11A, in implementations, each folding bay 7505, 7505*a-b* of the plurality of tiered folding bays 7505*a-n* comprises a receiving coupling 7510 configured to receive and retain a platter coupling 7165 such that the top surface 7105 of the platter 7100 and a laundry article 7300 disposed thereon remain level during engagement, disengagement and while rotating in an engaged state.

Figure 11B:
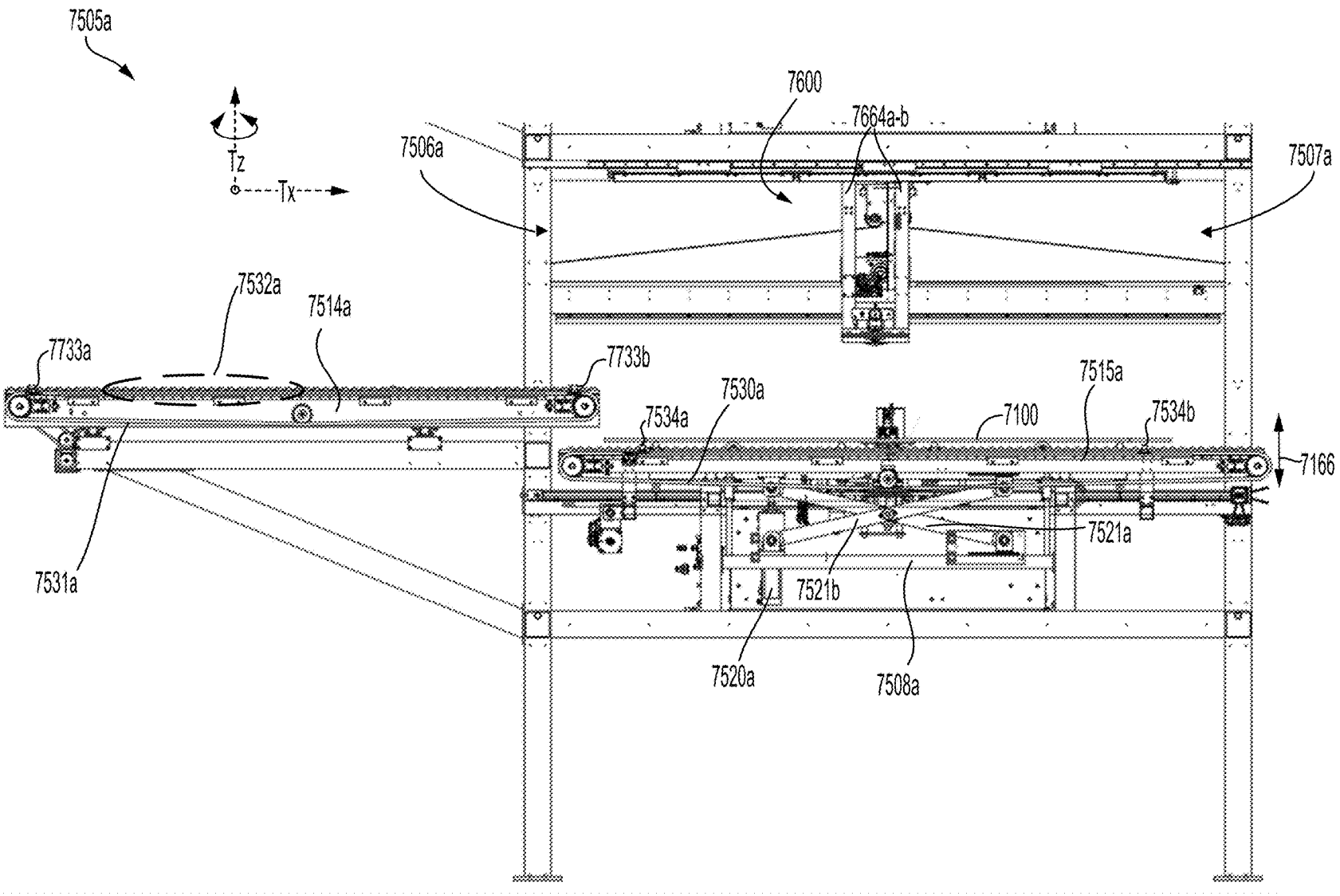
FIG. 11B depicts a cross sectional side view of the example rotatable platter and folding bay of FIG. 10B.

As will be described subsequently in detail with regard to implementations, each receiving coupling 7510 is configured to be disposed on and affixed to a support frame 7508 affixed withing the bay 7505. Each folding bay 7505, 7505*a-n* comprises a lifting mechanism, for example one or more pneumatic pistons, configured to separate the platter coupling 7165 from the receiving coupling 7510 by simultaneously pushing upward to raise a pair of transfer conveyors supporting the platter 7100 within the folding bay 7505. FIGS. 10A and 11A show respective end and cross sectional side views of a folding bay 7505 with the support frame 7508 extending upward such the pair of transfer conveyors 7515*a-b* disposed on the support frame are vertically aligned with a pair of support rails 7514*a-b* for receiving a platter 7100 entering the folding bay 7505. FIGS. 10B and 11B show respective end and cross sectional side views of the folding bay 7505 with the platter 7100 lowered by the support frame 7508 such that the platter coupling 7165 mates with the receiving coupling 7510.

As shown in FIGS. 10A-11B and 13A-B, in implementations the lifting mechanism of the support frame 7508 comprises bilateral pairs of scissor arms 7521*a-b*, 7521*a'-b'* having disposed thereon a pair of transfer conveyors 7515*a-b*. In implementations, the lifting mechanism for each pair of scissor arms 7521*a-b*, 7521*a'-b'* comprises one or more actuators (e.g., pneumatic pistons 7520, 7520*a-b*) that pushes up on at least one of the mechanically linked arms of each pair of scissors arms 7521*a'-b'*. In implementations, the actuators 7520*a-b* are operable communication with one or more controllers (e.g., controller 7005, remote terminal 205) for coordinating timing of platter lifting and conveying operations.

Figure 13A:
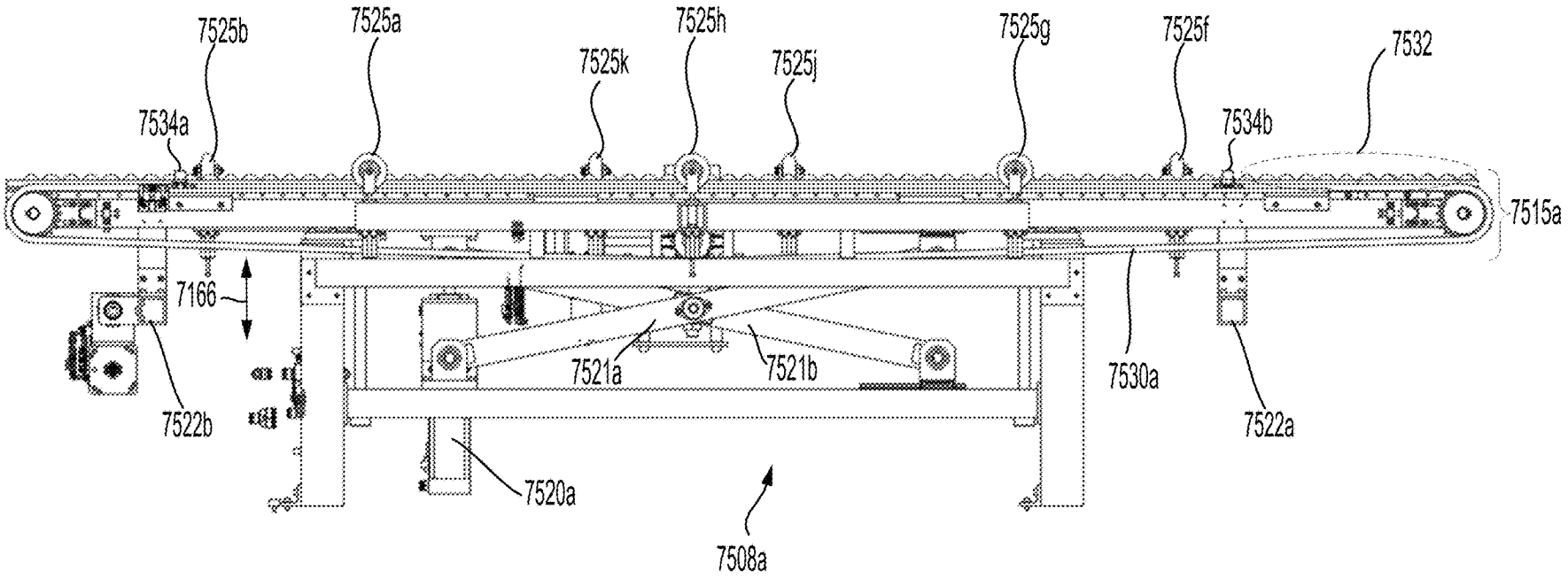
FIG. 13A depicts a side view of an example receiving coupling, transfer conveyors, transfer conveyer lift system, and transfer conveyor support frame of the autonomous tiered folding system of FIGS. 10A-11B.
Figure 13B:
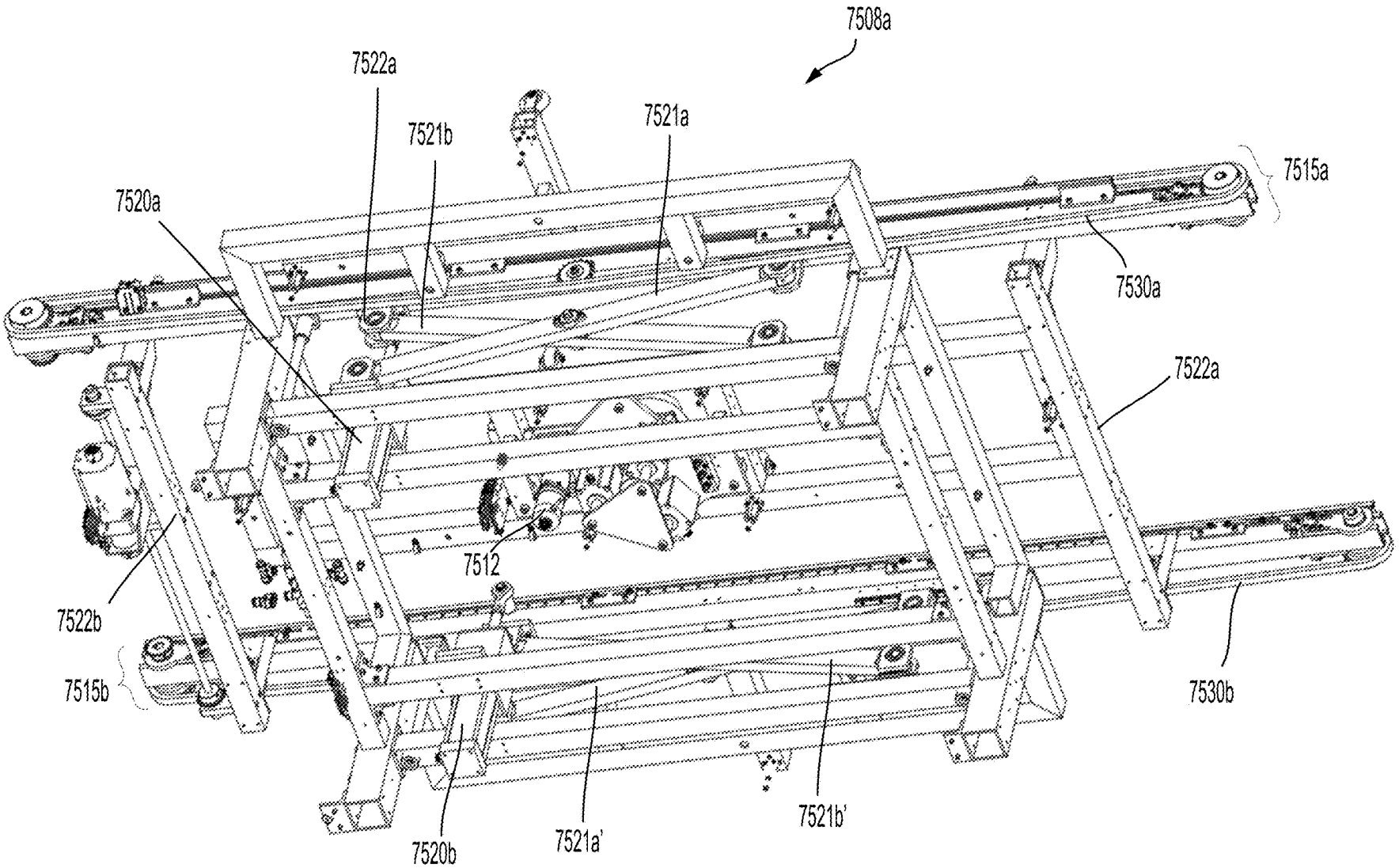
FIG. 13B depicts a perspective underside view of the example receiving coupling, transfer conveyors, transfer conveyer lift system, and transfer conveyor support frame of the autonomous tiered folding system of FIG. 13A.

In implementations, as shown for example in FIG. 13B, one scissor arm 7521*a* is fixed to a rail affixed to one of the pair of transfer conveyors 7515*a-b*. The other scissor arm 7521*b* engages a bracket 7522*a* configured to slide back and forth on the rail (e.g., MGN rail, SBR rail, etc.) when raised and lowered by an engaged actuator 7520*a*, and the sliding scissor arm 2521*b* pulls the other, fixed scissor arm 7521*a'* up or down in tandem such that the transfer conveyor 7515*a* disposed thereon raises and lowers in a horizontally level state. In implementations, one or more cross bars 7522*a-b* tie together the two conveyors of the pair of transfer conveyors 7515*a-b* for level lifting of the entire length of each conveyor. In implementations, one or both sides of the scissor lift support frame 7508 comprises an actuator 7520, 7520*a-b*. In implementations in which both sides of the scissor lift support frame 7508 comprise an actuator 7520, a single actuator 7520 could lift both conveyors of the pair of transfer conveyors 7515*a-b* if the other actuator fail because the one or more cross bars 7522*a-b* tie the two conveyors of the pair of transfer conveyors 7515*a-b* together such that the transfer conveyors 7515*a-b* raise and lower synchronously.

As will be described subsequently with regard to implementations, the rotatable platter 7100 is configured to be lowered and raised vertically (e.g., in the direction of double arrow 7166) in a level orientation as the platter coupling 7165 inserts into and out of the receiving coupling 7510 in mated engagement.

Returning to FIGS. 10A-B, a drive motor 7512 operably connected to the receiving coupling 7510 is configured to bidirectionally rotate the received platter 7100 about the spin axis Tz. Each folding bay 7505 comprises a plurality of actuated folding mechanisms configured to engage and fold a laundry article 7300 disposed on the received platter 7100. For example, the actuated folding mechanisms comprise at least one of one or more sliding folding rods 7200, 7200*a-b*, one or more sweep rods 7400, and at least one sweeping and folding blade configured to at least one of clamp, sweep, and fold the spread laundry article 7300 onto itself. Clamping, sweeping, and folding mechanisms disposed within each one of the plurality of folding bays 7505*a-n* will be described subsequently in detail with regard to implementations.

Figure 7:
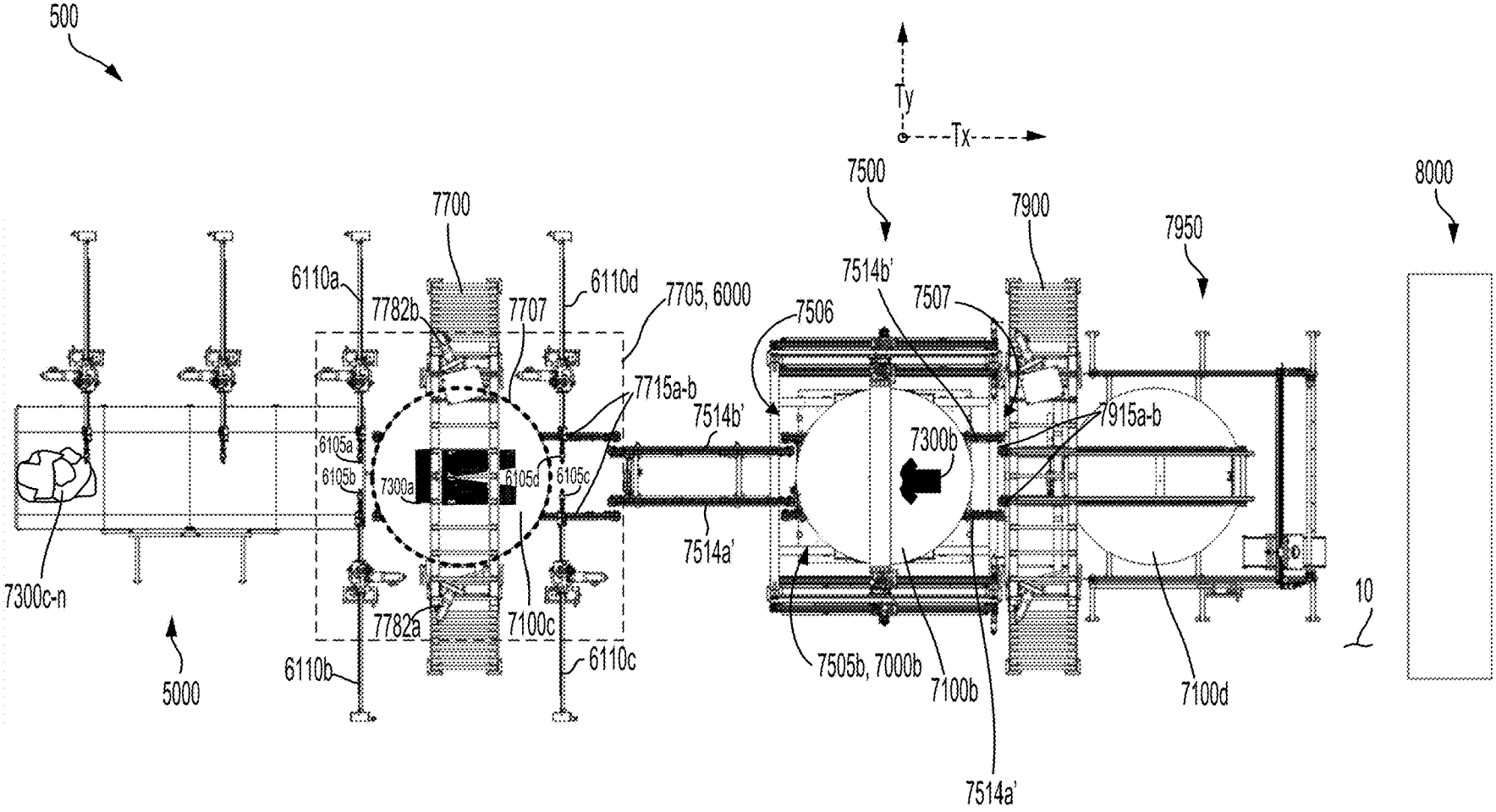
FIG. 7 depicts a top view of the example autonomous tiered folding system of FIGS. 5 and 6.

Returning now to the movements of a platter 7100 through the system 500, as shown in the top-down view of the system 500 in FIG. 7, in implementations, each folding bay 7505 comprises a pair of transfer conveyors 7515*a-b*, 7515*a'-b'* disposed within its corresponding folding bay 7505, 7505*a-b*. As shown for example in FIGS. 7 and 11A, in implementations, the pair of transfer conveyors 7515*a-b* are offset such that a length of the transfer conveyor 7515*a-b* extends further beyond the second open end 7507 of the bay 7505 and no length extends beyond the first open end 7506. Each pair of transfer conveyors 7515*a-b*, 7515*a'-b'* is configured to receive a platter 7100 and an unfolded laundry article 7300 disposed thereon through the first open end 7506, lower the platter coupling 7165 into the receiving coupling 7510, and remain stationary below the platter 7100 and not touching the underside surface 7106 during a folding cycle. In implementations, the pair of transfer conveyors 7515*a-b* is configured to extend beyond at least one of the first and second open ends 7506, 7507. Alternatively, in implementations, as shown in FIGS. 11A-B, each pair of transfer conveyors 7515*a-b* is disposed wholly or substantially wholly (e.g., FIG. 11A) within its bay 7505*a*, and, when raised, align with a pair of affixed intermediary rails 7514*a-b* extending from the bay 7505*a*. The pair of intermediary support rails 7514*a-b* then align with the pair of loading conveyors 7715*a-b* disposed on the loading elevator 7700. The pair of intermediary rails thus align to create a continuous support surface with the pair of raised loading conveyors 7515*a-b* elevated to their highest position, as shown in FIG. 11A. In implementations, at least one of a pair of unloading conveyors 7915*a-b*, a pair of loading conveyors 7715*a-b*, and intermediary support rails 7514*a-b* are configured to nest with the pair of transfer conveyors 7515*a-b* so that they occupy a shared plane. For example, as shown in FIG. 7, a pair intermediary support rails 7514*a'-b'* (e.g., support rails 7514) are more closely spaced together than the transfer conveyors 7515*a'-b'* and nest within the transfer conveyors 7515*a'-b'* when occupying a shared plan during a platter transfer.

Taking for example the first folding bay 7505*a*, in implementations, the pair of intermediary support rails7514*a-b* comprise roller surfaces 7535*a*, 7535*b* (FIGS. 11A-B and 18) on which a transferring platter 7100 slides into the bay 7505*a* and onto the transfer conveyors 7515*a-b*. In implementations, the pair of supports 7514*a-b* comprise actuatable conveyors such as those that will be describe with regard to implementations of the transfer conveyors 7515*a-b*, loading conveyors 7715*a-b*, and unloading conveyors 7915*a-b*. In implementations, the pair of intermediary support rails7514*a-b* comprise at least one of a driven chain, belt, and rollers. In implementations, the pair of intermediary support rails7514*a-b* are cantilevered from the bay 7505*a* at the first open end 7506. The pair of intermediary support rails7514*a-b* prevents the transfer conveyors 7515*a-b* from having to be longer and extend from the bay 7505*a*. The pair of transfer conveyors 7515*a-b* can be centered over the support frame 7508 in an even weight distribution for raising and lowering in a level state.

As depicted in FIG. 11A, following folding completion, the support frame 7508 is configured to raise the pair of transfer conveyors 7515*a-b* and the platter 7100*a* thereon thereby lifting the platter coupling 7165*a* from the receiving coupling 7510*a*. The pair of transfer conveyors 7515*a-b* is configured to discharge the platter 7100*a* and a folded laundry article (not shown for clarity) disposed thereon through a second open end 7507*a* opposite the first open end 7506*a* at the completion of a folding cycle. Folding cycle completion can be determined autonomously by one or more controllers and/or processors as described in US20220002936 incorporated herein by reference. Additionally or alternatively, folding completion can be determined by a user reviewing an image of the folded article 7300 and accepting the folding as completed and acceptable. In implementations, the user can be, for example, a line operator or a customer who owns the folded laundry article 7300. The user can receive an image of the folded article 7300 on a remote device display screen (e.g., smartphone, tablet, PC, etc.) and instruct the system 500 to deliver the folded laundry article 7300 to a packing robot 8000 or to deliver the folded laundry article back to the spreading station 7705 (e.g., a repositioning robot 6000) for spreading apart before attempting another folding cycle. In all implementations, one or more controllers 7005, 205 of the controls system 400 can learn to automatically detect acceptable folds for various types of articles (e.g., shirts, pants, dresses, etc.) over time using, for example, a neural network. For example, each time a laundry article is subsequently washed and handled, the controls system 400 can detect the article as previously having been folded by the folding system 500 and automatically determine an acceptable fold without requiring user intervention.

In implementations, the transfer conveyors 7515*a-b*, 7515*a'-b'* are wholly disposed within a folding bay 7505, 7505*a-b*. Alternatively, as shown in the implementation of FIG. 7, a relatively small portion of length of the pair of transfer conveyors 7515*a-b* can extend through the second open end 7507 of a folding bay 7505. Additionally or alternatively, a portion of the length of the pair of transfer conveyors can extend beyond at least one of the first and second open ends 7506, 7507. Additionally or alternatively, in implementations, the pair of transfer conveyors can be offset such that a length of the transfer conveyor extends further beyond the first open end 7506 of a bay 7505 than the second open end 7507. Alternatively, in implementations, the pair of transfer conveyors can be positioned within a folding bay 7505 so as to extend to even lengths beyond the first open end 7506 and the second open end 7507. Alternatively, in implementations as previously described and shown in FIGS. 7 and 11A-B, the pair of transfer conveyors 7515*a-b* are offset such that a length of the transfer conveyor 7515*a-b* extends further beyond the second open end 7507 of the bay 7505 and no length extends beyond the first open end 7506. Alternatively, in implementations, the pair of transfer conveyors 7515*a-b* are offset such that a length of the transfer conveyor 7515*a-b* extends further beyond the first open end 7506 of the bay 7505 and no length extends beyond the second open end 7507. Extending a pair of transfer conveyors beyond an open end 7506, 7507 of a folding bay 7505 assists with overlapping lengths and nesting with other pairs of conveyors and rails for creating a level surface for transiting a platter 7100 into and out of the bay without any gaps that could cause the platter to wobble or tip during transitions from one pair of conveyors (or rails) to the next. Alternatively, in implementations, the system 500 can tolerate small gaps between adjacent ends of conveyors and rails in a range of between about 1 cm to 20 cm.

Turning now to FIGS. 5-8, each of the plurality of platters 7100*a-d* is delivered to one of the plurality of folding bays 7505*a-b* by a loading elevator 7700. In implementations the loading elevator 7700 is disposed adjacent the first open end 7506, 7506*a-b* of each folding bay 7505, 7505*a-b* of the folding device 7500 (e.g., tower of stacked folding bays 7505*a-b*). In implementations, the loading elevator 7700 is configured to raise a platter 7100 to an unoccupied one of the plurality of tiered folding bays 7505*a-n* from a spreading height Hsp (FIGS. 5-6 and 8) at which the laundry article 7300 is received onto the platter 7100 in at least one of a spread state and a partially folded state. Additionally or alternatively, in implementations, the loading elevator 7700 is configured to lower a platter 7100 disposed thereon into an unoccupied folding bay 7505 of the plurality of tiered folding bays 7505*a-n*. Additionally or alternatively, in implementations, the loading elevator 7700 need not raise or lower the platter 7100 to transfer the platter 7100 into an unoccupied folding bay 7505 adjacent to a spreading station 7705 at the spreading height Hsp.

In implementations, as shown for example in FIG. 7, the system 500 comprises a pair of loading conveyors 7715*a-b* disposed within the loading elevator 7700 configured to support a platter 7100*c* disposed thereon. The pair of loading conveyors 7715*a-b* is configured to contact a bottom surface 7106 of a platter 7100*c*. In implementations, the pair of loading conveyors 7715*a-b* comprise a fixed length. Additionally or alternatively, the conveyors can be configured to slide toward and away from the plurality of folding bays 7505*a-n* to transit the platter onto a pair of transfer conveyors 7515*a-b*, 7515*a'-b'*. Additionally or alternatively, in implementations, the pair of loading conveyors 7715*a-b* can comprise an extendable portion, such as a telescopic conveyor or pull nose conveyor. In implementations, as shown in FIG. 7, the pair of loading conveyors 7715*a-b* are spaced apart to receive a downwardly protruding platter coupling 7165 therebetween.

A vertical drive 7780 (FIG. 4) of the loading elevator 7700 is configured to instruct one or more drive motors 7782, 7782*a-b* (FIGS. 5-7) to at least one of raise and lower the pair of loading conveyors 7715*a-b* with a platter 7100 and laundry article 7300 disposed thereon to one of the plurality of tiered folding bays 7505*a-n*. Additionally, the vertical drive 7780 of the loading elevator 7700 is configured is configured to instruct the one or more drive motors 7782, 7782*a-b* to at least one of raise and lower the pair of loading conveyors 7715*a-b* to align with and receive an empty platter 7100 of the plurality of rotatable platters 7100*a-n* from a return conveyor 7990 disposed at least one of beneath and laterally adjacent the plurality of folding bays 7505*a-n*. The one or more drive motors 7782, 7782*a-b* are configured to raise the empty platter 7100 from the return conveyor 7990 to the spreading height Hsp. In implementations, as shown in FIGS. 5-8, the return conveyor 7990 comprises one or more pairs driven conveyors 7992*a-b*, 7992*a'-b'* disposed on a floor 10 beneath the folding device 7500 (e.g., folding tower), the return conveyor 7990 extending between an unloading elevator 7900 and the loading elevator 7700. The return conveyor 7990 is configured to at least one of receive and store an empty platter 7100 from an unloading elevator 7900 and return the empty platter 7100 to the loading elevator 7700 for raising to the spreading height Hsp. In implementations, the return conveyor 7990 is configured to store one or more empty platters of the plurality of rotatable platters 7100*a-n*. In implementations, the return conveyor 7990 is configured to store a queue of two or more empty platters of the plurality of platters 7100*a-n*. Additionally or alternatively.

Once conveyed from the return conveyor 7990 into the loading elevator 7700 and raised to the spreading height Hsp, a platter 7100 is positioned to receive a next spread laundry article 7300. The loading elevator 7700 is configured to operate concurrently with at least one of folding operations within one or more of the plurality of folding bays 7505*a-n* and discharge operations comprising the unloading elevator 7900 unloading a platter 7100 and folded laundry article 7300 thereon from one of the plurality of tiered folding bays 7505*a-n*. The folding system 500 is thus configured to enable multiple concurrent processes to increase process line throughput of folded laundry articles. As shown in FIGS. 5-8, each of the folding bays 7505*a-b* can have disposed therein a platter 7100*a-b* and article (e.g., 7300*b* in upper folding bay 7505*b*) thereon for folding while simultaneously, the spreading station 7705, 6000 receives an empty platter 7100*c* therein for the start of a spreading operation on another laundry article 7300*a*. Also simultaneously, the unloading elevator 7900 can be delivering a folded laundry article on another platter 7100*d* to an unloading station for automated retrieval to a packing robot.

As shown in FIGS. 5-8, in implementations, the unloading elevator 7900 is disposed adjacent the second open end 7507 of the plurality of tiered folding bays 7505*a-n* (e.g., the tower of stacked folding bays 7505*a-b*, or folding device 7500) and is configured to retrieve and align a platter 7100 having a folded laundry article disposed thereon to an unloading station 7950. The unloading elevator 7900 is configured to raise and lower a platter 7100 thereon in a level orientation such that a folded laundry article 7300 thereon does not topple and/or unfold during discharge to the unloading station 7950 at which the folded article is retrieved for transfer to a packing robot 8000.

Figure 14B:
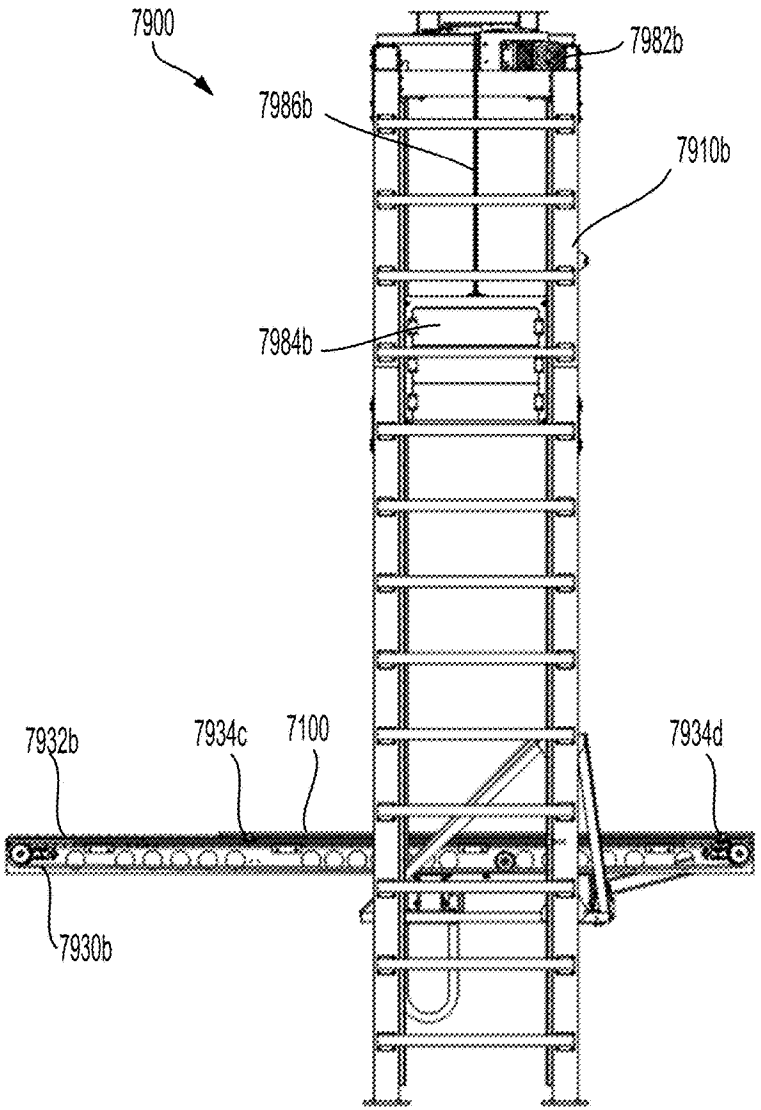
FIG. 14B depicts a side view of the unloading elevator of FIG. 14A.
Figure 14A:
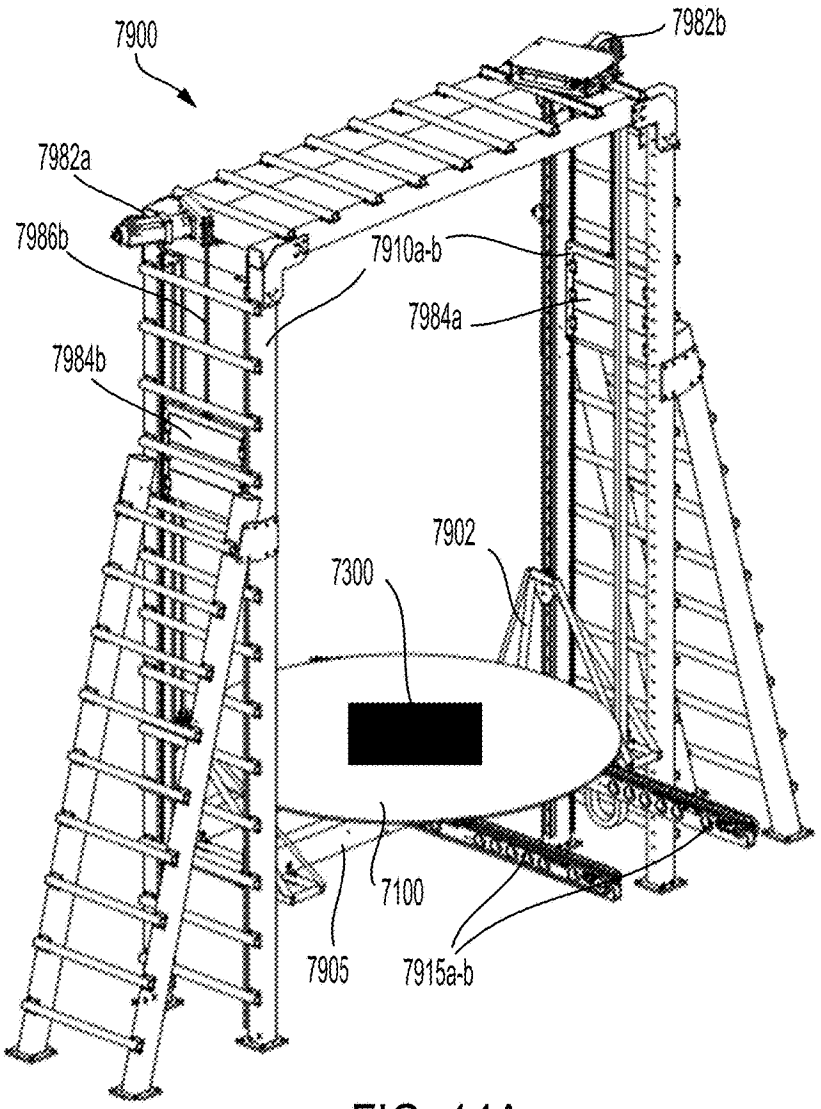
FIG. 14A depicts a perspective view of an example unloading elevator of an autonomous tiered folding system of FIGS. 5-8.
Figure 15:
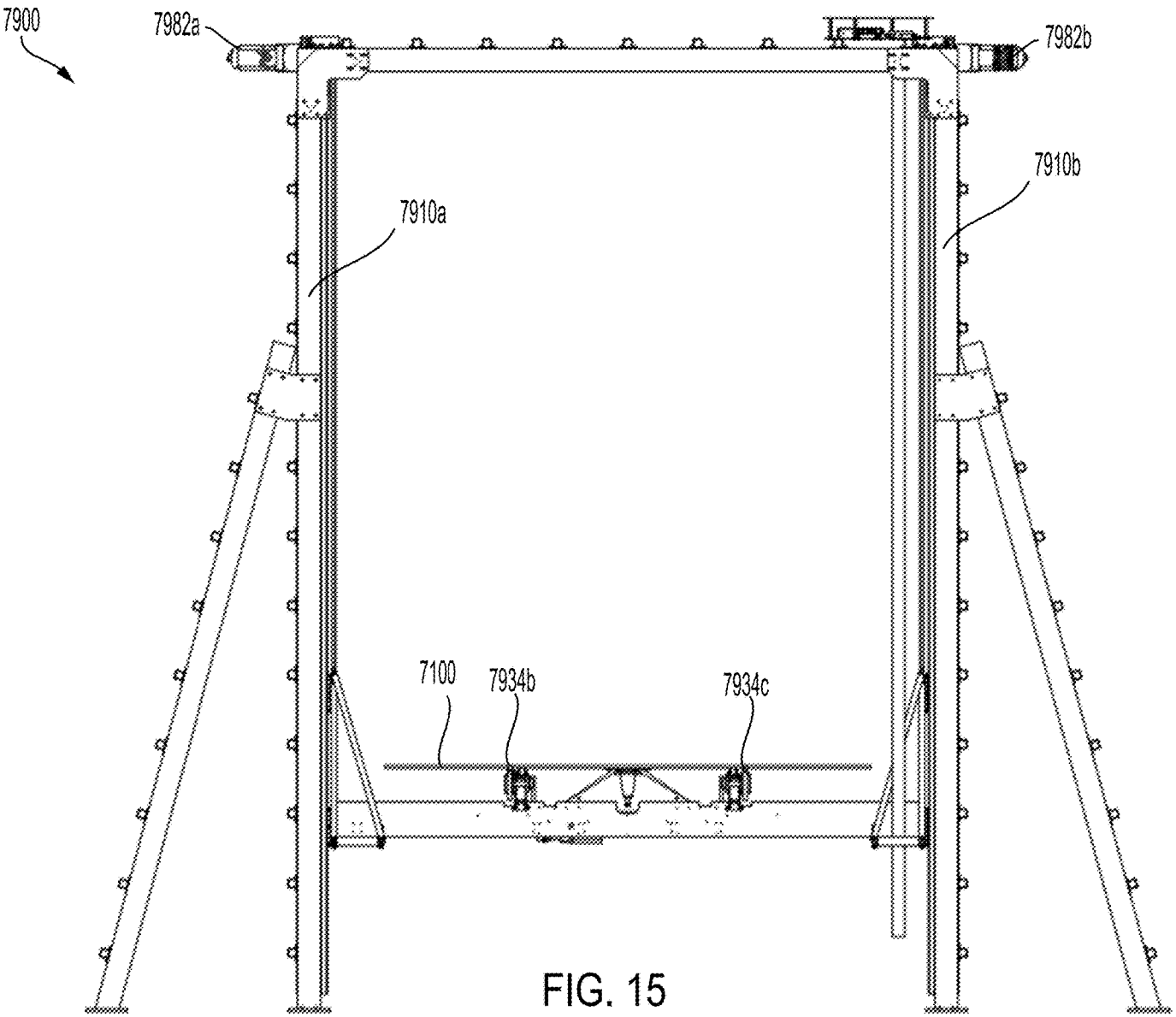
FIG. 15 depicts an end view of the unloading elevator of FIGS. 14A-B.

In implementations, the loading elevator 7700 and unloading elevator 7900 comprise analogous structural elements. As shown in FIGS. 14A-B and 15 in implementations, the unloading elevator 7900 comprises a carriage 7902 on which the pair of unloading conveyors 7915*a-b* is disposed. The carriage 7902 is configured to be raised and lowered between vertical supports 7910*a-b* by at least one drive motor 7982, 7982*a-b*. In implementations, the at least one drive motor 7982, 7982*a-b* comprises two synchronized drive motors each disposed adjacent a corresponding one of the vertical supports 7910*a-b*. Each of the two synchronized drive motors 7982*a-b* is configured to raise and lower a corresponding counterweight 7984*a-b*. In implementations each one of the counterweights 7984*a-b* is connected to a chain 7986*a-b* which is operably connected to a sprocket disposed on a motor shaft of a corresponding one of the synchronized drive motors 7982*a-b* in a coupled mating. The mated coupling transfers torque between the motor and the sprocket. In implementations, the coupling comprises at least one of a keyed shaft, a spline shaft, a clamp, and a press fit engagement of the shaft and sprocket. Both of the chains 7986*a-b* then synchronously lower and raise the carriage as the drive motors 7982*a-b* drive the chains and counterweights 7984*a-b* thereon up and down. In implementations, the pair of unloading conveyors 7915*a-b* is affixed to the carriage 7902. The unloading conveyors 7915 are affixed to support beams that can be at least one of welded, bolted, screwed, riveted, clamped, and adhered to the carriage 7902. As previously stated, as shown in FIGS. 5-6, the loading elevator 7700 comprises analogous components to those of the unloading elevator 7900, including at least a carriage 7702, drive motors 7782*a-b*, vertical supports 7710*a-b*, counterweights 7784*a-b*, and chains 7785*a-b*.

In implementations, the carriage 7902 of the unloading elevator and that of the loading elevator travel vertically with an acceleration rate of between about 1500-9500 mm/s^2 and a rate of travel in a range of between about 100-1000 mm/s. In implementations, vertical acceleration is in a range of between about 2500-3500 mm/s^2. In implementations, vertical acceleration is about 3000 mm/s^2. Selecting a maximum acceleration of 1 g or less prevents laundry articles from dislodging and/or floating off the top surface 7105 of the platter 7100. Additionally, selecting a maximum vertical speed of 1000 m/s avoids requiring large increases in required power to achieve associated time savings. Vertical speeds of more than 1000 m/s do not generate timing improvement to the output of the process line 100 and would require large increases in power supplied to the elevator motors 7982*a-b*. In addition to provisions for vertical speeds and accelerations, the loading conveyors 7715*a-b*, intermediary support rails 7514*a-b*, 7514*a'-b'* unloading conveyors 7915*a-b*, and transfer conveyors 7515*a-b*, 7515*a'-b'* comprise a horizontal acceleration in a range of between about 1500-9500 mm/s^2 and a velocity in a range of between about 100-400 mm/s. These ranges keep each of the plurality of platters 7100*a-n* moving quickly without causing light fabric to catch air and dislodge (e.g., lift, fold over on itself, twist, etc.) from the top surface 7105 of a platter 7100.

As previously described with regard to implementations, each pair of transfer conveyors 7515*a-b*, 7515*a'b'* is configured to extend align with a pair of intermediary support rails 7514*a-b*, 7514*a'-b'* extending from each one of the plurality of folding bays 7505*a-b*. Similarly, in implementations, the pair of loading conveyors 7715*a-b* is configured to extend outward from the loading elevator 7700 toward the transfer conveyors 7515*a-b* (and, in implementations, intermediary support rails 7514*a-b*, 7514*a'-b'*). The pair of unloading conveyors 7915*a-b* are configured to extend outward from the unloading elevator 7900, aligning at least one of end-to-end and slightly overlapped in length with the pair of transfer conveyors 7515*a-b* in a shared plane for a level hand off of a platter transiting out of a folding bay 7505. Additionally, in implementations, the pair of unloading conveyors 7915*a-b* are configured to extend outward from the unloading elevator 7900 toward the unloading station 7950. The unloading conveyors 7915*a-b* are spaced apart to receive the platter coupling 7165 therebetween when a platter 7100 is disposed thereon. As will be described subsequently with regard to implementations, the unloading elevator 7900 is configured to lower a platter 7100 with a folded laundry article 7300 disposed thereon, into the unloading station 7950 such that the platter coupling 7165 engages with a receiving coupling 7910 of the unloading station 7950 that is analogous to a receiving coupling 7510 of a folding bay 7505. In implementations, the pair of unloading conveyors 7915*a-b* are lowered beneath and apart from the underside surface 7106 of the platter 7100 during unloading of the folded laundry article, and the pair of unloading conveyors 7915*a-b* raise to retrieve the emptied platter for deliver to the return conveyor 7990 after the folded laundry article is retrieved from the surface of the platter 7100. The pair of loading conveyors 7715*a-b*, pairs of intermediary support rails 7514*a-b*, 7514*a'-b'*, pairs of transfer conveyors 7515*a-b*, 7515*a'-b'* and unloading conveyors 7915*a-b* are horizontally oriented to hold a platter 7100 level during raising, lowering, and transfer between pairs of conveyors, into and out of one of the plurality of tiered folding bays 7505*a-b* such that the folded laundry article 7300 disposed thereon does not dislodge or unfold.

In implementations, as shown for example in FIG. 7, loading conveyors 7715*a-b* are configured to overlap lengthwise at least partially with the intermediary conveyors 7514*a'-b'* during co-planar alignment of their transfer rails for level platter transfer between pairs of conveyors, and the intermediary conveyors 7514*a'-b'* are configured to overlap lengthwise at least partially with the transfer conveyors 7515*a'-b'* during co-planar alignment of their transfer rails for level platter transfer between pairs of conveyors. The transfer conveyors 7515*a'-b'* are configured to overlap lengthwise at least partially with the unloading conveyors 7915*a-b* during co-planar alignment of their transfer rails for platter transfer between pairs of conveyors. This overlap between adjacent conveyors prevents discontinuity in support and enables level loading and unloading of the platter 7100 into and out of one of the plurality of tiered folding bays 7505*a-n*. In implementations, the pair of transfer conveyors 7715*a-b*, 7715*a'-b'* are at least one of nested within and disposed outbound of each of the pair of unloading conveyors 7915*a-b* and a corresponding pair of intermediary support rails 7514*a-b, a'-b'*. Similarly, the pair of loading conveyors 7715*a-b* are at least one of disposed outbound of or nested with each pair of intermediary rails 7514*a-b, a'-b'* during loading of a platter and spread article disposed thereon into one of the plurality of tiered folding bays 7505*a-n*.

For example, as shown in FIG. 7, a pair of transfer conveyors 7715*a'-b'* in the upper folding bay 7505*b* is more narrowly spaced apart than a pair of intermediary rails 7714*a'-b'*, and a pair of unloading conveyors 7915*a-b*. This enables the transfer conveyors 7515*a'-b'* to overlap in length with one or both of the more widely spaced apart pair of intermediary rails 7714*a'-b'* and the more widely spaced apart pair of unloading conveyors 7915*a-b* when sharing a horizontal plane with one or the other of them. This configuration prevents end-to-end gaps between pairs of consecutive conveyors and forms a continuous conveyor surface that ensures a stable, level transfer of a platter 7100 into and out of each one of the plurality of tiered folding bays 7505*a-n*. Alternatively, in implementations, an end of each of the pair of transfer conveyors 7515*a-b* abuts at least one of the ends of the pair of intermediary rails 7714*a'-b'* and the ends of the pair of unloading conveyors 7915*a-b* to prevent discontinuity in conveyor support. In implementations, the controller 7005 is configured to time each pair of conveyors to run simultaneously and in the same direction during a platter transfer. Although implementations herein describe a pair of intermediary rails 7714*a-b, a'-b'* disposed between the loading elevator conveyors 7715*a-b* and the pairs of transfer conveyors 7515*a-b, a'-b'*, in implementations, the loading elevator conveyors 7715*a-b* are configured to transfer a platter and spread article thereon directly to the transfer conveyors 7515*a-b, a'-b'*.

Additionally, in implementations, similar to all of the implementations of pairs of conveyors described previously, the return conveyor 7990 comprises at least one pair of parallel return conveyors 7992 spaced apart to receive a platter coupling 7165 therebetween. In implementations, as shown for example in FIGS. 5, 6, 8 and 17, at least one pair of parallel return conveyors comprises two pairs of longitudinally aligned, nested pairs of conveyors 7992*a-b*, 7992*a'b*. A first pair of return conveyors 7992*a'-b'* closest to the unloading elevator 7900 is configured to be spaced further apart than the second pair 7992*a-b* of return conveyors which are spaced closer together than both of the first pair of return conveyors 7992*a'-b'* and the pair of loading elevator conveyors 7715*a-b*. In implementations, the two pairs of parallel return conveyors 7992*a-b*, 7992*a'-b'* thus are configured to at least one of overlap in length and nest with one another and with the loading conveyors 7715*a-b* and unloading conveyors 7915*a-b* for level loading and unloading of the platter 7100 without discontinuity of platter support. In implementations, the first pair of parallel return conveyors 7992*a'-b'* are at least one of within and outside of each of the pair of unloading conveyors 7915*a-b* such that they nest without interference when aligned at the same height and the second pair of parallel return conveyors 7992*a-b* are another of nested within and outside of the pair of loading conveyors 7715*a-b* such that they nest without interference when aligned at the same height. Nesting enables the pairs of return conveyors 7992*a-b*, 7992*a'-b'* to overlap in length with one or both of the pair of loading conveyors 7715*a-b* and the pair of unloading conveyors 7915*a-b* thereby preventing gaps between pairs of consecutive conveyors and ensuring a stable, level transfer of a platter 7100. Additionally or alternatively, in implementations, the ends of the pairs of parallel return conveyors 7992*a-b*, 7992*a'-b'* abut ends of the pair of loading conveyors 7715*a-b* and ends of the pair of unloading conveyors 7915*a-b* when disposed in a shared plane. Although at least one return conveyor 7990 is describe with regard to an implementation comprising two nested pairs of return conveyors 7992*a'-b'*, 7992*a-b*, in implementations, the return conveyor 7990 comprises a single pair of parallel return conveyors 7992 (not shown) configured to at least one of nest with and abut the pairs of loading conveyors 7715*a-b* and unloading conveyors 7915*a-b* at each end of the single pair of parallel return conveyors 7992.

In all previously presented implementations, the elevator drives 7780, 7980 (FIG. 4) are configured to instruct the loading and unloading elevators 7700, 7900 to raise and lower the pair of loading conveyors 7715*a-b* and pair of unloading conveyors 7915*a-b* to preset heights such that the loading conveyors 7715*a-b* and unloading conveyors 7915*a-b* arrive in a shared plane with at least one of the pairs of parallel return conveyors 7992*a-b*, 7992*a-b* and at least one of a pair of intermediary rails 7514*a-b*, 7514*a'-b'* and transfer conveyors 7515*a-b* associated with one of the plurality of tiered folding bays 7505*a-b*. This ensures a platter 7100 will transfer between pairs of conveyors, into and out of the elevators 7900, 7700 in a stable, level orientation without tipping or tilting in any direction. The controller 7005 is configured to time the running of the return conveyors 7992*a-b*, 7992*a'-b'* with the running of one or both of the loading conveyors 7715*a-b* and pair of unloading conveyors 7915*a-b* to run simultaneously and in the same direction during a platter transfer.

Overlapping lengths and nesting pairs of conveyors and rails creates a level surface for transiting a platter 7100 into and out of a folding bay 7505 and onto and off of elevators 7900, 7700 without any gaps that could cause the platter to wobble or tip during transition from one pair of conveyors (or rails) to the next. Alternatively, in implementations, the system 500 can tolerate small gaps between adjacent ends of pairs conveyors and between pairs of conveyors and pairs of rails in a range of between about 1 cm to 20 cm because the platter will be sufficiently received by a next pair of conveyors or rails prior to a middle point of the platter transiting beyond the end of a first pair of conveyors or rails that is handing off to the next pair of conveyor or rails.

Although implementations described herein are with reference to a dual elevator 7700, 7900, other elevator configurations can be implemented between the spreading station 7705 (e.g., a repositioning robot 6000) and one or more packing robots 8000. In implementations (not shown), a plurality of tiered folding bays can be loaded and unloaded from a first side by a single elevator. A return conveyor disposed beneath the plurality of tiered folding bays (e.g., mounted to the floor 10) can be configured to shuttle platters and any folded laundry articles thereon one at a time between an unloading station and a spreading station. This configuration reduces a floorspace occupied by having two elevators in a folding system but requires the return conveyor to continuously shuttle platters back and forth, not allowing for storage of staged platters ready for entering the spreading station while the folding bays are simultaneously occupied by platters and laundry garments. In this single elevator configuration, the number of platters 7100 would be equal to and no greater to the number of folding bays.

Alternatively, in implementations (not shown), the system could comprise an additional elevator disposed between the loading elevator and the plurality of stacked (e.g., tiered) folding bays. The additional elevator would improve throughput at the expense of occupying more floor space than the dual elevator 7700, 7900 configuration of previously described implementations. In this implementation, the loading elevator at the spreading station would travels through a relatively short range of elevations to increase that cycle time at the spreading station and would hands off a platter and spread article thereon to the additional elevator for delivery to a folding bay.

Once the additional elevator at least one of conveys the platter into a folding bay. When folding is complete, the transfer conveyors transit the platter and folded article onto the unloading elevator for lowering to the unloading station. After the folded garment is moved to the packing robot 8000 as previously described with regard to implementations, the unloading elevator brings the empty platter down to the return conveyor, which brings the platter into a queue for return to the repositioning station. As previously described with regard to implementations, the return conveyor can store one or more empty platters in a queue so there is no wait at the spreading station for an emptied platter 7100.

Alternatively in implementations (not shown), a plurality of folding robots 7000 are disposed laterally adjacent to a spreading station in a non-tiered arrangement. In some implementations, the arms of the spreading station are configured to lower a spread laundry article outside of the work volume onto a platter or intermediary transiting surface for delivery to a movable platter in a spread state. Alternatively, the floor of the spreading station working volume can be occupied by a movable platter configured to be conveyed into and out of the spreading station in more than one direction such that the spreading station can provide a platter having disposed thereon a spread laundry article to more than one folding station. As previously described with regard to implementations, each folding station comprises a completed folding robot 7000 once a platter is received in mated engagement. A side-to-side folding arrangement increases throughput of folded laundry articles to a packing robot 8000 but does not conserve floorspace as with stacked folding device 7500 implementations.

Figure 16:
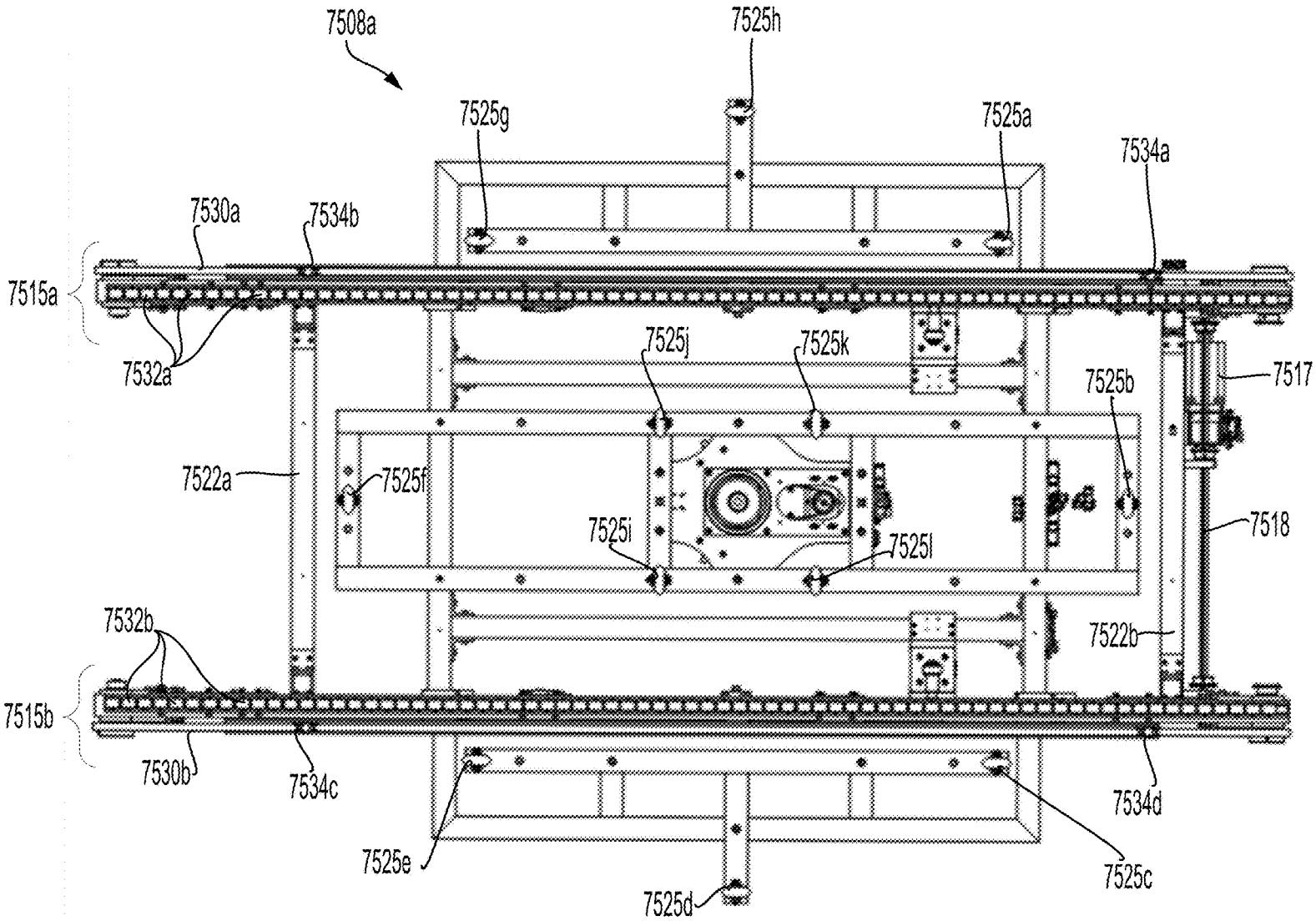
FIG. 16 depicts a perspective top down plan view of an example receiving coupling, transfer conveyer lift system, and transfer conveyor support frame of the autonomous tiered folding system of FIGS. 10A-11B.

Returning now to the dual elevator implementation of FIGS. 5-9, as previously described with regard to implementations, each of the plurality of tiered folding bays 7505*a-b* comprises a pair of transfer conveyors 7515*a-b, a'-b'* secured therewithin on a support frame 7508, 7508*a*, 7508*b*, as shown for example in FIGS. 10A-B, 11A-B and 13A-B. (The plurality of support frames 7508*a-b* are hereinafter referred to interchangeably with and without designation in the singular as "the support frame 7508".) Each pair of transfer conveyors 7515*a-b, a'-b'* is configured to raise to the height of the pair of intermediary rails 7714*a-b, a'-b'* (e.g., cantilevered conveyors) and align support surfaces with the support surfaces of the pair of intermediary conveyors 7714*a-b, a'-b'* for receipt of a platter 7100 having disposed thereon a laundry article 7300. The laundry article is spread and laid substantially flat and/or partially folded in an intentionally folded state on the platter 7100 by a repositioning robot 6000 (e.g., spreading station 7705). The pair of transfer conveyors 7515*a-b, a'-b'* is configured to convey the platter 7100 into an associated folding bay 7505, 7505*a-b* and lower the platter coupling 7165, 7165*a-b* into a receiving coupling 7510, 7510*a-b* for mated engagement. As previously described in reference to FIGS. 13A-B, in implementations the lifting mechanism comprises a plurality of actuatable pistons 7520*a-b* disposed beneath and moveably connected to the pair of transfer conveyors 7515*a-b* or supports therefor. The controls system 400 of the tiered laundry folding system 500 comprises at least one drive 7566 (FIG. 4) configured to operably control the actuatable pistons 7520*a-b* to raise and lower the pair of transfer conveyors 7515*a-b*. The transfer conveyors 7515*a-b* are moveably supported on the support frame 7508*a* by bilateral pairs of scissor arms 7521*a-b, a'-b'* configured to slide closed and open when lifted and lowered, respectively, by the plurality of actuatable pistons 7520*a-b*. In implementations, the plurality of actuatable pistons 7520*a-b* are configured to push or pull at least one scissor arm of each pair of bilateral pairs of scissor arms 7521*a-b, a'-b'* to synchronously raise the pairs of transfer conveyors 7515*a-b, a'-b'* and lift the platter coupling 7165*a* from the receiving coupling 7510*a* in one of the plurality of folding bays 7505*a* once a folding end state is reached. Additionally, in implementations as shown, for example, in FIGS. 11A, 13A, and 16, the support frame 7508 further comprises a plurality of support wheels 7525*a*-1 disposed thereon. In implementations, as shown in FIGS. 10B and 11B, when a platter 7100 enters a folding bay 7505 and is lowered so that the platter coupling 7165 engages with the receiving coupling 7510, the pair of transfer conveyors 7515*a-b* lower further such that they no longer contact the underside surface 7106 of the platter, and the platter 7100 is fully supported by the plurality of support wheels 7525*a*-1. The plurality of support wheels 7525*a-n* are configured to support a platter 7100 in a level position while enabling the platter 7100 to rotate during folding operations. In implementations, the support wheels 7525*a-n* can be grouped into an inner ring of wheels (e.g., 7525*i*-1) concentric with an outer ring of wheels (e.g., 7525 *a-h*) to support of the weight of the platter 7100 in an even distribution and prevent sagging at any location. Maintaining a planar top surface 7105 enables the autonomous folding mechanisms (e.g., at least one of one or more clamp rods 7200*a-b*, one or more sweep rods 7400, and one or more folding blades 7650) to correctly position themselves relative to the top surface 7105 and fully contact a laundry article 7300 during folding. Additionally, in implementations, the plurality of support wheels 7525*a-n* are height adjustable. In implementations, each one of the plurality of support wheels 7524*a-n* is rotatably affixed to a wheel shaft (axle) disposed on a linear bearing. Each wheel assembly further comprises a screw and lock nut on the bottom of a shaft of each linear bearing configured to enable adjusting the height of each wheel and locking that height in place. Adjustable wheels enable leveling of the support elements within each folding bay 7505 such that a received platter 7100 is contacted by every one of the plurality of support wheels 7525*a-n* in a level (e.g., horizontal and not tilted) state. Although the above described implementation of a support frame 7508*a* is described with regard to the lower bay 7505*a*, all elements are repeated within each additional bay (e.g., an upper bay 7505*b*) of a folding device 7500 comprising a plurality of tiered folding bays 7505*a-n*.

Returning to the conveyors of the folding system 500, in implementations, each pair of transfer conveyers 7515*a-b, a'-b'* comprises belted conveyors. Additionally or alternatively, as shown in FIGS. 11A-B, 13A-B, and 16, each one of the pair of transfer conveyors 7515*a-b* comprises a drive belt or chain 7530*a-b* disposed adjacent a plurality of passive rollers 7532*a-b* disposed along the length of each of the pair of transfer conveyors 7515*a-b*. The plurality of passive rollers 7532*a-b* are configured to receive and moveably support thereon a platter 7100. A belt or chain 7530*a-b* of each of the pair of transfer conveyors 7515*a-b* comprises affixed thereto at least two centering pins 7534*a-b, c-d* extending vertically upward from an upper portion each loop of belt or chain 7530*a-b*. As the chains 7530*a-b* rotate, the centering pins 7534*a-b, c-d* at least one of disposed on and affixed to each chain 7530*a-b* are configured to abut an edge of the platter 7100 and push the platter 7100 along the freely rolling plurality of passive rollers 7532*a-b*. In implementations, the pairs of transfer conveyors disposed in each of the plurality of folding bays 7505*a-b*, the pair of loading conveyors 7715*a-b*, the pair of unloading conveyors 7915*a-b*, the pair of intermediary rails 7514*a-b*, and the pairs of return conveyors 7992*a-b, a'-b'* are similarly constructed. As will be described subsequently in greater detail with regard to implementations, the drives of adjacent pairs of conveyors are controlled synchronously by the controller such that the centering pins 7534 of one pair of conveyors pushes the platter onto another pair of conveyors as another pair of centering pins on the another pair of conveyors engages the platter to push it along the another pair of conveyors.

Figure 17:
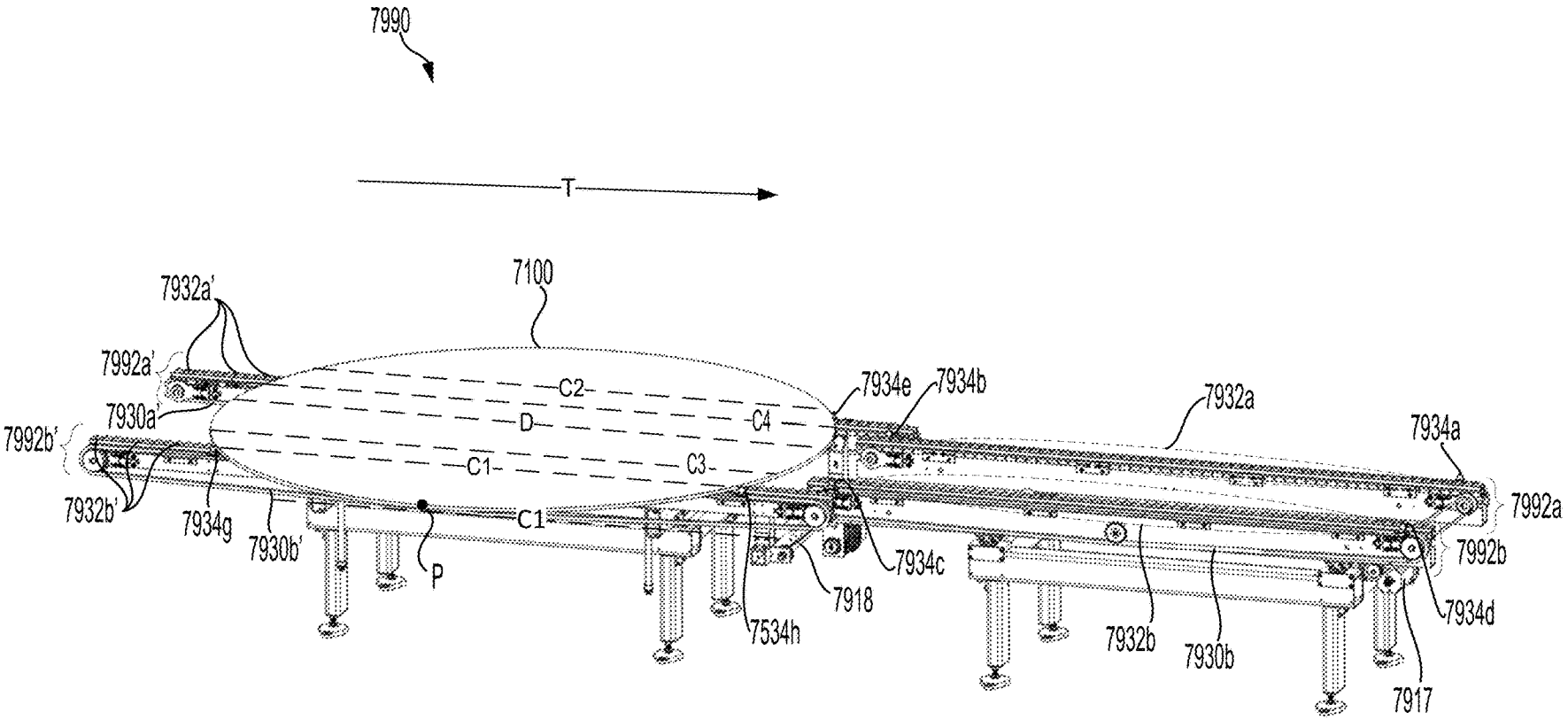
FIG. 17 depicts a perspective view of the return conveyor of the system of FIGS. 5-8.

As shown in FIG. 17, two nested pairs of return conveyors 7992*a-b*, 7992*a'-b'*, comprise driven loops of belts or chains 7930*a-b, a'-b'*, a plurality of centering pins 7934*a-d, e-h* at least one of disposed on and affixed to each chain 7930*a-b, a'-b'*, and a plurality of rollers 7932*a-b, a'-b'*. In implementations, as shown in FIG. 17, the plurality of centering pins 7934*a-d* of a first pair of return conveyors 7992*a'-b'* comprises two leading edge pins 7934*h,e* and two trailing edge pins 7924*f,g* configured to abut corresponding leading and trailing edges of the platter 7100 as defined by a direction of travel indicated by arrow T. Each one of the pairs of conveyors (e.g., transfer conveyors 7515*a-b, a'-b'*, loading elevator conveyors 7715*a-b*, support rails 7514*a-b, a'-b'*, unloading elevator conveyors 7915*a-b*, and return conveyors 7992*a-b, a'-b'*) comprises one of the two leading edge pins and one of the two trailing edge pins of the plurality of centering pins (e.g. transfer conveyor centering pins 7534*a-d*, support rail centering pins 7533*a-d*, return conveyor centering pins 7934*a-d, e-h*, loading elevator centering pins 7734*a-d* (not shown), and unloading elevator centering pins 7934*a-d*) spaced apart along the length of each corresponding chain (e.g., transfer conveyor chains 7530*a-b, a'-b'*, support rail chains 7531*a-b*, loading elevator conveyor chains 7730*a-b*, unloading elevator conveyor chains 7930*a-b*, second return conveyor chains 7930*a-b*, and first return conveyor chains 7930*a'-b'*) and by a chord length of the platter 7100 that is at least 25 percent of the distance measured between a diameter D of the platter 7100 parallel to the conveyors and a furthest circumferential point P perpendicular to that diameter. In implementations comprising nested conveyors, the chord length defined on a received platter by the pins of a first pair of conveyors is distinct from that defined by the pins of a next adjacent pair of conveyors.

For example, in FIG. 17, the two leading edge pins 7934*h,e* and two trailing edge pins 7924*f,g* of the first pair of return conveyors 7992*a'-b'* define chord C1 and chord C2 and the two leading edge pins and the two trailing edge pins of the second pair of return conveyors 7992*a-b* define chord C3 and C3, which are not colinear with cords C1 and C2. The pairs of leading edge pins and trailing edge pins of the plurality of centering pins 7934*a-b, a'-b'* are co-aligned between the parallel conveyors of each pair of return conveyors 7992*a-b, a'-b'* such that they simultaneously contact the leading and trailing edges of the platter 7100.

Figure 18:
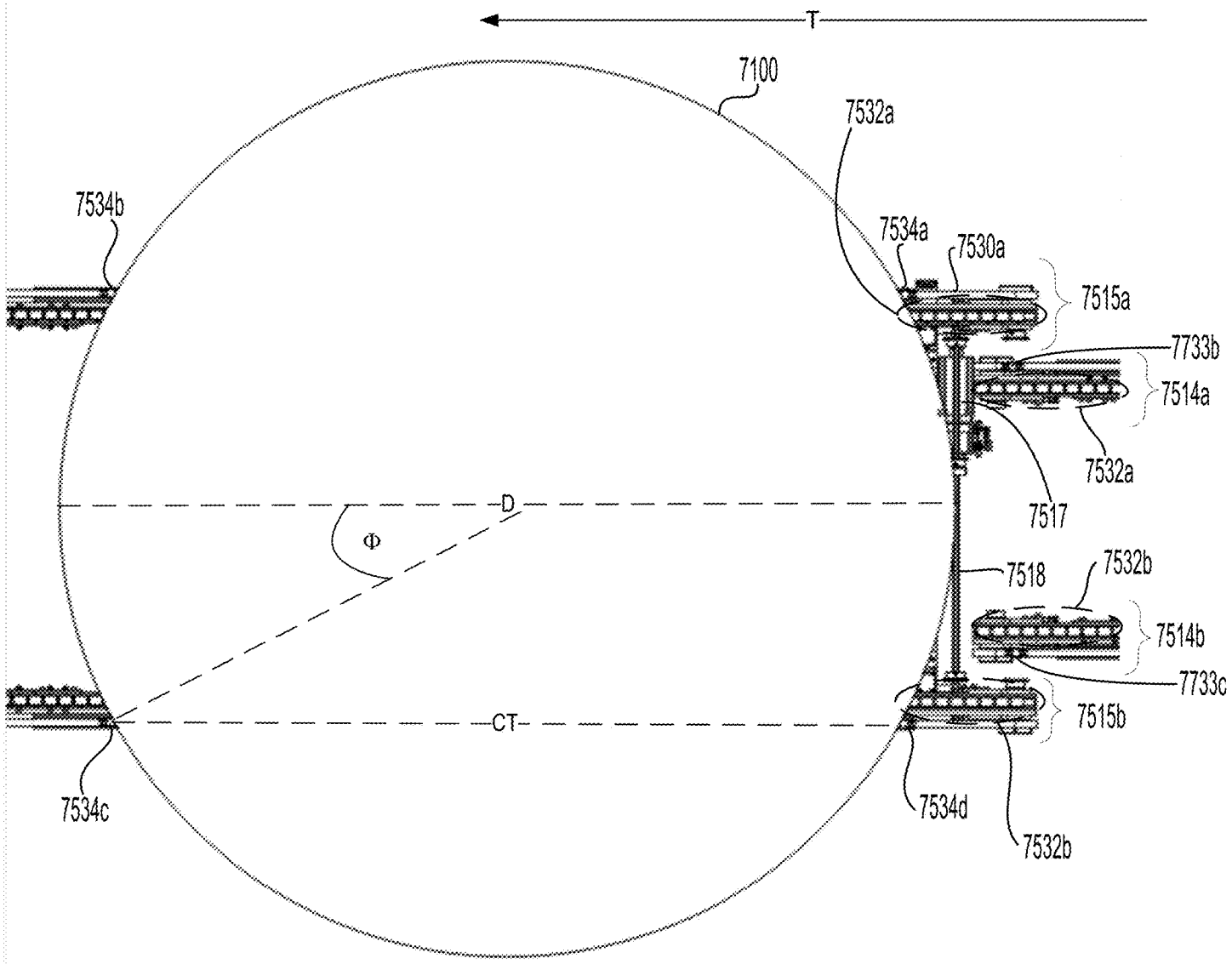
FIG. 18 depicts a top down view of an example platter, transfer conveyors, and centering pins of the autonomous tiered folding system of FIGS. 5-8.
Figure 19:
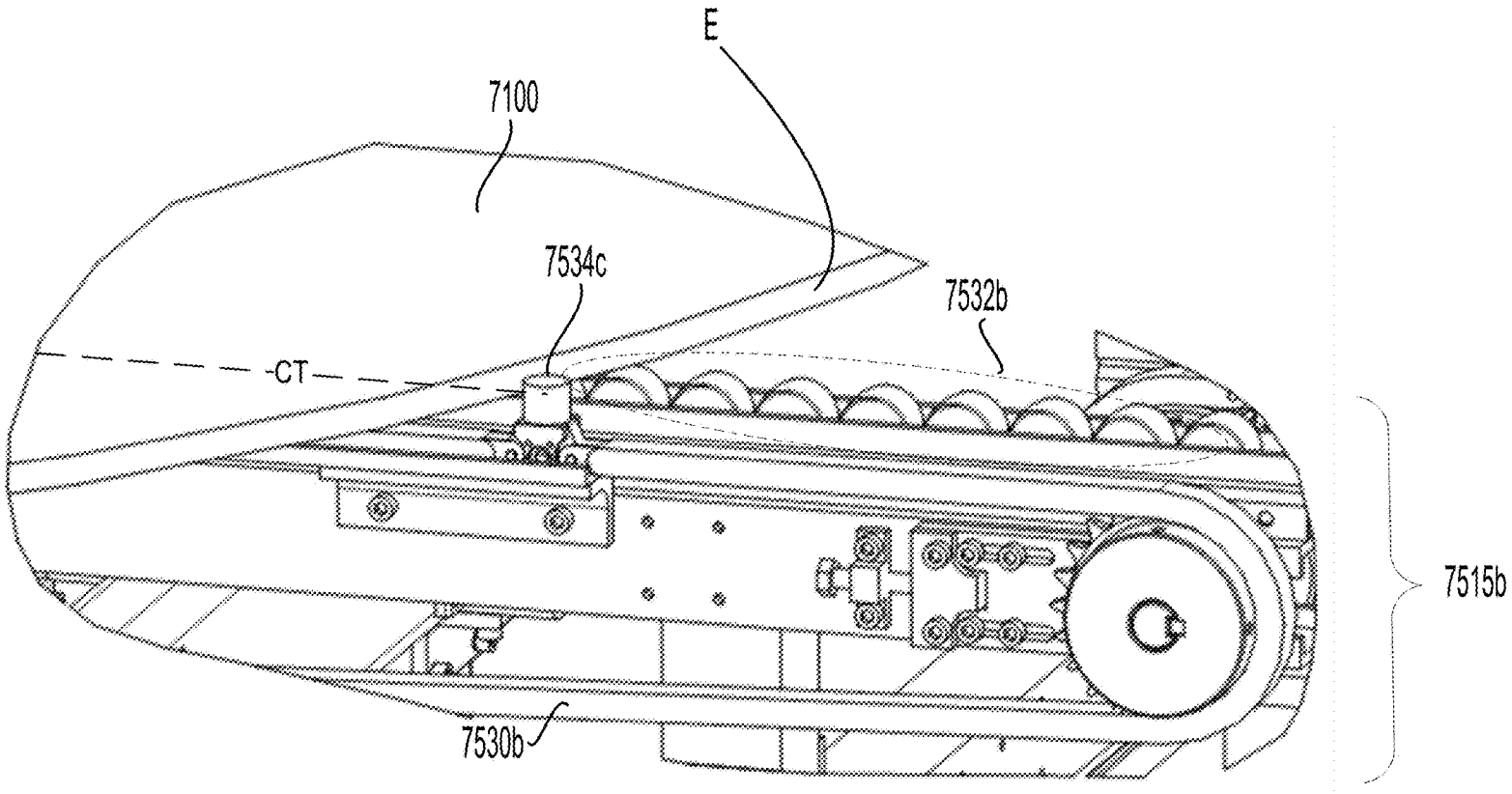
FIG. 19 depicts a partial cutaway closeup, side view of a platter disposed on a transfer conveyor.

Additionally, as shown in FIGS. 18 and 19, with respect to the transfer conveyors 7515*a-b, a'-b'*, in order to control positioning of the platter coupling 7165 so that it aligns concentrically (e.g., side-to-side and front-to-back in the X-Y plane) with the receiving coupling 7510, each pair of the leading and trailing centering pins 7534*a-b* of the transfer conveyors 7715*a-d* and each pair of the leading and trailing centering pins 7533*a-d* of the support rails 7714*a-b* are positioned along the chains 7730*a-b* to contact an edge E of the platter 7100 at a chord CT located along the circumference in a range of angular positions (D rotated outward from the diameter of the platter (e.g., 0 degrees) by at least between 30-45 degrees. Each pair of leading and trailing centering pins is located symmetrically about a diameter D of the platter oriented parallel to the pair of conveyors so that the disc shaped platter is centered on the pair of transfer conveyors 7515*a-b, a'-'d* with the patter coupling centered therebetween. Additionally, each chord traced between a pair of leading and trailing centering pins is located symmetrically about the diameter in clockwise and counterclockwise directions from the diameter. Additionally or alternatively, in implementations, the transfer conveyors comprise belted surfaces and the centering pins are affixed to the belts. Additionally or alternatively, the transfer conveyors comprise belted surfaces with centering ridges formed within the belts. Alternatively, in implementations, the platter can be centered on a pair of conveyors using another mechanism, such as one of a mechanical alignment system at the open end of the bay for pushing the platter from side to side and a sensor (e.g., optical, break beam, Hall effect, encoder based) is configured to detect an offset of a platter coupling relative to the receiving coupling.

Figure 20:
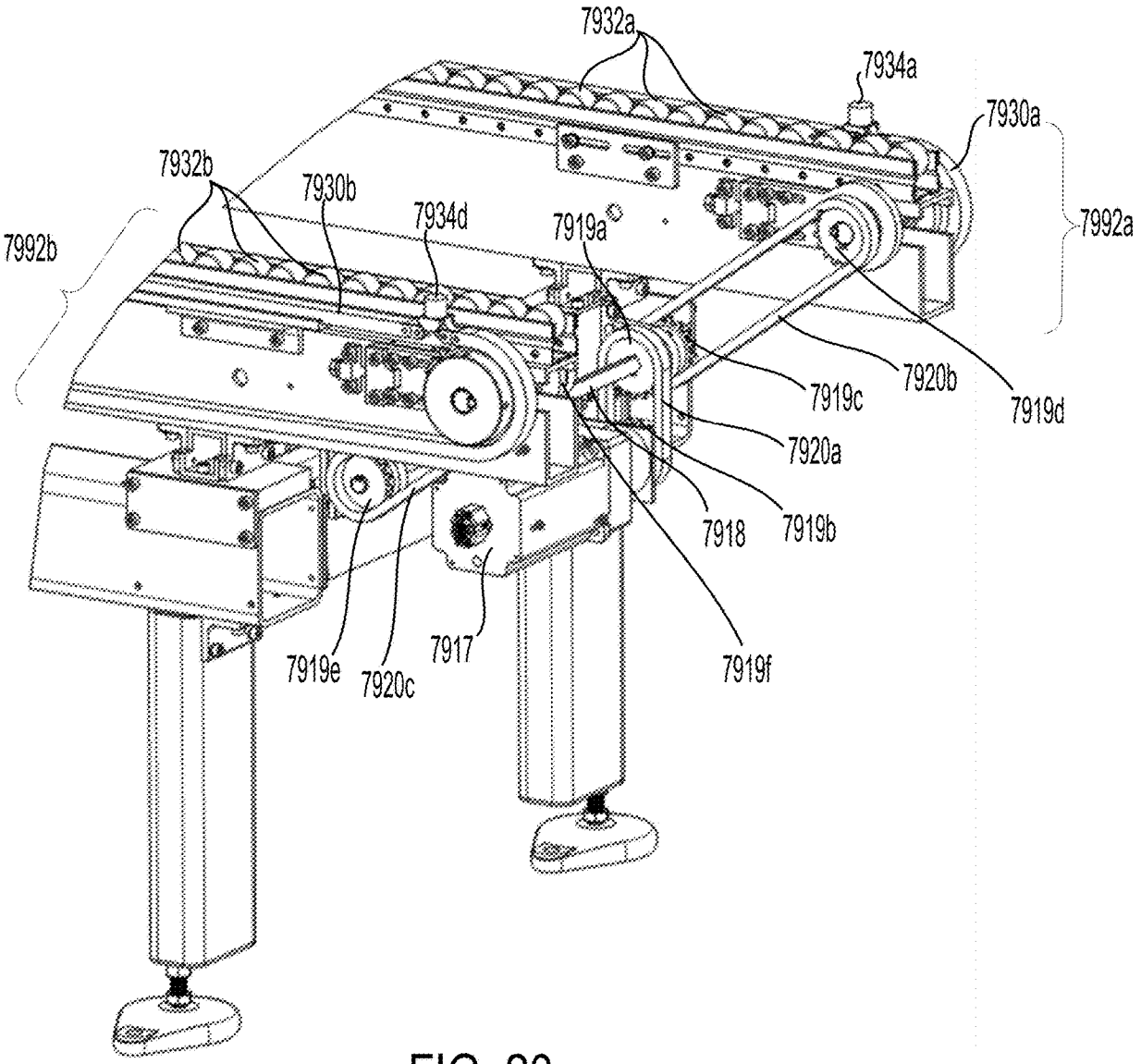
FIG. 20 depicts an example drive end of a pair of conveyors of the system of FIGS. 5-8.

In implementations, the two chains of a pair of conveyers are configured to be driven bidirectionally by a drive motor. For example, as shown in the close up partial view of the drive end of the pair of second return conveyors 7992*a-b* in FIG. 20, the two chains 7930*a-b* of the parallel conveyors 7792*a-b* can be connected by a drive axle 7918 and, in implementations, belts 7920*a-c* and pulleys 7919*a-f* transfer rotation from a drive motor 7517 to the drive axle and the parallel conveyors 7792*a-b*. That the rotation of the two chains 7930*a-b* are coupled and therefore synchronized, and their centering pins 7934*a-d* are continuously coaligned along the parallel lengths of each one of the pair of return conveyors 7992*a-b*. In implementations, the drive systems of the pairs of transfer conveyors 7715*a-b, a'-b'*, loading conveyors 7715*a-b*, support rails, and the unloading conveyors 7915*a-b* are similarly constructed. Additionally, in implementations, with regard to the transfer conveyors 7715*a-b*, the system 500 comprises a motor encoder 7579 (FIG. 4) configured to detect a distance traveled by each chain 7530*a-b* such that a controller 7005 can determine when the leading and trailing edge pins 7534*a-d* are located at a stopping position. The controller can instruct a drive motor 7517 of the transfer conveyors 7515*a-b* to halt such that the platter coupling 7165 is positioned above the receiving coupling 7510 inside one of the plurality of tiered folding bays 7505*a-n*. Additionally or alternatively, the system 500 comprises position detection sensors within each folding bay 7505 such as at least one of break beam sensors, time-of-flight proximity sensors, and Hall sensors for detecting one or more positions of the plurality of centering pins 7534*a-n* and sending a signal to the controller 7005 that the platter 7100 is positioned such that the platter coupling 7165 is positioned above the receiving coupling 7510 as shown in FIGS. 10A and 11A. In implementations, the unloading station 7950, spreading station 7705, 6000, return conveyors 7990, loading elevator 7700 and unloading elevator 7900 are similarly constructed with one or more position detection and/or platter alignment sensors in communication with one or more controllers 6005, 7005, 205.

Figure 21A:
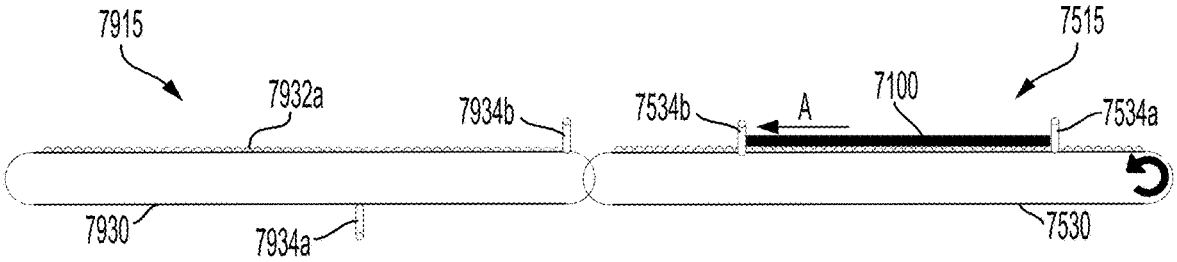
FIGS. 21A-D depict side views of a platter disposed initially on transfer conveyors in sequential positions during a transfer between the transfer conveyors and unloading conveyors.
Figure 21B:
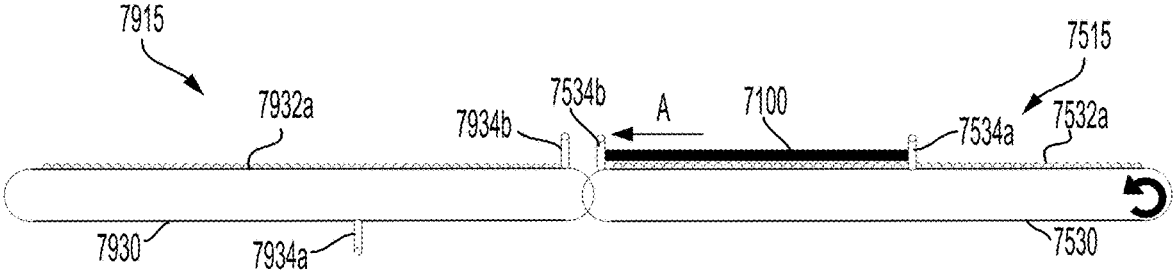
Figure 21C:
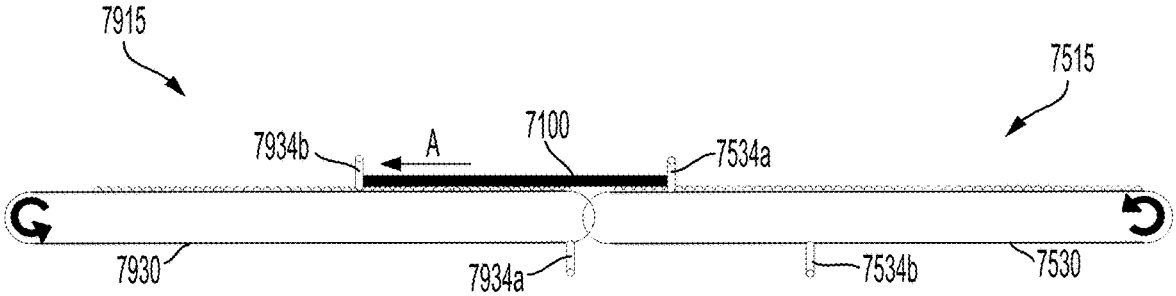
Figure 21D:
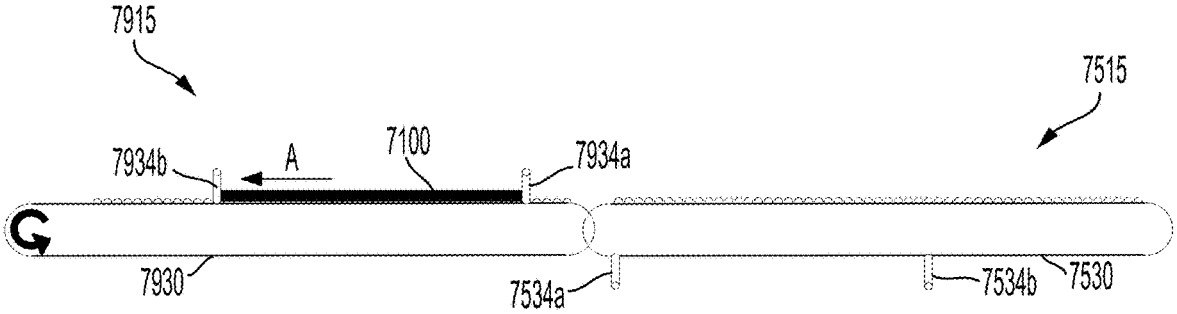

Additionally or alternatively, the two chains of all of the pairs of conveyors are configured to be bidirectionally rotated such that a platter 7100 can be pushed in either direction along and between adjacent pairs of conveyors. Additionally, as shown in the sequential sides view schematics of portions of a transfer conveyor 7515 and portions of an unloading conveyor 7900 in FIGS. 21A-D, the plurality of centering pins 7534*a-n* of the transfer conveyor 7515 are configured to loop around the ends of each respective one of the pair of transfer conveyors 7515*a-b*, riding their respective chain 7530*a-b* around the bends at the ends of each transfer conveyor 7515*a-b* during transfer of a platter 7100 onto and off of the pair of transfer conveyors 7515*a-b*. As shown in FIGS. 21A and 21B, a platter 7100 transits on the rollers 7532 of the transfer conveyor 7515 in the direction of arrow A toward the unloading conveyor while at least one controller 7005, 205 operates the drive motors rotating the respective belts 7530, 7930 of each conveyor to synchronize timing of movement and speed of rotation for an uninterrupted, level transition of the platter 7100 off of the transfer conveyor 7515 and onto the unloading conveyor 7915. As shown in FIGS. 21C-D, the platter 7100 is pushed from the transfer conveyor 7515 by tailing pins 7534*a,d* but does not disengage from the trailing edge of the platter 7100 and loop around, under the transfer conveyor 7515 until the trailing pins 7934*a,d* of the unloading conveyor contact a trailing edge of the platter 7100. The trailing pins 7934*a,d* of the unloading conveyor 7915 continue transiting the platter 7100 onto the unloading conveyor 7900. Additionally, in implementations, the pairs of support rails 7514*a-b, a'-b'*, the pair of loading conveyors 7715*a-b*, the pair of unloading conveyors 7915*a-b* and the pairs of return conveyors 7992*a-b, a'-b'* are similarly constructed and each comprise a plurality of centering pins disposed along their lengths for abutting leading and trailing edges (e.g., as determined by the movement direction) of the platter 7100 during transfer to and from a pair conveyors.

As described previously with regard to implementations, each pair of transfer conveyors 7515*a-b, a'-b'* is at least one of more narrowly spaced and more widely spaced than each pair of support rails 7514*a-b, a'-b'* and the pair of unloading conveyors 7915*a-b* such that their ends can nest and overlap in length. This configuration enables the plurality of centering pins 7534*a-b, a'-b'* of the transfer conveyors 7515*a-b, a'-b'* to round the bend of an end of the pair of transfer conveyors to a lower chain position once a pair of centering pins 7934*a,d* of the pair of unloading conveyors 7915 is abutting and pushing against a trailing edge of the platter 7100 during transfer. The pins of the pair of the support rails 7514*a-b, a'-b'* and unloading conveyors 7915*a-b* contact an edge of the platter along a different chord of the platter 7100 because they are nested at least one of inside or outside of the pair of transfer conveyors 7515*a-b* and therefore can contact the platter 7100 at least one of simultaneously with the plurality of pins 7534*a-n* of the transfer conveyors 7515*a-b* still contacting the platter and immediately as the plurality of pins 7534*a-n* of the transfer conveyors 7515*a-b* lose contact with the platter 7100.

Although the preceding descriptions provided with regard to interactions between two pairs of consecutive return conveyors 7792*a-b, a'-b'*, interactions between a pair of support rails 7514*a-b* and a pair of transfer conveyors 7515*a-b*, and interactions between a pair of transfer conveyors 7515*a-b* and a pair of unloading elevator conveyors 7915*a-b* in implementations, the configuration of centering pins, rollers, rails and drives applies to all of the pairs of conveyors of the system 500 (e.g., the transfer conveyors 7515*a-b, a'-b'*, the support rails 7514*a-b*, the loading conveyors 7715*a-b*, and the unloading conveyors 7915*a-b*) for synchronously timed movements and level handoffs of a platter 7100 between consecutive pairs of conveyors.

Figure 12:
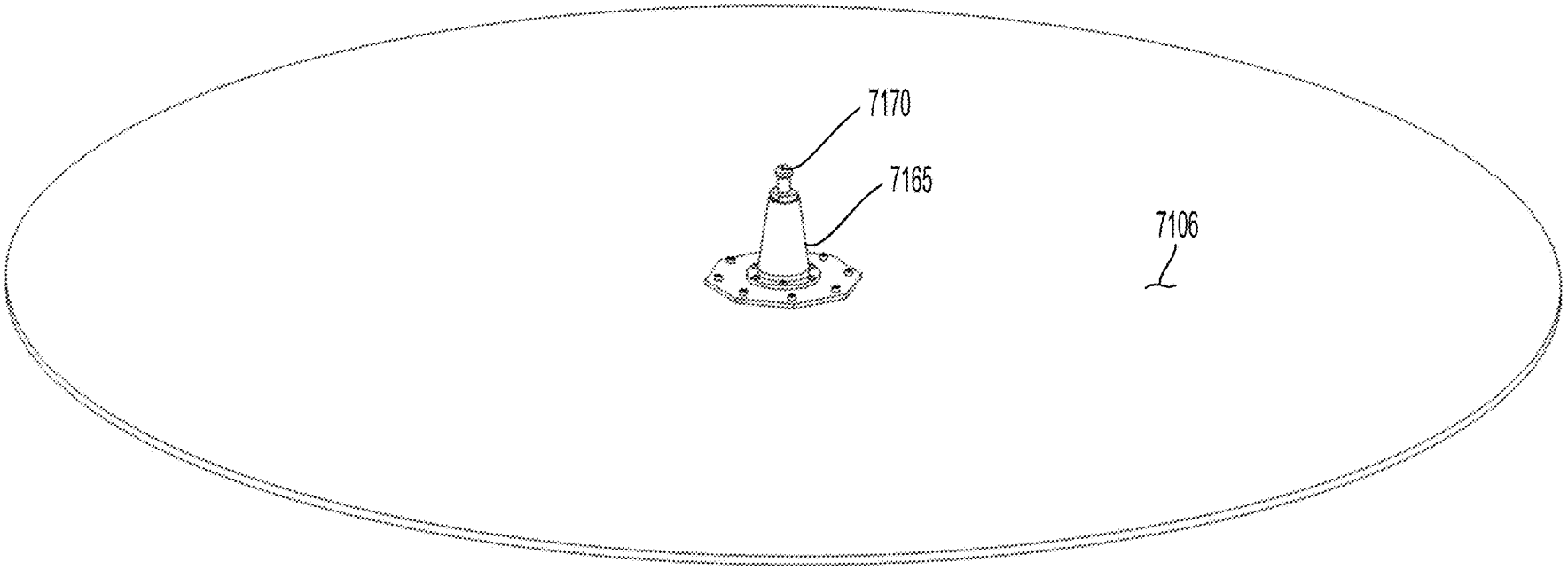
FIG. 12 depicts a perspective view of the underside surface of a rotatable platter and an example platter coupling of the autonomous tiered folding system of FIGS. 10A-11B.
Figure 22:
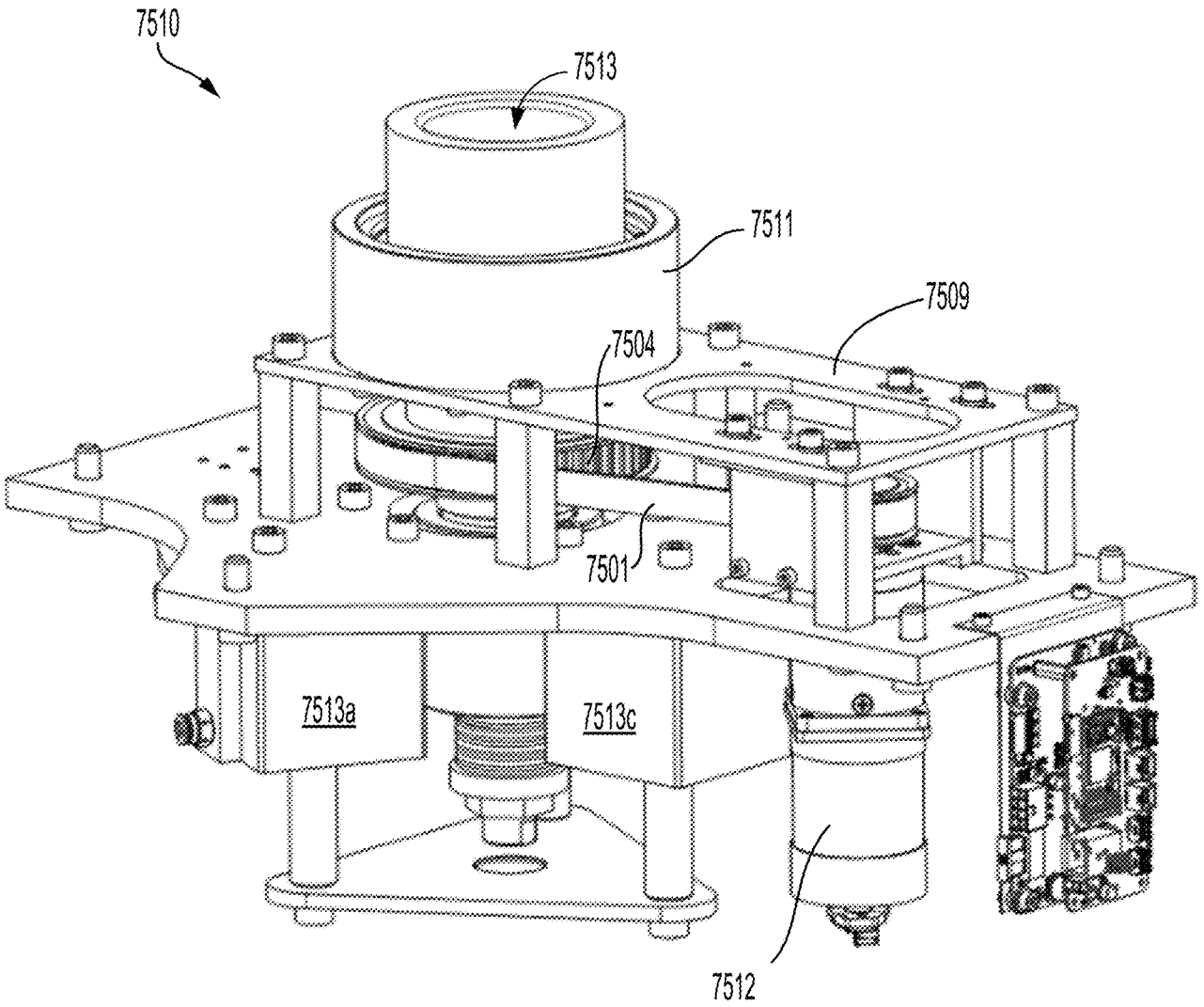
FIG. 22 depicts a perspective view of an example receiving coupling and platter spin drive of an autonomous tiered folding system.
Figure 23:
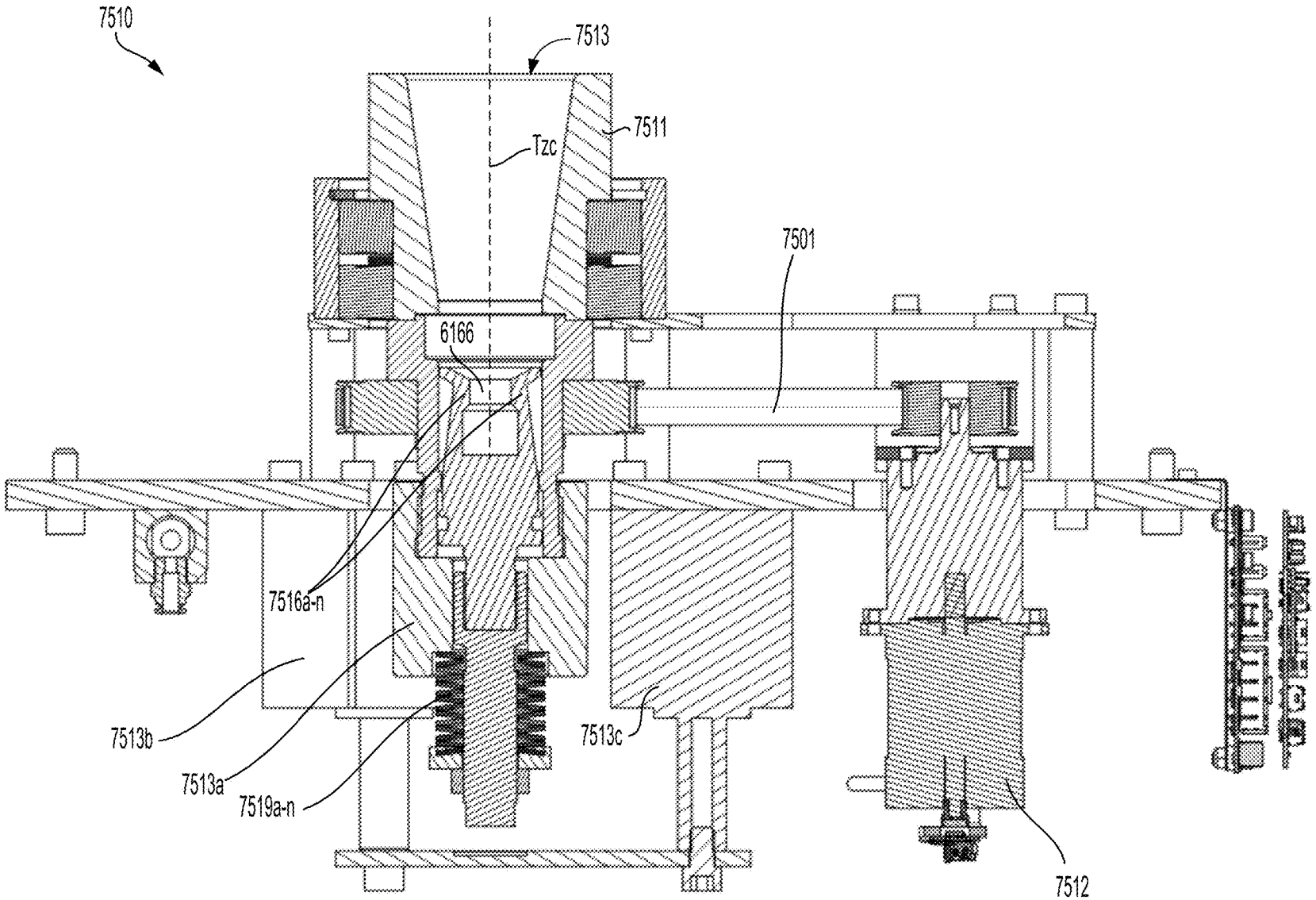
FIG. 23 depicts a side view partial cross section of the receiving coupling and spin drive of FIG. 22.
Figure 24:
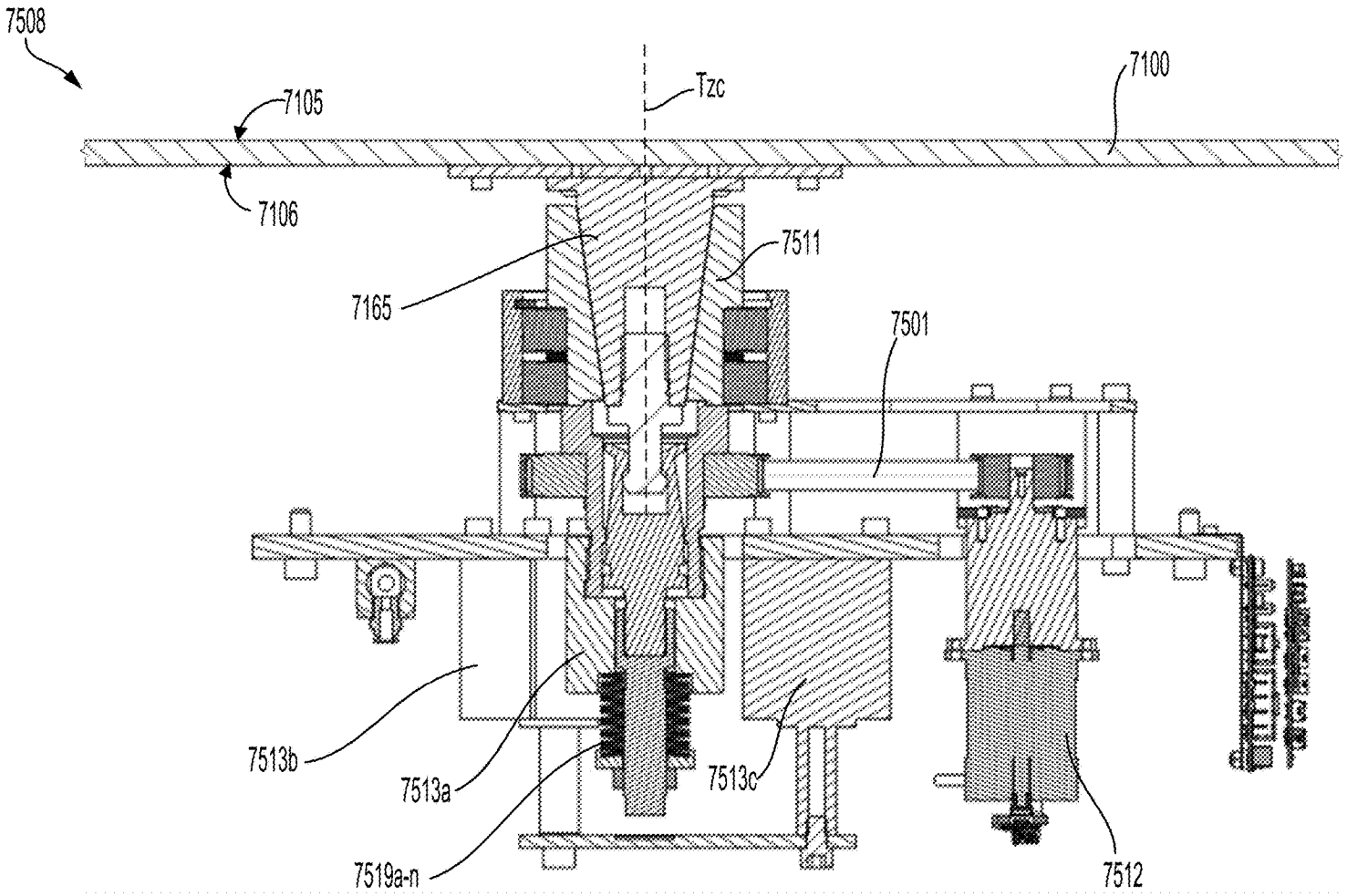
FIG. 24 depicts a side view cross section of the receiving coupling of FIG. 22 having disposed therein a retained platter coupling.
Figure 25:
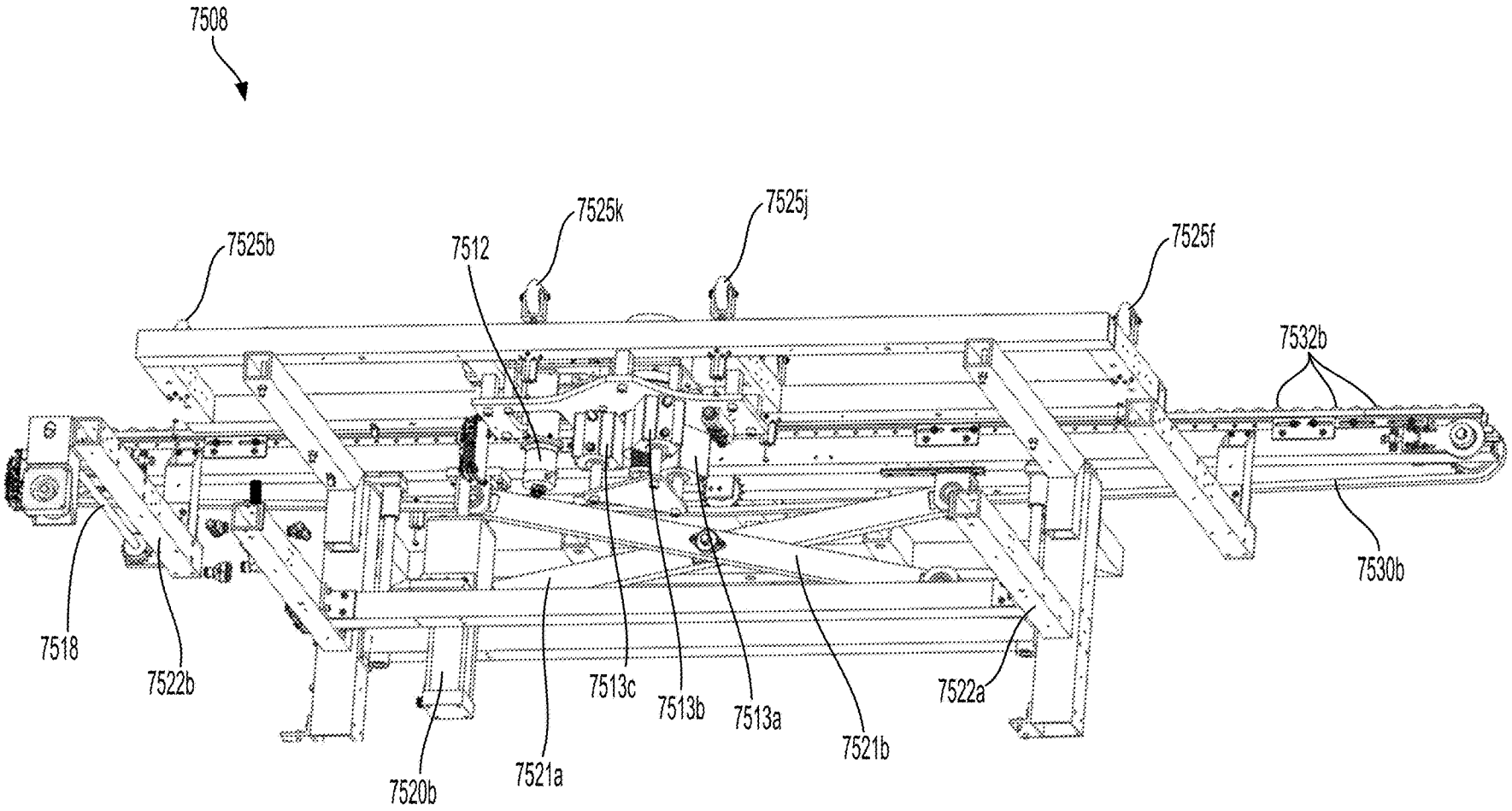
FIG. 25 depicts a bottom perspective cross sectional view of the example retaining coupling and support frame of FIG. 18.

In addition to the plurality of centering pins 7534*a-n* being configured to align the platter coupling 7165 above the receiving coupling 7510 inside one of the plurality of tiered folding bays 7505*a-n*, in implementations, as shown in FIGS. 11A-12, the platter coupling 7165 comprises a self-centering taper for aligning and guiding the platter coupling 7165 into a receiving coupling 7510. Each receiving coupling 7510 is one of a plurality of receiving couplings 7510*a-n* disposed in corresponding ones of the plurality of tiered folding bays 7505*a-n*. Each receiving coupling 7510 is configured to be affixed at a known location approximately centered within a folding bay 7505. In implementations, as shown in FIGS. 22-24, a ground frame 7509 of the receiving coupling 7510 is configured to be affixed to a support frame 7508 secured within the folding bay 7505. The ground frame 7509 can be affixed by mechanical means such as at least one of bolts, rivets, screws, pins, clamps, and welds that withstand the rotational and centrifugal forces of an engaged, rotating platter 7100 without fatiguing to failure and/or prying loose.

In implementations, as shown in FIGS. 22-24, the receiving coupling 7510 comprises a spindle 7511 having a tapered bore 7513 therein, the taper of which matches the taper of the platter coupling 7165 such that the platter 7100 self-centers within the receiving coupling 7510 for a secure mated engagement and rotation about the vertical central axis Tzc through the center point 7107 of the platter 7100. The tapered bore 7513 is formed within a spindle 7511 configured to be rotated by a drive motor 7512. In implementations, the drive motor 7512 is a direct drive. Alternatively, the drive motor 7512 can be a belt drive or chain drive, and the spindle 7511 can be rotated by a belt 7501 engaged with the drive motor 7512 and a pulley 7504 on the spindle 7511. The sloped sidewalls of the bore 7513 guide the tapered platter coupling 7615 into the receiving coupling 7510 such that a locking mechanism is able to secure the platter coupling 7615 in mated engagement. In implementations, the receiving coupling 7510 comprises a pull stud gripper comprising a plurality of fingers 7516*a-n* configured to open and close to release and grab a pull stud 6166 extending from a point of the platter coupling 7165. The plurality of pull stud gripper fingers 7516*a-n* are configured to receive and reversibly retain the self-centering platter coupling 7615. The system 400 comprises a controller-operated receiving coupling actuator 7556 (FIG. 4) configured to open and close the plurality of pull stud gripper fingers 7516*a-n*.

In implementations, the actuator 7556 operates at least one pneumatic air compressor configured to drive the pull stud gripper fingers 7516*a-n* both to engage and release a retention feature in the pull stud 6166 of the platter coupling 7165. In implementations, the actuator operates one or more pneumatic cylinders. In implementations, as shown in FIGS. 22-25, the system 500 further comprises a plurality of pneumatic cylinders 7513*a-c* configured to evenly distribute forces about the plurality of pull stud gripper fingers 7516*a-n* for synchronized actuation. In implementations, the plurality of pneumatic cylinders 7513*a-c* are configured to provide a combined force in a range of between about 500-1500 lbf. In implementations, the pneumatic cylinders 7513*a-n* are configured to provide a combined force of about 1000 lbf. Additionally, the receiving coupling comprises at least one spring. In implementations, as shown in FIGS. 23-24, the spring comprises a plurality of Belleville spring washers 7519*a-n* stacked in series within the receiving coupling 7510 beneath the plurality of pulls stud gripper fingers 7516*a-n*. The plurality of Belleville spring washers 7519*a-n* are configured to compress under application of a load and overcome a threshold force to spring back to an expanded state during a spring loaded release. In implementations, the plurality of Belleville spring washers 7519*a-n* is configured to at overcome at least 1000 lbf (e.g., approximately 4.45N) to release the platter 7100 (e.g., the pull stud 6166 of the platter) from the receiving coupling 7510.

In implementations, the system 500 further comprises one or more coupling sensors 7568 (FIG. 4) configured to detect successful engagement of the platter coupling 7165 and receiving coupling 7510. For example, in implementations, each individual bay 7505 of the plurality of folding bays 7505*a-n* comprises at least one proximity sensor (e.g., an optical sensor) configured to determine whether the platter coupling 7165 is engaged or disengaged from the receiving coupling 7510. Additionally, one or more proximity sensors can be disposed with a bay 7505 for detecting when a platter 7100 has fully transited off of the transfer conveyors 7515*a-b* and onto an adjacent pair of conveyors (e.g., unloading elevator conveyors 7915*a-b*, support rails 7514*a-b*, or loading elevator conveyors 7714*a-b*).

Once the platter coupling 7165 is securely seated within and retained by the receiving coupling 7510, the controller 7005 receives a signal to begin a folding sequence as described with regard to the folding robot 7000 of US20220002936. Each folding bay 7505 of the plurality of tiered folding bays 7505*a-n* comprises at least one of one or more sliding sweep rods 7400 (e.g., for smoothing and folding the article), one or more sliding clamp rods 7200*a-b*, and a tiltable folding blade 7650 configured to clamp, smooth, and fold the laundry article disposed on the top surface 7105 of the platter 7100. The platter 7100 engaged with the receiving coupling 7510 within a bay 7505 effectively establishes a folding robot 7000.

Each folding robot 7000 within each bay 7505 comprises a movable, rotatable platter 7100 selectively mated with and secured to the rotatable receiving coupling 7510. Additionally, each folding bay comprises at least two of the following, as depicted in FIGS. 9, 10A-B, and 26-31E: at least one movable sweep rod 7400, at least one clamp rod 7200, 7200*a-b*, and at least one blade assembly 7600 in wired or wireless communication with at least one controller 7005, 205. In implementations, the platter 7100 transferred into the bay 7505 on transfer conveyors 7515*a-b* is configured to deliver a repositioned deformable laundry article 7300 for folding. The repositioned deformable laundry article 7300 can be at least one of spread out, oriented, and partially folded by a preceding autonomous robot, for example a spreading station 7505 (e.g., repositioning robot 6000) configured to manipulate the repositioned article 7300 and lay it in a spread state (e.g., flattened state) on the top surface 7105 of the platter 7100 in anticipation of folding.

Figure 26:
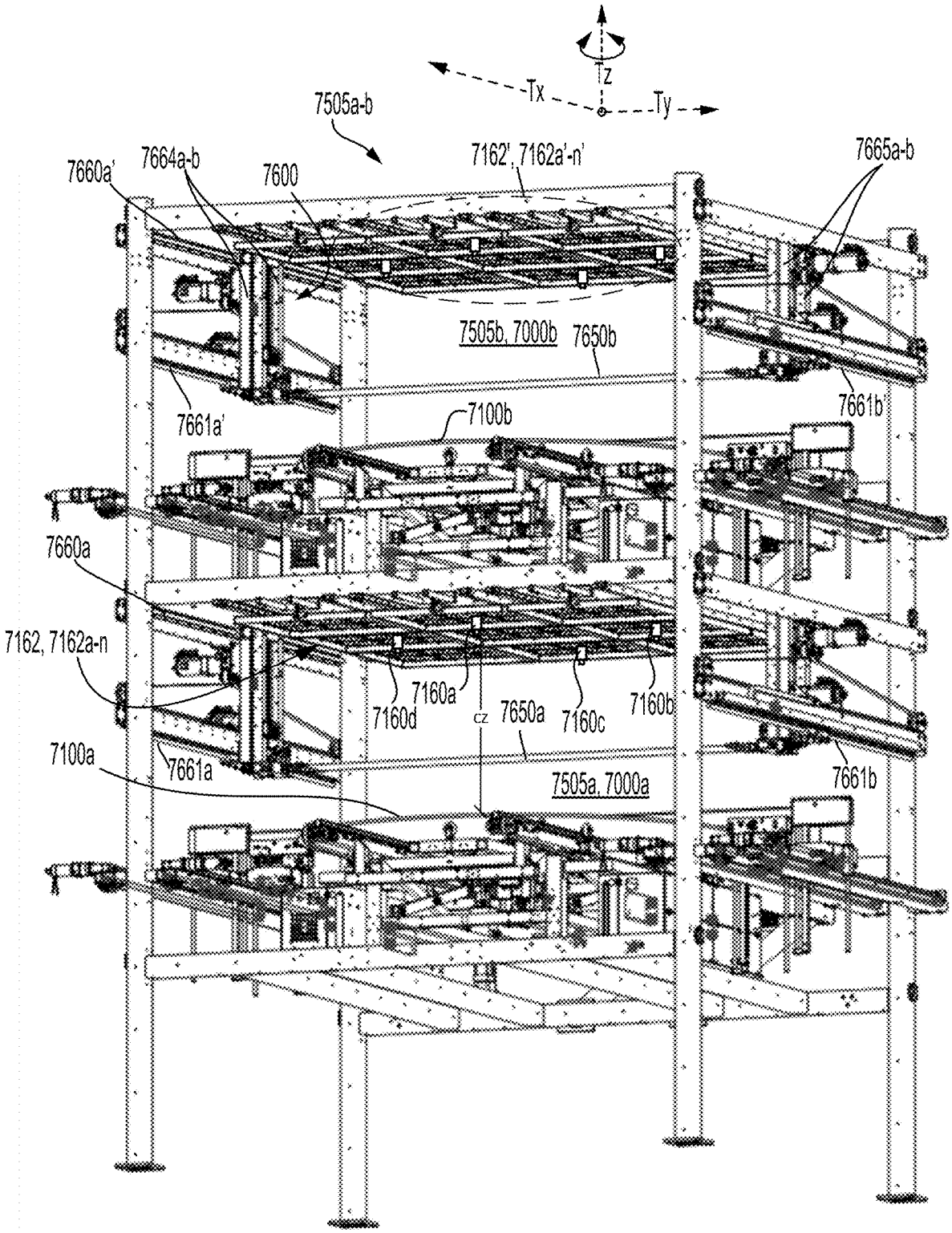
FIG. 26 depicts a perspective end view of a plurality of exemplary folding bays of an autonomous tiered folding system including example lighting, sensors, folding rods and a folding blade.

In addition to comprising at least one of at least one movable sweep rod 7400, at least one clamp rod 7200, 7200*a-b*, and at least one blade assembly 7600, in implementations, as shown in FIG. 26, the system 500 further comprises one or more sensors 7160, 7160*a-n* in operable communication with the controller 7005. The one or more sensors 7160 are configured to detect at least one of a presence, position, size, flatness, and depth of the deformable article 7300 disposed on the top surface 7105 of the platter 7100 within a bay 7505. Each folding bay 7505 of the plurality of folding bays 7505*a-n* comprises one or more sensors 7160, 7160*a-n* and one or more light sources 7162, 7162*a-n* configured to illuminate the deformable article 7300 disposed on the top surface 7105 of the platter 7100. In implementations the one or more light sources 7162, 7162*a-n* are in operable communication with the controller 7005. Additionally, in implementations, the one or more light sources 7162, 7162*a-n* are adjustable by the controller 7005 for changing hue and luminosity. The controller 7005 is configured to control one or more adjustable outputs of the one or more light sources to eliminate, diminish, and/or augment reflection, shadows, and visibility of each laundry article 7300 in accordance with fabric type and characteristics.

As shown in FIGS. 10A-B and FIG. 26, in implementations, the one or more light sources 7162, 7162*a-n* comprise a plurality of diffuse light panels each having a corresponding one of a plurality of lights disposed at least one of on, within, and above the light panel. In implementations the plurality of diffuse light panels comprise LED edge lit acrylic panels. In implementations, each one of the plurality of light panels of the plurality of light sources 7162*a-n* is configured to slide into rails suspended at the top of each individual folding bay 7505 of the plurality of tiered folding bays 7505*a-n* and lock into place in an array 7163 for ease of installation and maintenance while providing full coverage lighting within the folding bay 7505 for accurate sensor perception of a deformable laundry article 7300 during folding operations. Additionally or alternatively, in implementations, at least one of the plurality of light panels of the plurality of light sources 7162*a-n* comprises disposed therethrough, therein, or thereon one of the one or more sensors 7160*a-n*.

In implementations, the one or more sensors 7160*a-n* comprise one or more of at least one of a 3-D camera, a 2-D camera, LIDAR (Light Detection And Ranging, which can entail optical remote sensing that measures properties of scattered light to find range and/or other information of a distant target), LADAR (Laser Detection and Ranging), a sonar proximity sensor, an ultrasonic ranging sensor, a radar sensor (e.g., including Doppler radar and/or millimeter-wave radar), a fisheye lens camera, and a pair of stereo depth cameras. In implementations, each one of the one or more sensors 7160*a-n* is a camera calibrated at a fixed position and orientation relative to the platter 7100. Additionally or alternatively, in implementations, the one or more sensors 7160*a-n* output to the controller 7005 at least one of a depth map, RGB images, and IR images. In implementations at least one of the one or more sensors 7160*a-n* comprises a REALSENSE camera configured to output any of a depth map, RGB images, and IR images. In implementations, the one or more sensors 7160*a-n* can be configured to output 3-D image data to at least one controller 7005, 205. Additionally or alternatively, in implementations, at least one of the one or more sensors 7160*a-n* can be configured to output one or more 2-D images to at least one controller 7005, 205. In implementations, the one or more sensors 7160*a-n* comprise one or more features or attributes of the preceding implementations.

Additionally or alternatively, in implementations as shown in FIG. 26, the one or more sensors 7160*a-d* are disposed through, on, or in a center of four the plurality of light panels 7162*a-n*. In implementations, the one or more sensors 7160*a-d* are disposed in a center panel along each edge of a 3×3 array a plurality of light panels 7162*a-n*. Additionally or alternatively, the one or more sensors can be disposed in a central panel of the plurality of light panels 7162*a-n*. Additionally or alternatively, the one or more sensors can comprise two sensors disposed at opposite corners of the plurality of light panels 7162*a-n*. In implementations, the one or more sensors are disposed within a folding bay 7505 such that the one or more sensors detect an entire surface of a platter 7100 disposed within the folding bay 7505. Although the plurality of sensors are labeled in FIG. 26 with regard to the lower folding bay 7505*a*, it is to be understood the configuration of elements within one folding bay are applicable to all of the plurality of folding bays 7505*a-n*.

In implementations, the one of more sensors 7160*a-n* comprises a camera protruding from a lower surface of the center panel of the plurality of light panels 7162*a-n* and having a field of view encompassing the top surface of a platter 7100 received within the associated folding bay 7505. Because the camera is disposed on, in, or through a light panel 7162, the system 500 can further comprise a shroud (not shown) disposed about the camera 7160 to block any edge light from interfering with the camera's detection of a laundry article 7300 disposed on a platter 7100 therebelow. In implementations, the shroud can be recessed within a hole in the light panel 7162 of the plurality of light panels 7162*a-n* and extends proud of a lower surface of a light panel to block edge light from interfering with the camera 7160.

In one implementation, the one or more sensors 7160*a-n* comprise imaging sensors including at least one of an infrared range sensor and a volumetric point cloud sensor configured to generate range value data representative of the deformable laundry article 7300 disposed on the platter 7100. The one or more sensors 7160*a-n* can be configured to generate presence value data representative of the deformable laundry article 7300. In implementations, the presence value data can indicate a position and orientation of the deformable laundry article on the platter 7100 disposed within a folding bay 7505.

The one or more sensors 7160*a-n* are configured to at least one of detect one of one or more features and capture one or more images of the deformable article 7300 disposed on the rotatable platter 7100 disposed within one of the plurality of tiered folding bays 7505*a-n*. In implementations, the one or more light sources 7170*a-n* are disposed within each one of the plurality of tiered folding bays 7505*a-n* for enabling detection by the one or more sensors 7160*a-n* of an article 7300 on the platter 7100. As shown in FIGS. 4, 10A-B, and 38-39, the folding robot 7000 further comprises a controller 7005 in operative communication with a motor drive 7552 of a table drive motor 7519, at least one of a plurality of sweep rod, clamp rod, and folding blade Z-axis drive motors (e.g., respective motors 7205, 7405, 7605), at least one clamp rod Y-axis drive motor 7207, at least one sweep rod, clamp rod, and folding blade X-axis drive motors (e.g. respective motors 7206, 7406, 7606), a sweep rod spin drive motor 7512, a blade rotational drive motor 7690, and the one or more sensors 7160*a-n* disposed within each individual the folding bay 7505 of the plurality of folding bays 7505*a-n*.

In implementations, the controller 7005 is further configured to determine, based on a comparison of a received output signal of the one or more sensors 7160*a-n* to data stored in a memory 7010 in communication with the controller 7005, at least one of an article type, a front side, a back side, and an inside surface of the deformable article 7300. Additionally, as previously described, in implementations the controller 7005 is further configured to determine, based on a comparison of a received output signal of the one or more sensors 7160*a-n* to data stored in a memory 7010 in communication with the controller 7005 that folding of an article is in a state of acceptable completion or unacceptable completion requiring reprocessing by one or more of the folding robot 7000 and repositioning robot 6000. In implementations, at least one of the one or more sensors 7160*a-n* can be a 2-D camera and the data associated with the repositioned deformable laundry article is size invariant image data.

Additionally or alternatively, in implementations, the memory 7010 of the controller 7005 comprises a neural network 300, and determining the one or more characteristics of each one of the plurality of deformable articles comprises processing the received output signal of at least one sensor if the one or more sensors 7160*a-n* with a neural network model. In implementations, the neural network model fulfills tasks comprising at least one of a classifying, detecting, and segmenting. In implementations, the neural network model is at least one of a supervised learning model (e.g., comprising at least one of a regression algorithm, a linear classifier, a support vector machine (SVM), a decision trees, and a random forest algorithm) configured to predict an outcome based on labeled data, and an unsupervised model (e.g., comprising at least one of K-Means clustering, principal component analysis (PCA), and autoencoding) configured to determine patterns and associations in unlabeled data. In implementations, supervised and unsupervised models are configured to implement deep learning techniques. In implementations, the neural network model can be a reinforcement learning model, which also can use deep learning techniques.

In implementations, the neural network comprises a trained neural network model, for example a convolutional neural network that operates quickly on 3D and/or 2D data and is configured to classify images from one or more 3D and/or 2D cameras. In an implementation, the classification comprises generating a descriptor based on the output signal of the one or more sensors 7160*a-n* and classifying, using the neural network, the output signal based on the descriptor. The neural network is configured to output a probability that the output signal corresponds to a class of the stored data. For example, a neural network can be trained with a set of training data, and after training, the neural network comprises a set of weights that can be used for neural network inference to determine whether an input (e.g., output signal from one of the one or more sensors 7160*a-n*) is within one of the trained classes. In implementations, the classes of trained data in the neural network comprise data associated with many types of labels (e.g., classes). The plurality of classes, or labels, comprises at least two of type of article, a feature on an article (e.g., a pom pom, a tassel, a zipper, etc.), a location on the article (e.g., a waistband, a cuff, a pants crotch, etc.), the location of the article on the platter 7100, and one or more customer specific labels. A class can be indicative, for example, of one or more deformable article types that require particular folding maneuvers, for example. In implementations, the neural network model is configured to output a plurality of outputs comprising at least one of key points, garment features, and a mask of the garment on the platter 7100. In implementations, the classes of trained data in the neural network comprise data associated with at least one of many types of deformable laundry articles, features, key points, etc. that influence cumulatively improved folding maneuvers to reach a final folded state within dimensions of a pre-set footprint area, as level as possible, and without unfolding.

In implementations the one or more sensors 7160*a-n* comprises a depth camera that generates point clouds (e.g., a REALSENSE camera) or a stereoscopic arrangement of two or more 2D or 3D cameras positioned above the platter 7100 and aimed at the top surface 7105. In implementations, the one or more sensors 7160*a-n* comprise at least two depth cameras angled at the platter to capture the entire platter. The controller 7005 is configured to combine the received point clouds from the at least two depth cameras and transform the combined received point clouds into a flattened, top down image of an article disposed on the platter 7100. The controller 7005 is configured to generate a non-warped view of the entire platter 7100 and an article disposed thereon. Additionally or alternatively, in implementations, the one or more sensors 7160*a-n* comprises a single depth camera mounted at a fixed location relative to the platter. In implementations, the controller 7005 is configured to rotate the platter 7100 on which the single depth camera is aimed for continuously collecting data (e.g., a plurality of images or video). The single depth camera is configured to capture the platter 7100 and an article thereon in its entirety during a full 360 degree rotation. The controller is configured to construct a complete rendering of the article. In implementations, the complete rendering can be flattened. In implementations, the complete rendering or flattened rendering can be provided to the neural network model for prediction. In implementations, the surface of the platter 7100 is non-speculative. In implementations, the top surface 7105 is a single color, such as white or grey, for providing readily detected contrast to most deformable articles 7300. In implementations, the top surface 7105 comprises two or more regions of at least one of different color and pattern. Returning to FIG. 26, the one or more sensors 7160*a-n* comprises a plurality of cameras 7160*a-d* positioned at a height of CZ above the rotatable platter. In implementations, the height CZ is in a range of between about 1 to 5 meters (e.g., 1 m, 1.5 m, 2 m, 2.5 m, 3 m, 3.5 m, 4 m, 4.5 m, 5 m). In implementations, the one or more sensors 7160*a-n* can be positioned directly above the center 7107 of the platter 7100. In implementations, the one or more sensors 7160*a-n* comprise four cameras 7160*a-d* evenly distributed about a central panel of the plurality of light panels 7162*a-n*. Additionally or alternatively, the one or more sensors 7160*a-n* may be offset from the center 7107 of the platter 7100 and/or angled from the vertical axis Tz (e.g., Z-axis). In all implementations, the one or more sensors 7160*a-n* are positioned at a fixed height and orientation relative to a platter 7100 having a platter coupling 7165 fully engaged with the receiving coupling 7510 within the folding bay 7505.

In implementations, at least one controller 7005, 205 is configured to receive one or more output signals from the one or more sensors 7160*a-n*, determine, based on the received one or more output signals, at least one of an article type, size, thickness, and location of the deformable article 7300 on the platter 7100. The controller 7005 is configured to determine based on the at least one of the determined article type, determined article size, determined article thickness, and the location, a first fold line of the deformable article, instruct a drive motor 7512 to rotate the platter 7100 to align the fold line of the deformable article with the at least one clamp rod suspended above the platter, and instruct the at least one clamp rod 7200, 7200*a-b* to lower onto the first fold line. The lowered at least one clamp rod 7200 is configured to apply force and immobilize the fold line of the deformable laundry article 7300 against the surface 7105. The controller 7005 is further configured to instruct the at least one movable sweep rod 7400 to slidably move in a first direction between the deformable article 7300 and the surface 7105 to a position adjacent and parallel to the at least one retractable clamp rod 7200, and raise the deformable article up and over the at least one retractable clamp rod 7200, slidably moving in the first direction at least until the article 7300 disengages from the at least one movable sweep rod 7400. In examples, aligning the fold line (e.g., the location on the article 7300 where the clamp rod 7200 presses) of the deformable article 7300 with the at least one clamp rod 7200 comprises rotating the fold line to a substantially parallel position with the at least one clamp rod 7200.

As described previously with regard to implementations, the system 500 comprises at least one of a local controller 7005 and remote controller 205 in operable communication with the one or more sensors 7160*a-n* of each of one of the plurality of tiered folding bays 7505*a-n*. As shown in the control system 400 schematic of FIG. 4, the controller 7005 is in operable communication with at least one or more sensors disposed about a work volume 7707 of the spreading station 7705 (e.g., repositioning robot 6000), one or more unloading station sensors 7952*a-n* disposed about an unloading station 7950, one or more sensors disposed about the return conveyor 7990, one or more elevator drive motors 7782*a-b*, 7982*a-b*, the drive motor 7512 of each of the plurality of tiered folding bays 7505*a-n*, and drives configured to move of each of the at least two of one or more sliding sweep rods 7400, a sliding clamp rod 7200, and a tiltable folding blade 7650 in at least two of the orthogonal Tx, Ty, and Tz coordinate directions.

In implementations, the at least one controller 7005, 205 is configured to determine, based on input signal(s) received from the one or more sensors 7160*a-n*, the presence or absence of one of the plurality of rotatable platters 7100 in each one of the plurality of tiered folding bays 7505*a-n*, identify an unoccupied bay 7505, and instruct the loading elevator 7700 to raise one of the plurality of rotatable platters 7100*a-n* and a repositioned laundry article 7300 thereon from the spreading station 7700 to the identified unoccupied bay 7505 while transiting the platter 7100 on the conveyors of the elevator for handing off either to support rails 7514*a-n* that hand the platter off to the transfer conveyors 7515*a-b* or directly to the transfer conveyors 7515. In implementations, the system comprises support rails 7514*a-b, a'-b'* extending from a first open end 7506 of the tower of the plurality of tiered folding bays 7500 to enables the spreading station 7705 to be spaced apart from the tower 7500 and the return conveyor 7990 below the so that none of the structures collide. The arms 6110*a-d*, for example, of the spreading station 7705 required a large zone of free space around them so that they can move freely without one end or the other of each arm colliding with another structural element. Additionally, the presence of support rails 7514*a-b, a'-b'* enables the loading elevator conveyors 7715*a-b* to remain shorter and more uniform with other conveyors of the system for ease of construction, operation, and maintenance. Having all of the conveyors in the system sized evenly assists with timing the movements of the chains and centering pins. As described previously with regard to implementations, the system 500 comprises a coupling sensor 7564 in operative communication with the controller 7005. The coupling sensor 7564 in each bay 7505 is configured to detect the platter 7100 coupling successfully engaging the receiving coupling 7510 and provide an output signal to the controller 7005 indicative of at least one of a successful engagement of the platter coupling 7165, an unsuccessful engagement, and a release of the platter coupling 7165 from engagement with a receiving coupling 7510.

As described previously, each individual folding bay 7505 of the plurality of tiered folding bays 7505*a-n* comprises at least two of one or more sliding sweep rods 7400, one or more sliding clamp rods 7200, and a tiltable folding blade 7650 collectively configured to clamp, smooth, and fold the laundry article disposed on the top surface 7105 of the platter 7100. In implementations, each folding bay 7505 of the plurality of folding bays 7505*a-n* includes at least one clamp 7200, 7200*a-b* configured to clamp a deformable article 7300 to the top surface 7105 of a platter 7100 in a lowered position. The at least one clamp 7200, 7200*a-b* is configured to raise and lower from the surface 7105 of the rotatable platter 7100 and slidably move parallel to the surface 7105. In implementations, the at least one clamp 7200, 7200*a-b* is configured to be moved synchronously or asynchronously and in orthogonal coordinate Tx, Ty, and Tz directions by drive motors in operable communication with corresponding clamp drives, e.g., X axis drive 7230, 7230*a-b*, Y axis drive 7235, 7235*a-b*, and Z axis drive 7240, 7240*a-b* (FIG. 4) driving corresponding drive motors 7205*a-b*, 7206*a-b*, 7207*a-b* (FIGS. 10A-B, and 39-42). In implementations, the at least one clamp 7200, 7200*a-b* can be an elongated rod. In other implementations, the at least one clamp 7200, 7200*a-b* can be an elongated flat, spatula-like bar. In implementations, the at least one clamp 7200 can comprise two retractable clamps 7200*a*, 7200*b* as shown at least in FIGS. 10A-B and 38, configured to be simultaneously controlled for synchronized, coordinated movement.

As shown in FIGS. 22-25, a drive motor 7512 is configured to rotate the platter 7100 about a central axis Tzc. The drive motor 7512 is driven by a motor drive 7552 (FIG. 4) in operable communication with the controller 7005. The drive motor 7512 can include an encoder 7560 for determining rotational position of the platter 7100. The controller 7005 is configured to receive signals from the encoder 7560 and a positional feedback sensor (e.g., an optical sensor 7564 such as a break beam or a camera configured to detect one or more detectable fiducials, a hall sensor, etc.) for determining the rotational position such that an article on the platter 7100 can be rotated to a particular angle for at least one of clamping and folding. For example, the platter 7100 is configured to rotate a number of degrees to orient a targeted fold line parallel to at least one of a clamp rod 7200, a sweep rod 7400, and a folding blade 7650 for at least one of clamping, sweeping smooth and folding the article 7300. In implementations, the one or more encoders 7560 and sensors 7564 are in communication with a sensor interface 7558 configured to communicate with the controller 7005 via a network interface 7554. Additionally or alternatively, the platter support 7508 comprises a processor 7550 in operable communication with the motor drive 7552, the encoder 7560, one or more sensors 7564*a-n*, the sensor interface 7558, and the network interface 7554 configured to communicate with the controller 7005 via wired or wireless communications.

The rotatable platter 7100 can be oriented like a compass with "North" N, indicating a beginning position for rotation, regardless of the position of the turntable as determined by encoder tics. The encoder tic position can inform a direction of travel (e.g., rotation) to arrive at a desired rotational position. In one implementation, a full rotation comprises 4096 tics. The number of tics in a full rotation can be specific to a particular encoder. In implementations, the rotatable platter 7100 is round and a complete rotation of the rotatable platter 7100 includes rotating a north most point by 360 degrees, or 4096 tics. A deformable article 7300 can be disposed on the rotatable platter 7100 such that a clothing vector is at an initial angle to a radius through the northern most point. Rotating the platter 7100 counterclockwise until to a desired rotational position that can be selected to align the clothing vector and/or a fold line with a clamp rod 7200. The drive motor 7512 can rotate the rotatable platter 7100 such that the at least one clamp rod 7200, 7200*a-b* aligns with a first clamp position on the deformable article 7300. The first clamp position can be, for example, a fold line on the deformable article 7300, along which at least a portion of the article 7300 is folded.

Figure 40:
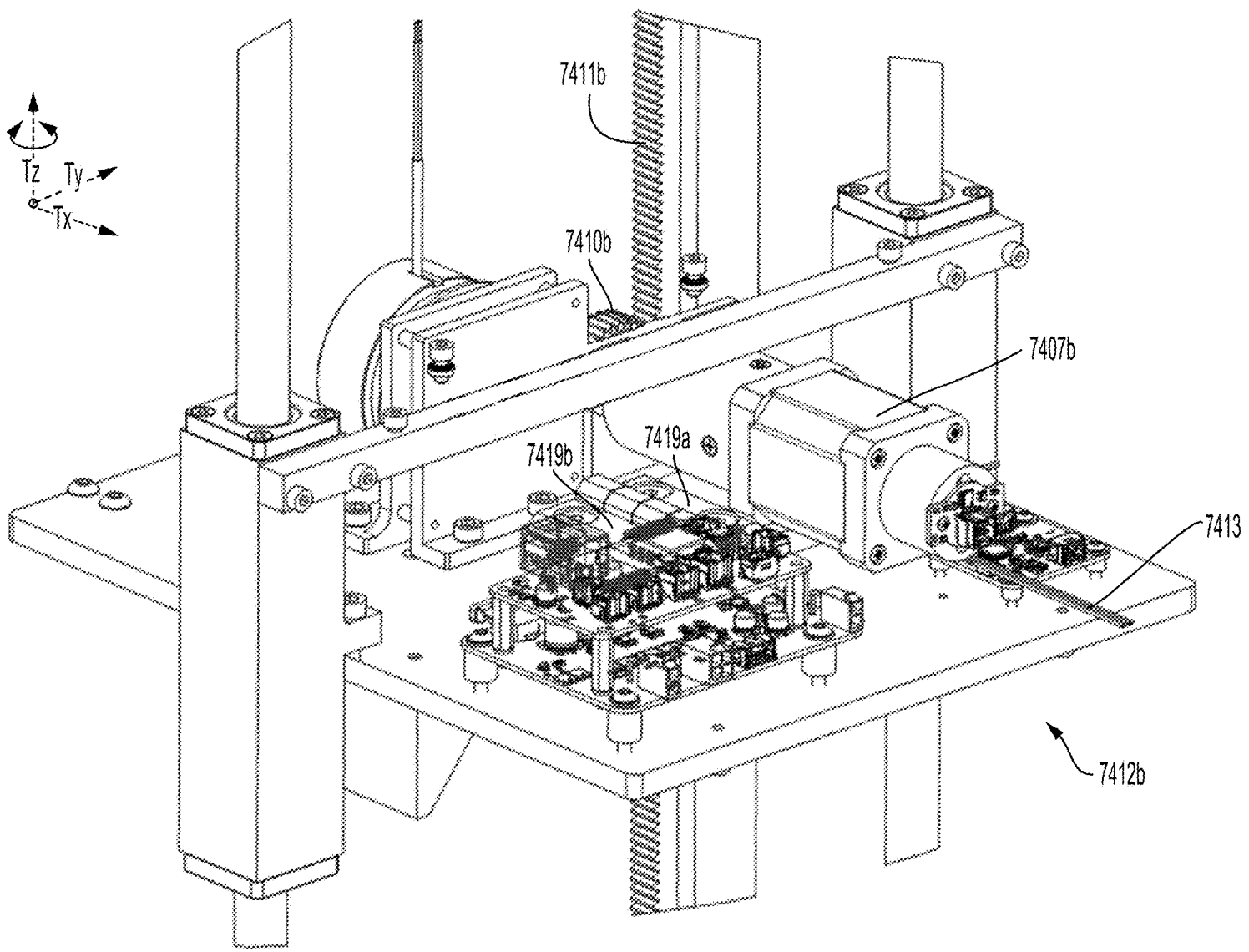
FIG. 40 depicts a close-up outside perspective view (e.g., view from outside the folding bay) of a carrier for sweep rod of FIG. 39 with enclosure surfaces removed including an example force sensor assembly.
Figure 41:
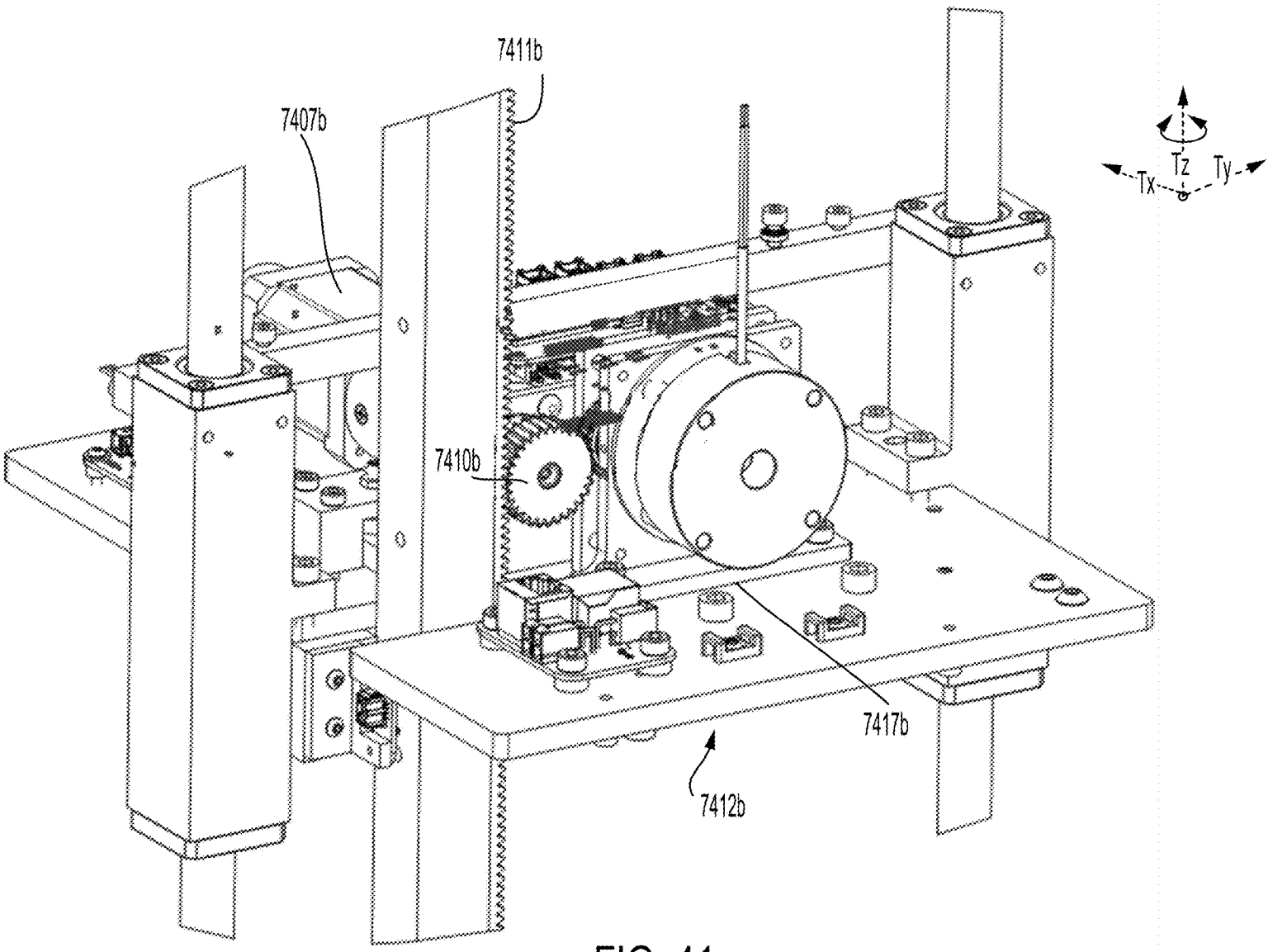
FIG. 41 depicts a close-up inside perspective view (e.g., view from inside the folding bay) of a carrier for sweep rod of FIG. 39 with enclosure surfaces removed including an example force sensor assembly.
Figure 42:
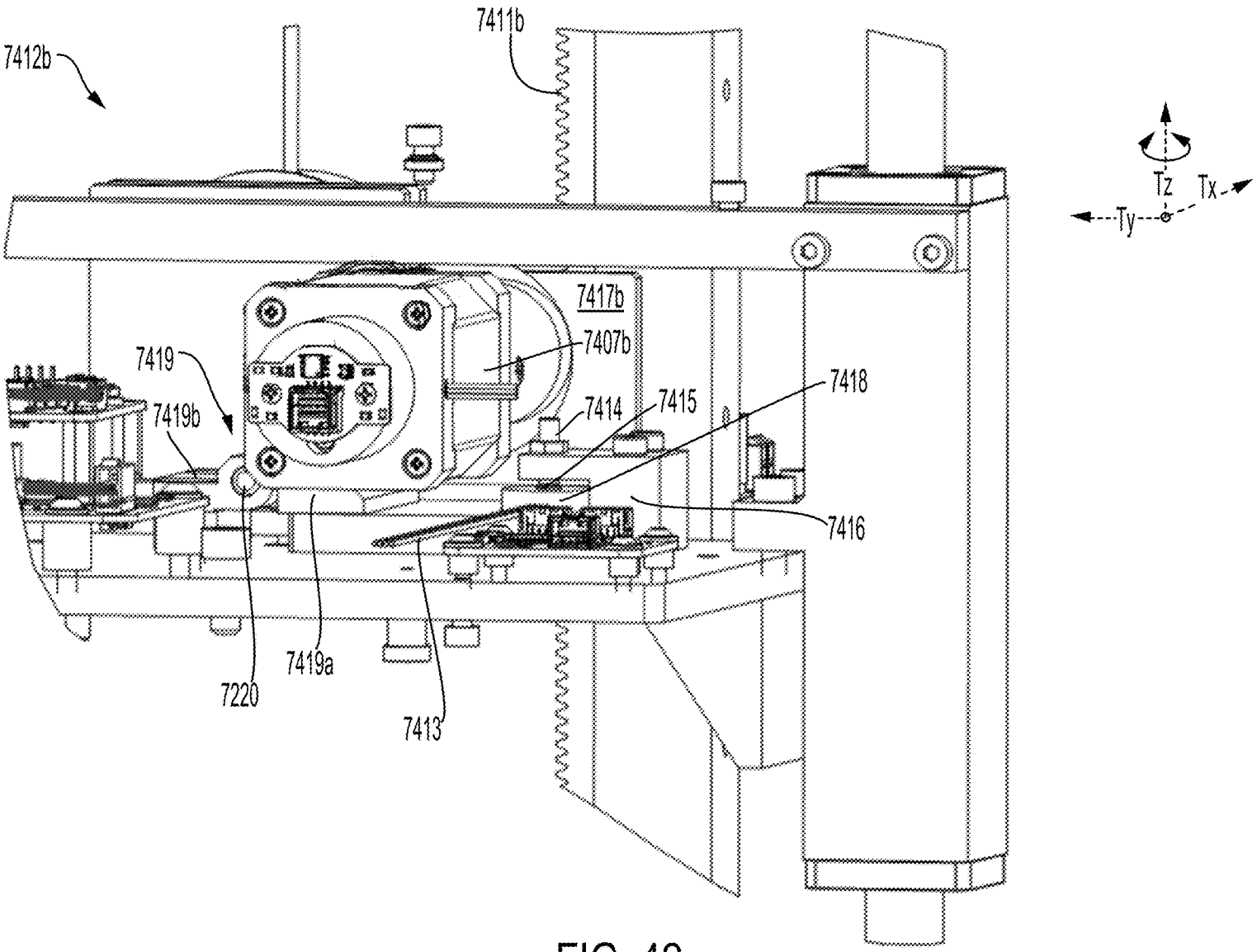
FIG. 42 depicts another a close-up outside perspective view of a carrier for sweep rod of FIG. 39 with enclosure surfaces removed to show an example force sensor assembly.

As shown in FIG. 10A, in implementations, at least one movable sweep rod 7400 is disposed parallel to the at least one clamp rod 7200, 7200*a-b*. In implementations, the at least one movable sweep rod 7400 is configured to be moved bidirectionally in each of Tx and Tz coordinate directions by drive motors in operable communication with corresponding sweep drives, e.g., X axis drive 7430, 7430*a-b* and Z axis drive 7440, 7440*a-b*. Optionally, in some embodiments, the at least one movable sweep rod 7400 is configured to be moved in the Ty direction by at least one drive motor in operable communication with at least one Y axis drive. Additionally, in implementations, the at least one movable sweep rod 7400 is configured to be rotated about its longitudinal axis by a rotation motor in operable communication with a spin drive 7435, 7435*a-b*. The at least one Z-axis drive 7440 is configured to operate a Z-axis motor 7407 (FIG. 40-42) to raise and lower the carrier of the at least one movable sweep rod 7400 from the surface 7105 of the rotatable platter 7100. For example, in implementations, a Z-axis drive motor 7440 is configured to engage a pinion gear 7410 configured to engage a vertical rack 7411 (e.g., as shown in FIGS. 40-42) for lowering and raising the at least one movable sweep rod 7400 toward and away from the surface 7105 of the platter 7100. The at least one movable sweep rod 7400 also is configured to slidably move parallel to the surface, bidirectionally in alignment along an X-Axis aligned with the Tx coordinate direction.

In implementations, under the operable control of the at least one controller 7005, 205, the at least one movable sweep rod 7400 is configured to slide under an unclamped portion of the deformable article 7300, and lift the unclamped portion above the at least one clamp rod 7200. The at least one movable sweep rod 7400 is configured to pass, or carry, the unclamped portion over the at least one retractable clamp rod 7200, and dispose the lifted unclamped portion to a resting position atop another portion of the deformable article 7300 while continuing to move in the X-axis direction Tx to disengage from the article. In implementations, the at least one movable sweep rod 7400 can move in an arc while passing the unclamped portion deformable article 7300 over the at least one clamp rod 7200 at a peak height above the surface 7105 of the platter that clears the clamp rod and enables the article to wrap around the clamp rod. The controller 7005 is configured to instruct the X-axis drive motor 7405 and Z-axis 7407 drive motor to move the sweep rod 7400 simultaneously to follow an arcuate movement path. In implementations, the article wraps around the clamp rod 7200 in tension during folding for a tightest possible fold bend radius that ensures a stable fold.

Carrying the unclamped portion 7310*a* in an arc 7410 ensures the raised portion of the article 7300 is passed up, over, and away from the clamp rod 7200 to land atop an unclamped portion of the article disposed on the rotatable platter 7100 in as tightly folded a layering as possible, wrapping the folded unclamped portion around the clamp rod 7200. Laying the folded layers as flat as possible ensures the final folded garment will be stackable in a packing queue without toppling and/or unfolding. With regard to implementations of methods of folding, at least one of article thickness and stiffness are considered in determining where to place a clamp rod 7200 such that the unclamped portion passed over the clamp does not resist folding and spring back to an unfolded state. In implementations, thicker and stiffer fabrics require clamping further into a garment from the edge than thinner, less stiff fabrics. In implementations, a default minimum clamp position from an edge (e.g., 5 cm, 5.5 cm, 6 cm, 6.5 cm, 7 cm, 7.5 cm, 8 cm, 8.5 cm, 9 cm, 9.5 cm, 10 cm, 10.5 cm, 11 cm, 11.5 cm, 12 cm, 12.5 cm) ensures successful folding regardless of fabric type or thickness.

As previously described, the folding robot 7000 (e.g., a movable, rotatable platter 7100 installed in a folding bay 7505 and the corresponding folding rods and blades in that folding bay 7505) is configured to fold a plurality of types of deformable articles autonomously. In implementations, the received deformable article 7300 is substantially extended. For example, a preceding robot in the process line (e.g., spreading station 7705, also a repositioning robot 6000 with a platter 7100 installed) can manipulate each of the deformable articles to spread each the article 7300 such that all extremities (hoods, torso portions, sleeves, legs, straps, skits, etc.) are fully spread or substantially spread to a flat or substantially flat condition. A substantially flat condition can include a deformable article 7300 having in a range of 1 to 5 tucked or twisted edges or corners of the article that can be resolved and/or accommodated by smoothing and folding processes executed by the folding robot 7000. Additionally or alternatively, in implementations, flat or substantially flat can include articles comprising a plurality of surface wrinkles that can be resolved and/or accommodated by smoothing and folding processes executed by the folding robot 7000 of each folding bay 7505 of the plurality of folding bays 7505*a-n*.

In implementations, the deformable article 7300 is one of a plurality of deformable laundry articles 7300*a-n* comprising two or more article types of at least one of different sizes and different shapes. For example, the deformable article 7300 can be one of a plurality of laundry articles comprising a single load of household laundry. Household laundry can comprise many types of bodily worn garments (undergarments, tee shirts, pants, dresses, skirts, shorts, pajamas, dress shirts, etc.) and cloth articles requiring washing (e.g., sheets, tablecloths, curtains, bath rugs, etc.). These garments and articles are deformable, meaning they do not hold their shape. Because garments and other cloth articles are supple, they deform when manipulated. Different items of the plurality of laundry articles may have different thickness and stiffness values depending on the material and style of the item. For example, a woven bathmat will be stiffer than a silk blouse. The plurality of laundry articles in a single load of household laundry also can comprise many different laundry articles each having a different weight. Additionally, the size of each deformable article 7300 of the plurality of laundry articles can vary greatly within a single load of laundry, such that folding each deformable article 7300 requires maneuvers particular to each article. As will be described subsequently with regard to implementations, at least one controller (e.g., controller 7005 and remote terminal 205) will determine a folding process based on a determination of at least one of article type (e.g., shirt, pants, sock, bathrobe, zippered top, hooded sweatshirt, blouse, button front shirt, sweater, baby clothes, coats, blankets, coats, curtains, bed sheets, and towels), article size, article material thickness, material stiffness, remaining available volume in a receiving box (e.g. a packing box for return shipment to a household), one or more predetermined target final folded area footprint dimensions, and dynamical changing responses to each sequential folding maneuver.

In implementations, each of the two or more article types comprises a longest dimension of between about 4 cm to 500 cm. Accordingly, in examples, the rotatable platter 7100 has a shortest dimension in a range of between about 0.5 m to 5 m. In examples, such as those of the preceding examples, the rotatable platter 7100 is circular and the shortest dimension is a diameter. In implementations, each one of the plurality of platters 7100*a-n* in the system 500 comprises a diameter of between about 75 cm to 3 m. In implementations, the diameter is in a range of about 2.0 m to 2.6 m. In examples, the platter 7100 comprises a continuous flat top surface 7105. The continuous flat surface 7105 can be opaque. In implementations, the continuous flat surface 7105 comprises at least one of a solid color and pattern. Additionally or alternatively, in implementations, the continuous flat surface 7105 comprises at least one color. In implementations, the flat top surface 7105 can include one or more fiducial markers affixed to the flat top surface 7105 at known positions about a central z-axis Tzc for orienting the deformable article 7300 on the rotatable platter 7100. For example, the fiducial marker can be one or more visible markers (e.g., a line, a dot, a barcode tag, a letter, a number, a refractory disc, etc.) detectable by an optical sensor (e.g., sensor 7160) disposed adjacent the platter 7100 for sensing detectable fiducial markers on the top surface 7105 of the platter 7100. The one or more sensors can output a signal to the controller 7005, and at least one of the controller 7005 and remote terminal 205 (e.g., remote, or centralized, controller 205) can determine a rotational position of the platter 7100 based on the received signal indicative of a pose of one or more sensed fiducial markers relative to a known rotation position (e.g., a "home" position, such as a 0-degree rotational position). In implementations, the rotatable platter 7100 comprises a cross sectional thickness (in the direction of Tz) in a range of between about 0.5" to 2" (e.g., in a range of between about 1 cm to 5 cm). The rotatable platter 7100 comprises and/or is manufactured from at least one of foam core, polystyrene, balsa wood, aluminum, aluminum honeycomb, stainless steel, sign board, bamboo, and ULTRA-BOARD. The rotatable platter 7100 comprises and/or is manufactured from a stiff, lightweight material that has a low inertia under rotation for more immediate response to commands to rotate and stop in precise alignment to one or more of the at least one clamp rod 7200, the sweep rod 7400, and another element, such as a folding blade 7650.

In examples, the spin drive motor 7512 is configured to rotate the platter 7100 at a fastest speed in a range of between about 30 RPM to 120 RPM. In implementations, the at least one controller 7005, 205 can determine a fastest rotational speed based on at least one of the size, weight, and type of laundry article 7300 disposed on the platter 7100. Intelligently limiting the rotational speed for lighter, thinner fabrics (e.g., as detected by at least one of the spreading station 7705 (e.g., repositioning robot 6000) and separating robot 5000) prevents the laundry article from flapping on top of itself when spread on the platter 7100 and/or toppling when at least partially folded. The drive motor 7512 can be reversible and configured to rotate the platter 7100 in at least one of a forward direction and reverse direction depending on the most efficient rotation (e.g., a least amount of rotational distance) for orienting a received article 7300 with the at least one of at least one clamp rod 7200, a sweep rod 7400 and a folding blade 7650.

Returning to FIG. 10A, the folding robot 7000 (e.g., an autonomous device comprising a movable, rotatable platter 7100 installed in a folding bay 7505 and the corresponding folding rods and blades in that folding bay 7505) further comprises a plurality of parallel support rails 7420*a-b*, 7220*a-b*, secured to parallel sides in the folding bay 7505*a* and disposed adjacent a platter 7100. In implementations, the plurality of parallel support rails 7420*a-b*, 7220*a-b* run length wise between the open ends 7506, 7507 of the bay. The first clamp rod 7200*a* of at least one clamp rod 7200 is configured to engage a first carrier 7212*a* slidably disposed on an inner one 7220*a* of the plurality of parallel support rails and the at least one sweep rod 7400 is configured to engage a second carrier 7412*a* slidably disposed on a next outer one 7420*a* of the plurality of parallel support rails. Alternatively, the at least one clamp rod 7200 can be configured to engage the second carrier slidably disposed on the outer one of the plurality of parallel support rails and the at least one sweep rod 7400 can be configured to engage the first carrier 7212*a* slidably disposed on the inner one of the parallel rails. In implementations, the first and second carrier 7212*a*, 7412*a* each further comprise at least one of a clamp Z-axis drive motor 7207*a* (not shown) and a sweep Z-axis drive motor 7407*a* (e.g., drive motor 7407*b* FIGS. 40-42). In implementations, the at least one Z-axis clamp drive motor 7207*a* and the sweep rod Z-axis drive motor 7407*a* are linear drive motors configured to raise and lower the engaged at least one clamp rod 7200 and at least one sweep rod 7400 up and down, away from and toward, the top surface 7105 of the platter 7100. In implementations, the at least one clamp rod comprises a pair of clamp rods 7200*a-b* that can operate synchronously or asynchronously, lowering to different clamp heights to accommodate uneven thicknesses of an article disposed on the platter 7100. The height variations can be determined by the at least one controller 7005, 205 based on at least one of a sensor signal from the one or more sensors 7160*a-n* indicating an article thickness above the plane of the top surface 7105 and a sensors signal of a feedback sensor configured to detect each clamp making contact with a laundry article 7300.

In implementations, the folding robot 7000 (e.g., an autonomous device comprising a movable, rotatable platter 7100 installed in a folding bay 7505 and the corresponding folding rods and blades in that folding bay 7505) comprises similar components on both sides of the platter 7100. The Z-axis drive motors 7207*a-b* (not shown), 7407*a-b* disposed on either side of the platter 7100 are configured to be synchronously controlled for level raising and lowering of the engaged respective clamp rods 7200*a-b* and one or more sweep rods 7400 evenly along their lengths. Alternatively, in implementations, one or more of the Z-axis drive motors 7207*a-b*, 7407*a-b* on either side of the platter 7100 can be asynchronously controlled, being operated one side at a time, for example, to accommodate clamping a particular article 7300 having a sensed uneven thickness (e.g., measured height from the top surface 7105). In implementations, the Z-axis drive motors 7207*a-b*, 7407*a-b* further comprise a motor gear brake for preventing the raised sweep rod 7400 and one or more clamp rods 7200*a-b* from lowering in an uncontrolled and unexpected movement. In implementations, the Z-axis drive motors 7207*a-b*, 7407*a-b* operate a linear actuator including at least one of a belt, chain and sprocket, a screw drive, a motor driven pinion gear configured to engage a vertical rack, and a pneumatic drive. For example, in implementations, as shown in FIG. 40, a Z-axis drive motor 7407*b* of a sweep rod 7400 is configured to engage a pinion gear 7410 configured to engage a vertical rack 7411' for lowering and raising the carrier 7412*b* along the rack and correspondingly raising and lowering the sweep rod 7400*b* toward and away from the surface 7105 of the platter 7100.

As shown in FIGS. 10A-B, the first carrier 7212*a* can be configured to cantilever the engaged first clamp rod 7200*a* above the rotatable platter 7100, and a third carrier 7212*b* is configured to cantilever the engage second clamp rod 7200*b* above the rotatable platter 7100. Additionally or alternatively to the at least one clamp rod 7200, 7200*a-b* being retractable and/or telescoping, at least one of the first carrier 7212*a* and third carrier 7212*b* can further comprise a pivot joint (not shown) for tilting the engaged at least one clamp rod 7200, 7200*a-b* above the rotatable platter 7100. In examples, the at least one clamp rod 7200, 7200*a-b* is retractable, and the first carrier 7212*a* and third carrier 7212*b* further each comprise at least one friction wheel configured to engage the clamp rod 7200*a-b* for extending and retracting over the platter 7100 in the Ty coordinate direction. For example, the at least one friction wheel is driven by a Y-axis drive motor 7206*a-b* in operative communication via a drive belt or other similar motion transfer mechanism. The Y-axis drive motor 7206*a-b* drives the friction wheel to rotate forward and in reverse to extend and retract the at least one clamp rod 7200*a-b*. The friction wheel engages a lower edge of the at least one clamp rod 7200, 7200*a-b* to extend and retract the at least one clamp rod over the platter 7100 and a deformable article 7300 disposed thereon. In implementations, the at least one clamp rod 7200, 7200*a-b* can be supported by two or more rotatable guide wheels for supporting and aligning the at least one clamp rod 7200, 7200*a-b* at a fixed position parallel to the Y-axis Ty. In examples, the at least one clamp rod 7200, 7200*a-b* is telescoping and configured to extend and retract over the platter 7100.

As indicated in FIGS. 10A-B, the first and second carriers 7212*a, a'*, 7412*a. a'* of each bay 7505*a-b* are driven to slide along two of the first plurality of parallel support rails 7420*a*, a', 7220*a, a'* by respective first and second X-axis drive motors 7205*a, a'*, 7405*a, a'*. In implementations, the X-axis drive motors 7205*a, a'*, 7405*a, a'* comprise power linear actuators configured to move the first and second carriers 7212*a*, 7412*a* along their respective support rails 7420*a, a'*, 7220*a. a'* in the X-axis (e.g., Tx coordinate) direction. In implementations, the linear actuators comprise at least one of a belt, such as a timing belt, a chain, a reel and spool, and a pneumatic drive. In implementations, each of the X-axis drive motors 7205*a, a'*, 7405*a, a'* comprises a shaft encoder 7265*a-b*, 7465*a-b* (FIG. 4) for determining a position of each of the first carrier 7212*a, a'* and second carrier 7412*a, a'*. Additionally or alternatively, each of the support rails 7420*a*, 7220*a* comprises a limit switch 7270, 7270*a-b*, 7470, 7470*a-b* (FIG. 4) for determining a starting, or home, position of each respective carrier 7212*a, a'*, 7412*a, a'* and an incremental position encoder 7260, 7260*a-b* 7460, 7460*a-b* (FIG. 4) for subsequently tracking a location of each carrier 7212*a, a'*, 7412*a, b'* along their respective support rail 7420*a*, 7220*a* during folding and smoothing operations.

As described previously, a second plurality of parallel support rails 7420*b*, 7220*b* are disposed parallel to the first plurality of parallel support rails 7420*a*, 7220*a*, and adjacent the rotatable platter 7100 such that the rotatable platter 7100 is disposed between the first plurality of parallel support rails 7420*a*, 7220*a*, and second plurality of parallel support rails 7420*b*, 7220*b*. The second plurality of parallel support rails 7420*b*, 7220*b* comprises a second set of carriers 7212*b*, 7412*b* and X-axis drive motors 7205*b*, 7405*b*, Y-axis drive motor 7206*b*, and Z-axis drive motors 7207*b*, 7407*b*. The functionality of the second set of carriers 7212*b*, 7412*b* are identical to those previously with regard to the first set of carriers 7212*a*, 7412*b*, the first parallel support rails 7420*a*, 7220*a*, drives, linear actuators, shaft encoders, limit switches, and incremental encoders.

In implementations, as previously described the X-axis drive motors 7205*a-b* of the at least one clamp rod 7200, 7200*a-b* are configured to be synchronously controlled on both sides of the platter 7100 to maintain the carrier ends of the first and second clamp rods 7200*a-b* at matching positions along their respective rails and therefore in line with one another along a Y-axis oriented in the coordinate Ty direction. In implementations in which the at least one clamp rod 7200 is a single rod, the synchronized control of the X-axis drive motors 7205*a-b* prevents an uneven motion of the carrier ends that would result in twisting a unitary clamp rod 7200. Similarly, the X-axis drive motors 7405*a-b* of the sweep rod 7400 are configured to be synchronously controlled on both sides of the platter 7100 to maintain the carrier ends of the sweep rod 7400 at matching positions along their respective rails and therefore in line with one another along a Y-axis oriented in the coordinate Ty direction.

In implementations, as shown in FIG. 10A, the at least one clamp rod 7200 comprises a first clamp rod 7200*a* engaged with the first carrier 7212*a* slidably engaged with a support rail 7220*a* and a second clamp rod 7200*b* engaged with a third carrier 7212*b* slidably engaged with another support rail 7220*b*. The third carrier 7212*b* can be engaged with an inner one 7220*b* of the second plurality of parallel support rails 7420*b*, 7220*b* disposed on an opposite side of the platter 7100 from the first plurality of support rails 7420*a*, 7220*a*. Alternatively, the third carrier 7212*b* can be slidably engaged with an outer one 7420*b* of the second plurality of parallel support rails 7420*b*, 7220*b*. Under operative control of the at least one controller 7005, the X-axis drive motors 7205*a-b* of the first and second clamp rods 7200*a-b* can be configured to transit synchronously along their respective support rails 7220*a-b* in an X-axis Tx direction. Alternatively, the first and second clamp rods 7200*a-b* can be configured to slide asynchronously in an X-axis Tx direction, for example, when clamping an article in more than one location simultaneously or when clamping with only one of the first and second clamp rods 7200*a-b* and stowing the other out of the way of the sweep rod 7400 during a folding motion. Under operative control of the at least one controller 7005, the Y-axis drive motors 7206*a-b* of the first and second clamp rods 7200*a-b* can be configured to extend and retract the first and second clamp rods 7200*a-b* synchronously along the Y-axis Ty direction. During operation, a central longitudinal axis of each of the first and second clamp rods 7200*a*, 7200*b* can align with a shared axis such that the rods align end-to-end over the platter 7100. In implementations, the first and second clamp rods 7200*a-b* comprise an end-to-end gap therebetween in a range of between about 0 to 50 mm in a fully extended position. In implementations, the first and second clamp rods 7200*a-b* can extend to allow the sweep rod 7400 to pass over the first and second clamp rods 7200*a-b* while moving along the X-axis direction (e.g., forward and reverse in the Tx coordinate direction).

In alternate implementations, the at least one clamp rod comprises a single piece clamp rod engaged with the first carrier and a third carrier slidably engaged with an inner one of the second plurality of parallel support rails such that the single clamp rod extends across the entire rotatable platter 7100. The single piece clamp rod can be retractable and the first carrier can further comprise at least one friction wheel configured to engage the clamp rod for extending and retracting over the platter. The at least one clamp rod can be telescoping and configured to extend and retract over the platter. In examples of at least one of a retractable and telescoping single clamp rod, the third carrier can be configured to selectively receive and release the single clamp rod when fully extended. In examples, the first carrier further comprises a pivot joint for tilting the engaged at least one clamp rod above the rotatable platter 7100 and the third carrier is configured to selectively receive and release the single clamp rod when tilted to a lowered position.

In alternate implementations, the at least one sweep rod comprises a first sweep rod configured to engage with the second carrier and a second sweep rod configured to engage with a fourth carrier slidably engaged with one of the second plurality of parallel support rails. In examples, the fourth carrier is slidably engaged with one of the second plurality of parallel support rails 7420*b*, 7220*b*. In examples, the fourth carrier is slidably engaged with an outer one of the second plurality of parallel support rails 7420*b*, 7220*b*. In implementations, as shown in FIGS. 10A-B, the at least one sweep rod 7400 comprises a single sweep rod 7400 engaged with the second carrier 7412*a* slidably engaged along a support rail 7420*a* of the first plurality of parallel support rails and a fourth carrier 7412*b* slidably engaged with a support rail 7420*b* of the second plurality of parallel support rails, the single sweep rod 7400 extending across the entire rotatable platter 7100. Additionally or alternatively, in implementations, each of the first and second pluralities of parallel support rails comprise three or more rails disposed on opposing sides of the support frame 7508*a*. For example, a third rail or pair of rails (one on each side of the support frame 7508) can support one or more of a pinpoint clamp, a robotic arm, and a rotatable (e.g., tiltable) blade, as will be described subsequently with regard to implementations.

In implementations, the folding robot 7000 (e.g., an autonomous device comprising a movable, rotatable platter 7100 installed in a folding bay 7505 and the corresponding folding rods and blades in that folding bay 7505) further comprises at least one spin drive motor (not shown) operating under the control of the spin drive 7435 (FIG. 4). The spin drive motor is configured to rotate (e.g., spin) the at least one movable sweep rod 7400 about a longitudinal axis at least one of parallel to or coaxial with a longitudinal central axis of the sweep rod 7400 while suspended above the platter 7100 and slidably moving in an X-axis direction (e.g., the Tx coordinate direction) along corresponding support rails 7420*a-b*. In implementations the at least one spin drive motor comprises a first spin drive motor disposed on the second carrier 7412*a* and a second spin drive motor disposed on the fourth carrier 7412*b*. Under operative control of the at least one controller 7005, the spin drive motors are configured to spin synchronously such that the entire length of the sweep rod 7400 rotates at the same revolution rate. In implementations, the spin drive motors each rotate a drive belt or other similar motion transfer mechanism to spin the sweep rod 7400. Rotating the entire length of the sweep rod 7400 at the same revolution rate and rotational position ensures that the rod 7400 does not twist or cause an article being swept smooth by the sweep rod 7400 to bunch by moving up or beneath the article 7300 at variable rates of rotation. In implementations, the spin motors are configured to engage a shaft encoder for maintaining a rotational position and such that a controller 7005, 205 can monitor for any slip.

In implementations, the at least one movable sweep rod 7400 is configured to slide under a terminal edge of an unclamped portion of the article 7300 while rotating. The one or more sensors 7160*a-n* can be configured to detect the terminal edge for aligning a length of the at least one movable sweep rod 7400 with the length of the terminal edge such that the terminal edge tangentially contacts movable sweep rod upon contact. This tangential contact assists with rotating the terminal edge up and onto the rotating sweep rod 7400 so that the rotating sweep rod 7400 can slide beneath the article 7300 disposed on the platter. Alternatively, in implementations, the movable sweep rod 7400 operates without spinning (e.g., rotating about its longitudinal axis).

In implementations, the at least one clamp rod 7200 and at least one movable sweep rod 7400 each comprise, or are manufactured from, at least one of wood, stainless steel, aluminum, DELRIN, polycarbonate, graphite, titanium, PVC, bamboo, and chromoly. In implementations, the rods 7200, 7200*a-b*, 7400 are stiff and resistant to bending in a fully extended position. In some examples, the at least one clamp rod 7200, 7200*a-b* and at least one movable sweep rod 7400 can be tubular to reduce weight while maintaining radial strength and stiffness along the length of the elongated rods. Additionally or alternatively, in implementations, the at least one movable sweep rod 7400 comprises a tensioned wire.

In all implementations herein described previously and hereafter with regard to a single bay 7505 of the plurality of folding bays 7505*a-n*, it is intended that all elements described with regard to the single bay 7505 are applicable to all others of the plurality of folding bays 7505*a-n*.

In implementations, the folding device 7000 (e.g., an autonomous device comprising a movable, rotatable platter 7100 installed in a folding bay 7505 and the corresponding folding rods and blades in that folding bay 7505) further comprises one or more force sensors disposed on at least one of the at least one clamp Z-axis drive motor and a contact surface of the at least one clamp rod 7200, 7200*a-b* configured to contact an article 7300 disposed on the platter 7100. In implementations, at least one of the sweep rod 7400', one or more sweep rod Z-axis motors 7407*a-b*, and/or at least one carrier 7412*a'-b'* comprises a force sensor configured to detect an amount of force the sweep rod 7400' imparts on the article and output a signal indicative of the amount of force to the controller 7005 for instructing the one or more Z-axis motor 7405*a'-b'* to maintain the downward force applied with a range of forces of between about 2.5N and 50N.

In implementations, the one or more force sensors comprise at least one of a compression-type load cell, a compression-tension load cell, a pneumatic load cell, a hydraulic load cell, a capacitance load cell, a strain gauge, a bending beam, and a piezo sensor. The one or more force sensors are configured to be in operative communication with a sensor interface 7255, 7455 and the at least one controller 7005, 205 via a network interface 7250, 7450 as shown in FIG. 4. The one or more force sensors can output a signal to at least one controller 7005, 205 for controlling one or more Z-axis motors and limiting the applied downward force to a range of between about 2.5N and 50 N. In implementations, such as that of FIGS. 40-42, the force sensor comprises a compression-type load cell 7418 mounted on at least one of the carriers 7412*a*, and in implementations, on all of the carriers 7212*a-b*, 7412*a-b*, and in wired connection 7413 with one or more processors, such as that of the controller 7005.

The following description of a force sensor is applicable to all clamp and sweep rods, although described with particularity with regard to a sweep rod 7400: The load cell 7418 is configured to output a signal indicative of the amount of force a sweep rod 7400*b* is imparting to the surface 7105 of the platter 7100 and/or an article disposed thereon. As shown in FIGS. 40-42, the compression-type load cell 7418 is configured to receive a downward force applied to a pressable button 7415 of the load cell 7418 once the sweep rod 7400 contacts the article 7300 disposed on the platter 7100 or the top surface 7105 of the platter 7100 and receives a resistance force.

The at least one sweep rod contacts the article 7300 or platter surface 7105 with an amount of downward force. An opposing upward, resistive force acts on a contacting portion of the sweep rod 7400 which transmits a downward force on holding end of the sweep rod 7400 and the carrier 7412*b* on which the sweep rod is mounted. The carrier 7412*b* is prevented from lowering the sweep rod 7400 further past a point of resistance, and the Z-axis drive motor 7407*b* reacts by reversing the pinion gear 7410 to climb up the rack 7411.

In implementations, the Z-axis drive motor 7407*b* and load cell 7218 are configured to mount to a motor bracket 7417*b* secured to a first hinge flap 7419*a* of a stiff hinge 7419. A second hinge flap 7219*b* of the stiff hinge and knob bracket 7216' are configured to be affixed to the carrier 7412*b*. A knob 7414 is configured to be affixed to the knob bracket 7416 and disposed at a calibrated distance above and/or in end-to-end contact with the pressable button 7415 of the load cell 7418. When the Z-axis drive motor 7407*b* is prevented from lowering the carrier 7412*b* further, the attached pinion gear 7410 climbs up the rack 7411 in an upward vertical direction Tz pulling the Z-axis drive motor 7407*b* upward. The carrier 7412*b*, the second hinge flap 7419*b*, the knob bracket 7416, and the knob 7414 affixed thereto remain stationary in the vertical direction Tz while the Z-axis motor 7407, the motor bracket 7417, and loadcell 7418 disposed thereon move upward with the first hinge flap 7419*a* which pivots upward around the hinge spine 7420 independently from the affixed second hinge flap 7419*b*. Once the sweep rod makes contact with at least one of the laundry article and/or the surface 7105 of the platter 7100, movement of the sweep rod is slowed and/or hindered, and the Z-axis motor 7407*b*, the motor bracket 7417, and load-cell 7418 react to the resistance force by moving upward to back off of the lowered position. The knob 7414 is positioned above the pressable button 7415 of the load cell 7418 as shown in FIG. 42 such that the stationary knob 7414 contacts the upward moving pressable button 7415 therebeneath.

Based on the received output signal from the load cell 7418, the controller 7005 can instruct the Z-axis drive motor 7407*b* to raise or lower the sweep rod to actively limit the amount of force the sweep rod applies to the article disposed on the platter 7100. Alternatively, in implementations, the load cell 7418 can be mounted directly beneath the Z-axis drive motor 7407 such that a housing of the Z-axis drive motor 7407 contacts and presses the pressable button 7415 directly when opposing forces are applied to the carrier 7412*b* during compression of an article by the sweep rod. As previously described, the Z-axis force sensors described with regard to the sweep rod are similarly applicable to the carriers 4212*a-b* of the clamp rods 7200*a-b* for detecting compressive forces applied by the two or more clamp rods.

In implementations, as shown at least in FIGS. 10A-B, 26-29, and 38-39, additionally or alternatively to the sweep rod 7400, the device 7000 comprises a blade assembly 7600 configured to at least one of smooth (e.g., sliding under and moving along the article to flatting wrinkles and unfurl portions of the article), clamp, fold, and compress a laundry article. In implementations, the blade 7650 is configured to rotates to about a 60-degree angle with respect to the platter surface 7105. This approximate rotational angle may be advantageous for smoothing a deformable article when placing the blade 7650 under a clamped article and when moving the blade 7650 along a deformable article on the platter to smooth any wrinkles and/or unfurl any folded over portions of the article prior to folding. As will be described subsequently with regard to implementations, the blade 7650 is configured to rotate completely through one or more partial or full 360 degree rotations for lifting, flipping, and manipulating an article during smoothing and folding processes.

In implementations, the blade 7650 is a thin, substantially planar blade, and the surface of the blade 7650 is generally smooth to reduce catching on or creating friction with the deformable article. Alternatively, in implementations, at least one surface of the blade can be treated to create a higher frictional surface to retain more smooth fabric articles thereon without the articles sliding off during a folding operation. For example, an edge and/or planar contact surface of the blade 7650 can comprise at least one of a surface topography (e.g., peening, etching, raised textural bumps) and grippy surface material (e.g., a textured coating). The blade 7650 may be formed of a metal (e.g., aluminum, stainless steel, chromoly), carbon fiber, stretched canvas, nylon or plastic/elastomeric material; however, any suitable material configured to be held in tension along its length for maintaining a consistently straight edge.

In implementations, the length of the blade 7650 is generally sufficiently long so that it extends across the platter 7100 (e.g., from 0.5 m to 5.0 m). Alternatively, in implementations, the blade 7650 may extend across only a portion of the platter 7100. In implementations, the blade 7650 comprises a length in a range of between about 2.0 m to 3.2 m. The width of the blade 7650 may be from 5 or 10 cm to 20 cm, 30 cm, 40 cm, 50 cm or more. In implementations, the width of the blade 7650 is between 10 cm and 50 cm wide. In implementations, the thickness of the blade 7650 can be 5 mm to 3 mm or 2 mm or 1 mm or less. The dimensions of the blade 7650 may be selected to pass under a deformable article 7300 and/or to provide smoothing motions over a top of the deformable article 7300. Because the blade 7650 is relatively long compared to its thickness, the blade 7650 is held in tension across its length to prevent sagging over the platter 7100, which would result in less effective smoothing and folding of an article thereon because not all portions of the blade 7650 would contact the article evenly. In implementations, a ratio of the blade length to thickness comprises a range of between about 1500 to 1 to 3000 to 1.

Figure 27:
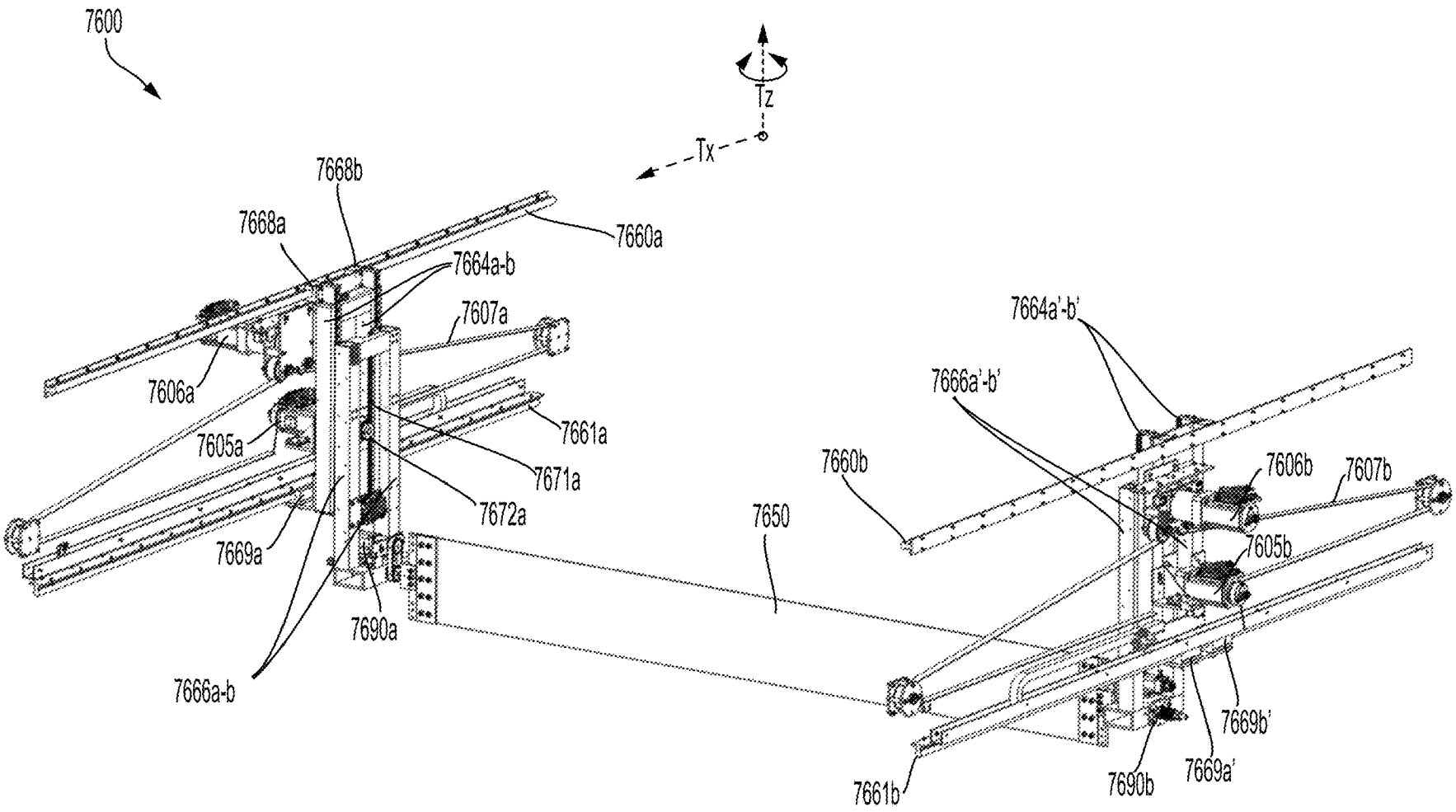
FIG. 27 depicts an example perspective view of a folding blade assembly of one of the folding bays of FIG. 26.
Figure 28:
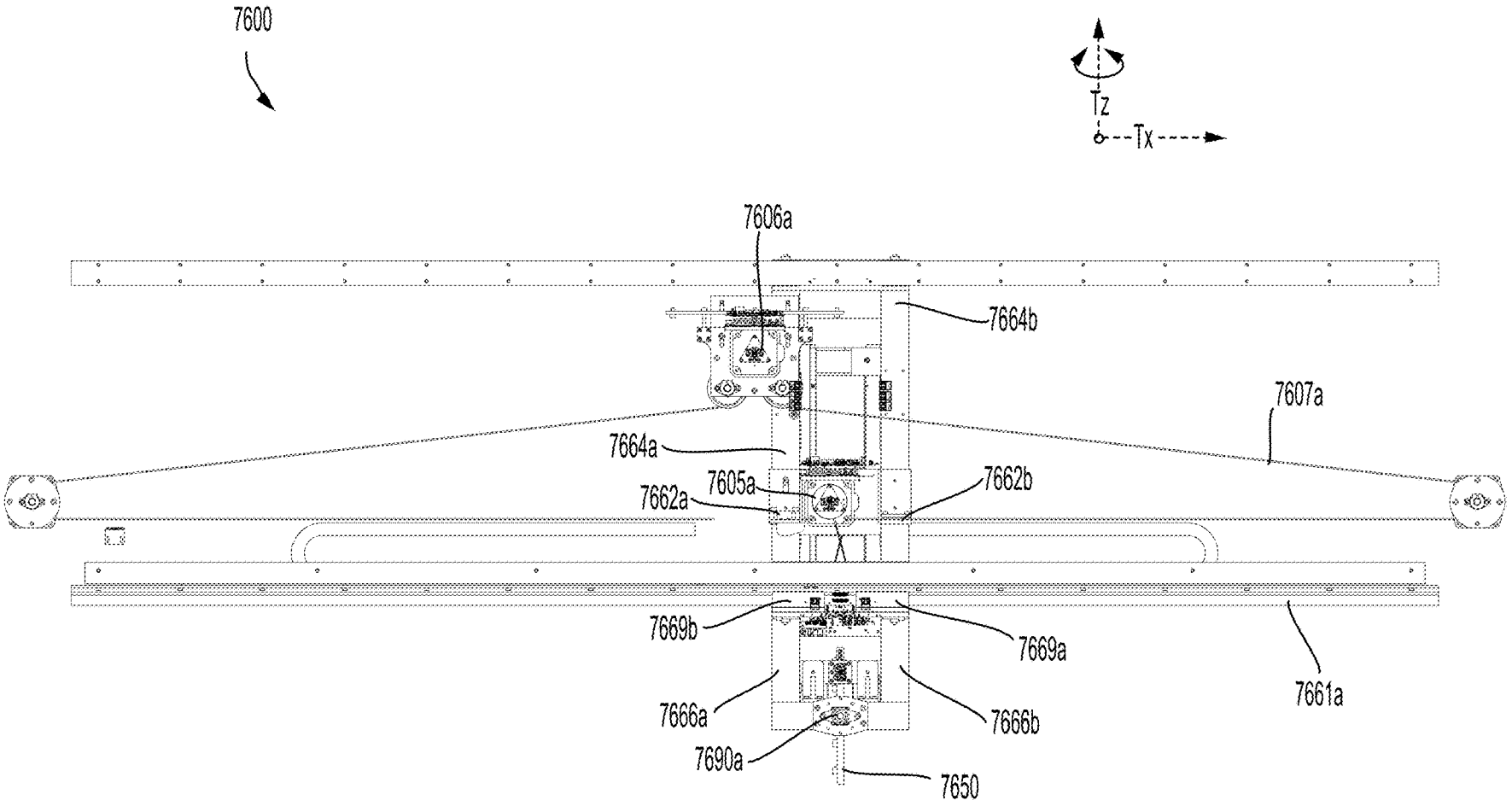
FIG. 28 is a side view of an example driven suspension assembly of the folding blade assembly of FIG. 27 viewed from outside the folding bay.
Figure 29:
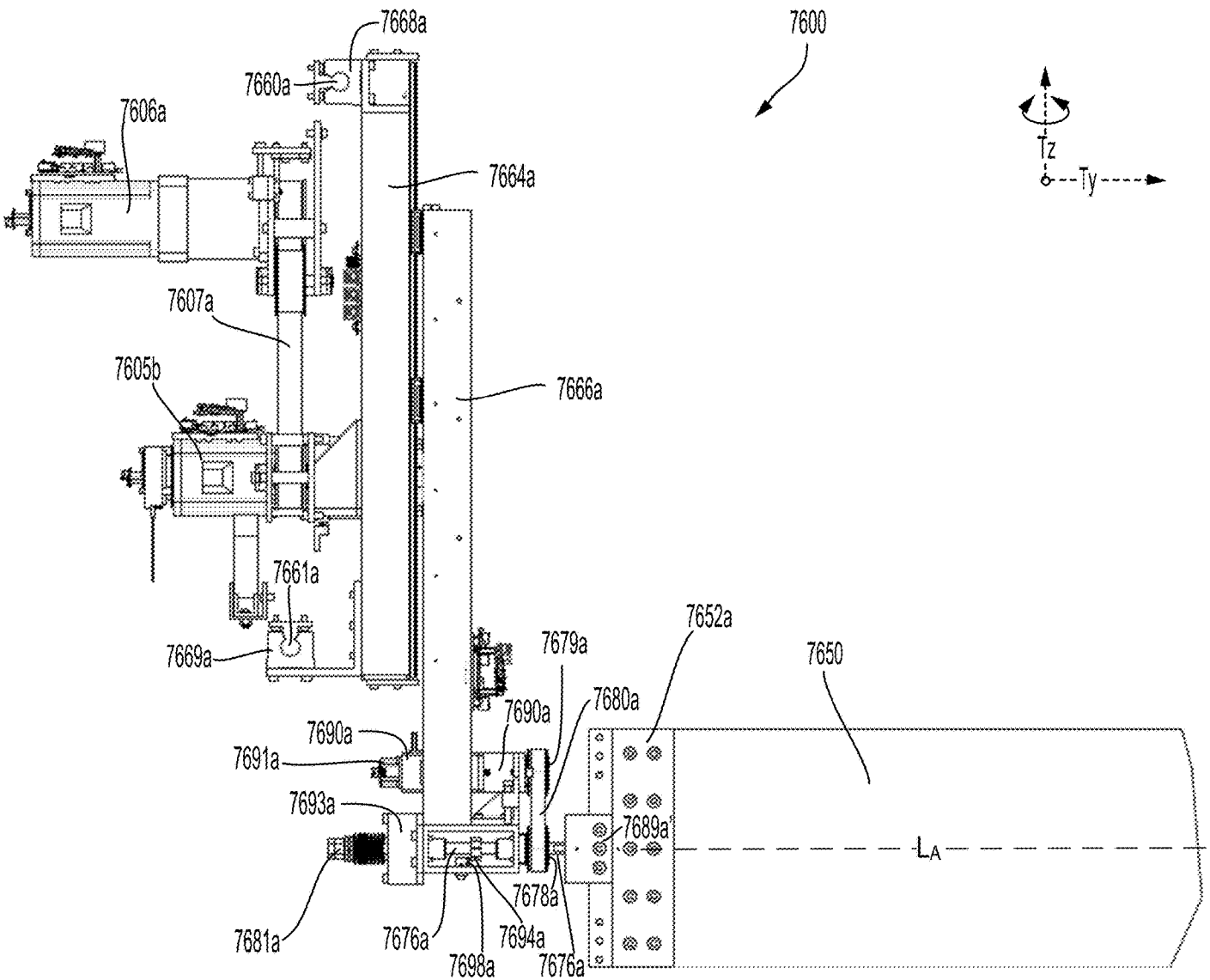
FIG. 29 depicts a close-up partial view of a folding blade, suspension assembly, and blade rotation drive of FIG. 27.

Turning now to FIGS. 9, 26, and 27-29, in implementations each one of the plurality of tiered folding bays 7505*a-n* comprises a folding blade assembly 7600 suspended from a top portion of the bay 7505. For clarity, only one side of the support and drive assemblies of a folding blade assembly 7600 is shown in FIGS. 27-29. The assembly is intended to be repeated on opposite sides of each folding bay 7505 with a single blade 7650 extending between the pairs of assemblies 7600*a-b* in each folding bay 7505. The suspended folding blade assembly 7600 comprises symmetrical systems on both ends of blade 7650 and systems described herein with regard to one end are applicable to the other end. The suspended folding blade assembly 7600 is configured to move up and stow out of the way when the pair of transfer conveyors 7515*a-b* lift a platter 7100 into and out of a folding bay 7505. Additionally, in implementations, stowing a blade 7650 all the way up at the top of a folding bay prevents the blade 7650 from interfering with at least one of one or more clamp rods 7200, 7200*a-b* and a sweep rod 7400.

In implementations, as shown in FIGS. 26-29, a pair of upper and lower linear rails 7660*a-b*, 7661*a-b* (e.g., SBR rail) can be disposed on both sides of the bay 7505 along the top of the bay, extending front-to-back (e.g., loading end to unloading end) between the open ends 7506, 7507. In implementations the upper rails 7660*a-b* extend along an interior-facing surface and the lower rails 7661*a-b* each extend along a bottom-facing surface of the bay structure for withstanding moment forces applied by the rotating and sliding blade 7650. In implementations, the blade 7650 is mounted on both ends to arms 7666*a-b* configured raise and lower in the Z-axis direction (Tz coordinate direction) along stanchions 7664*a-b*. The stanchions 7664*a-b* are mounted to upper and lower pairs of slidable carriages 7668*a-b*, 7669*a-b*, configured to move in the X-axis (Tx) direction along the upper and lower linear rails 7660*a*, 7661*a*. In implementations, the upper and lower pairs of slidable carriages 7668*a-b*, 7669*a-b* are mounted as far apart as possible (e.g., between about 10-36 inches, e.g. 25-92 cm) within the folding bay 7505 to counteract a higher blade tension force pulling on the carriages. In implementations, the upper and lower pairs of slidable carriages 7668*a-b*, 7669*a-b* comprise four carriages per each side of the blade 7650, two upper carriages engaging the upper rail 7660*a* and two carriages engaging the lower rail 7661*a*. The upper and lower pairs of slidable carriages are constrained by the rails 7660*a-b*, 7661*a-b* to take up tension in the blade 7650 and, in implementations, to withstand the blade 7650 being lowered to apply a force to "pat down" a folded up laundry article, e.g., compressing the folded article to a shorter height for more stable folds and/or more compact packing into a customer return box and, subsequently, a household dresser drawer. Additionally or alternatively, the slidable carriages can be formed monolithically with the stanchions 7664*a-b*.

As with previously described implementations, one or more drive motors of the folding blade assembly 7600 are in operable communication with at least one controller 7005, 205. In implementations, as shown in FIGS. 27-28, an X-axis drive motor 7606*a* is configured to move the slidable carriages 7660*a-b*, 7669*a-b* bidirectionally in the X-axis (Tx) direction by pulling a tensioned timing belt 7607*a* one way or another toward either of the first and second open ends 7506, 7507 of a folding bay 7505. In implementations, the timing belt 7607*a* is anchored to the stanchions 7664*a-bb* configured to move along the upper and lower linear rails 7660*a*, 7661*a*. In implementations, the ends of the timing belt 7607*a* can be anchored to the stanchions 7664*a-b* by fasteners such as for example, at least one of belt clamps 7662*a-b*, pins, staples, clips, and rivets. In implementations, the timing belt 7607*a* can be anchored to the stanchions 7664*a-b* by the ends being fed through slotted anchors and bolted, ratcheted, and/or clamped to itself like a ratchet strap held in tension.

In implementations, as shown in FIG. 27, a Z-axis drive motor 7605*a*, 7605*b* is disposed on one of each end of the blade 7650. Each Z-axis drive motor 7605*a*, 7605*b* is configured to operate a linear actuator to raise and lower the arms 7666*a-b*, 7666*a'-b'* in the Z-axis direction (Tz) along the stanchions 7664*a-b*, 7664*a'-b'*. In implementations, the linear actuator includes at least one of a belt, chain and sprocket, a screw drive, a motor driven pinion gear configured to engage a vertical rack, and a pneumatic drive. In implementations, as shown in for example on one side of the blade assembly 7600 in FIG. 27, a Z-axis motor 7605*a* drives a pinion gear 7672*a* configured to engage a rack 7671*a* disposed on at least one of the arms 7666*a-b*. Although only shown in detail on one side of the blade 7650 in the perspective view of FIG. 27, this Z-axis drive mechanism is implemented on both ends of the blade 7650. In implementations, the blade 7650 is configured to lower to a distance below the table height such that the controller 7005 can instruct the Z-axis motor 7605 to lower the blade 7650' at least to the top surface of a platter 7100 and apply additional compression force when a folded laundry article requires compression to secure folds and/or size the article to occupy a least amount of volume in a packing container. In implementations, the Z-axis motors 7605*a-b* disposed at each end of the blade 7650 are configured to synchronously raise and lower both ends such that the blade 7650 remains level above the platter 7100 during raising and lowering and all sweep and folding operations.

In implementations, as shown in FIG. 29, the blade 7650 is configured to rotate with an engaged, driven shaft 7676*a* disposed at each end of the blade 7650 in alignment with a central longitudinal axis LA of the blade 7650'. In implementations the blade shaft 7676*a* can be directly coupled to a drive motor'. Alternatively, as shown in FIG. 29, for example, the shaft 7676*a* is coupled to the drive motor 7690*a* via a pair of rotatable pulleys (or sprockets) 7678*a*, 7679*a*. In implementations, a first pulley 7678*a* is engaged with the shaft 7676*a* and a second pulley 7679*a* in vertical alignment with the first pully 7678*a* is engaged with a drive shaft of the motor 7690*a*. A drive belt 7680*a* (e.g., a timing belt) couples the motion of the second pulley 7679*a* to the first pulley 7678*a* to rotate the shaft 7676*a*. This drive configuration is replicated on both ends of the blade 7650 and the motors operate synchronously to drive the blade 7650 to rotate without twisting.

Because the blade 7650 is driven to rotate from the center of the blade (e.g., about the central longitudinal axis LA) by a single shaft 7676*a*, in implementations, the blade 7650 can rotate 360 degrees one or more times in the same direction (e.g., clockwise or counterclockwise). In implementations, as shown in FIG. 29, the shaft 7676*a'* comprises a magnet 7694*a* disposed thereon. A stationary sensor 7698*a* disposed on the arms 7666*a-b* detects a rotational position of the magnet 7695*a*, and therefore the shaft 7676*a*, and outputs a signal to the at least one controller 7005, 205 indicative of a rotational position of the blade 7650 attached to the shaft 7676*a*. The at least one controller 7005, 205 can control an angle of the blade 7650 relative to the top surface of the platter 7100 and a laundry article 7300 disposed thereon based on signals received from at least one of the sensor 7698*a* and a motor encoder 7691*a* disposed on the drive shaft of the rotational drive motor 7690*a*.

Additionally, in implementations, the blade assembly 7600 comprises at least one load cell 7693*a-b* disposed on one or both blade shafts 7676*a-b* disposed at respective opposite ends of the blade 7650. The load cell 7693*a-b* is configured to measure a tension force applied by the shaft 7676*a-b* through the length of the blade 7650. In implementations, the blade 7650 is tensioned in a range of between about 100 lbf to 400 lbf to keep the blade taught and straight with no bending or twisting between the ends. In implementations, the blade 7650 is tensioned to about 200 lbf. In implementations, tension is configured to be set manually with an adjustable nut 7681*a* on the shaft 7676*a*. In implementations, the at least one load cell 7693*a-b* is configured to output a signal to the controller 7005, 205 indicative of the tension load on the blade 7650, and the controller 7005, 205 is configured to signal at least one of an audible alert (e.g., alarm), a visible alert (e.g., flashing yellow or orange light adjacent the folding bay 7505), and an electronic alert (e.g., pop up notification on a screen of a remote device 245 or computer terminal 205) indicative of a blade 7650' being over or under tensioned so that servicing can be provided. Additionally or alternatively, in implementations the system 500 is configured to employ active blade tensioning and the at least one load cell 7693*a-b* outputs a signal to the controller 7005, 205 indicative of the tension load on the blade 7650. The controller 7005, 205 can then signal at least one actuator to automatically adjust the tensioning force applied to either one or both ends of the blade 7650 to maintain tension and keep the blade taught and straight for accurate smoothing, clamping, and folding of a deformable article. Although the blade rotational assembly is described herein with regard to a single end of the blade 7650, both ends of the blade 7650 comprise identical elements for raising, lowering and rotating the blade 7650 and those elements are configured to operate synchronously.

In all implementations herein described, the blade 7650 can be used in operations analogous to the operations as described herein with respect to the sweep rod 7400. In examples, the blade Z-axis drive motors 7605*a-b* are configured to raise and lower the blade assembly 7600 relative to the platter surface 7105 and the X-axis drive motors 7606*a-b* are configured to move the blade assembly 7600 along the parallel rails 7660*a-b*, 7661*a-b* in the X-axis direction (Tx). The rotational drive motors 7690*a-b* are configured to rotate the blade 7650, and in implementations, the rotational drive motors 7690*a-b* engaged with opposite ends of the blade 7650 are geared for synchronized motion to keep the surface of the blade 7650 flat (e.g., not twisted between the ends) in any position (e.g., any rotational angle relative to the top surface 7105 of the platter 7100). In implementations comprising both of at least one clamp rod 7200, 7200*a-b* and a blade 7650, the at least one clamp rod 7200, 7200*a-b* is disposed parallel to the blade 7650 and is configured to raise and lower from the rotatable platter and slidably move parallel to the surface such that the clamp rod 7200 can clamp a deformable article to the surface 7105 of the platter 7100 prior to the blade 7650 acting upon the article. Similar to the sweep rod 7400, the blade assembly 7600 is operably controlled by the at least one controller 7005, 205 and comprises various drives, sensors, processors, and communication electronics as depicted in FIG. 4 for controlling operations of the blade assembly 7600.

As described previously, in implementations, the blade 7650 is configured to fold one portion of the deformable article 7300 over another by operating similarly to the sweep rod 7400. Additionally or alternatively, the implementation of the blade 7650 of FIGS. 26-29 can fold one portion of a deformable article 7300 over another portion by raising up the one portion and rotating while moving laterally (Tx direction) and tilting at an angle to flip the one portion atop the another portion. Additionally, the blade 7650 can spin one or more times (e.g., 180 degrees of rotation, 360 degrees of rotation, 540 degrees of rotation, 720 degrees of rotation, etc.) while in the lowered position to fully extend the one portion over the another portion and free the blade 7650 from beneath the lifted and folded over portion.

Figure 30A:
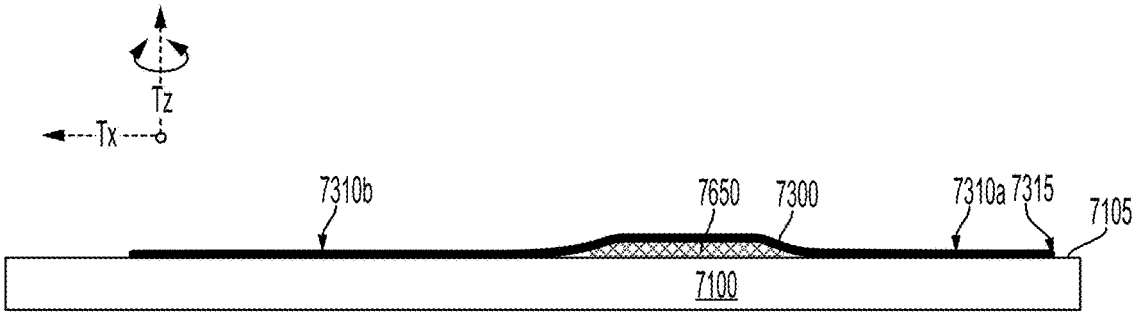
FIGS. 30A-31E depict a sequence of stages of folding an article using the rotatable blade of FIGS. 26-29.
Figure 30B:
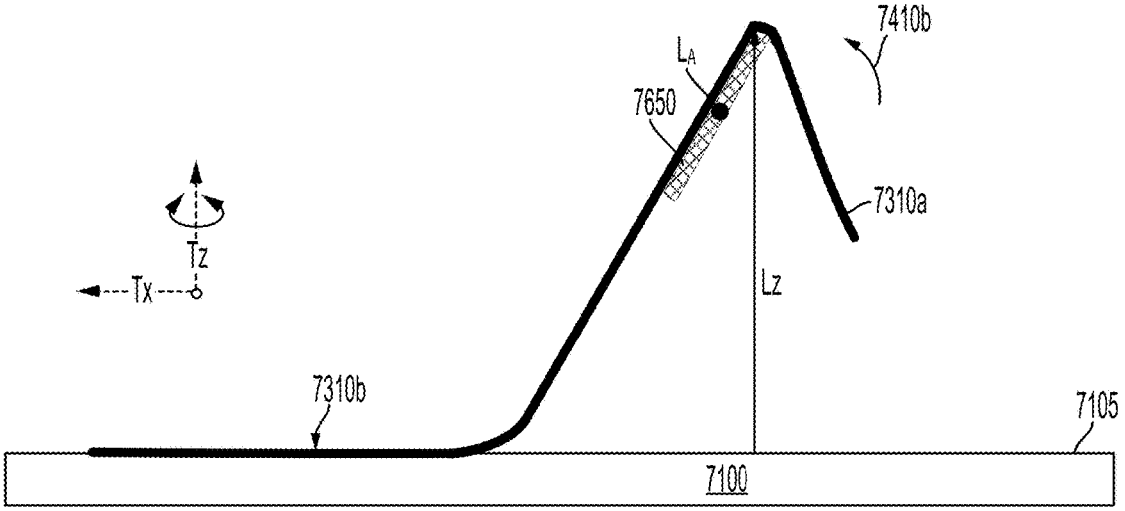
Figure 30C:
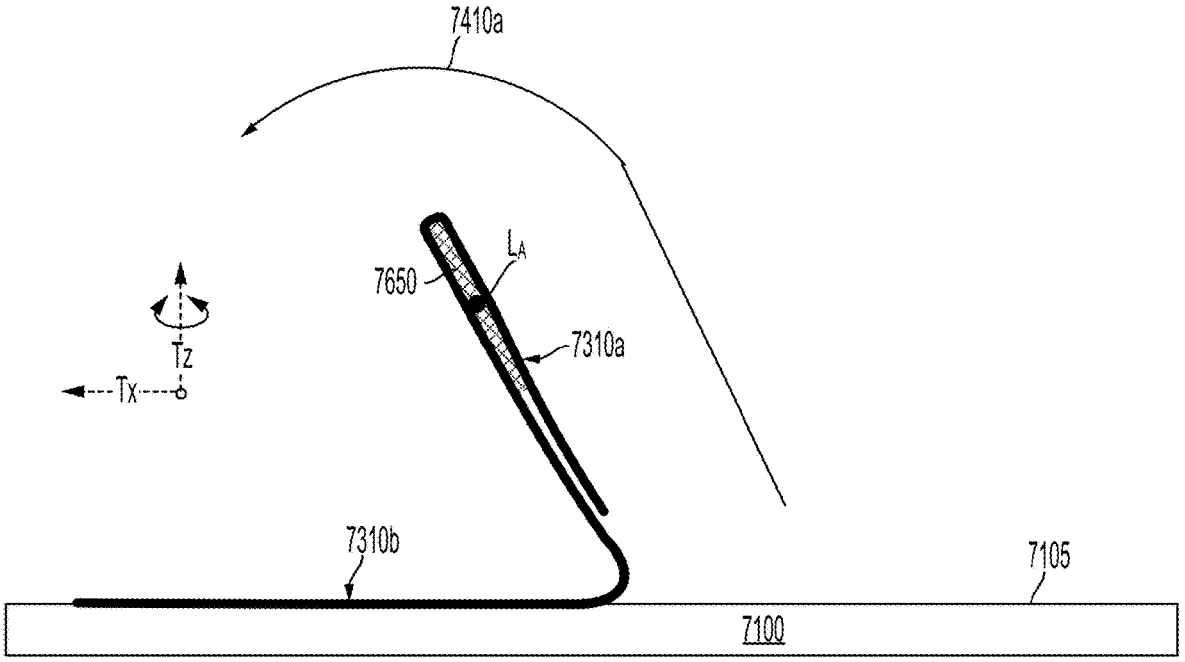
Figure 31A:
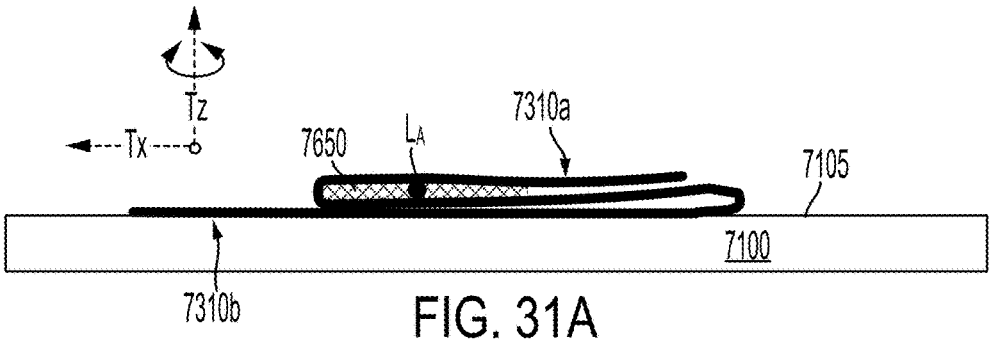
Figure 31B:
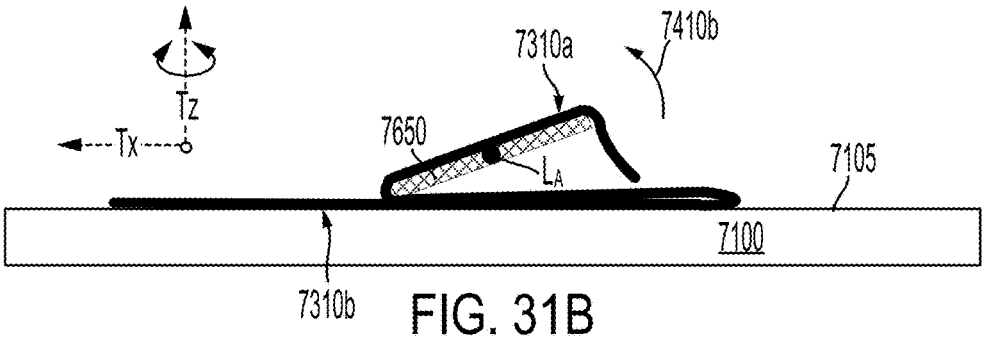
Figure 31C:
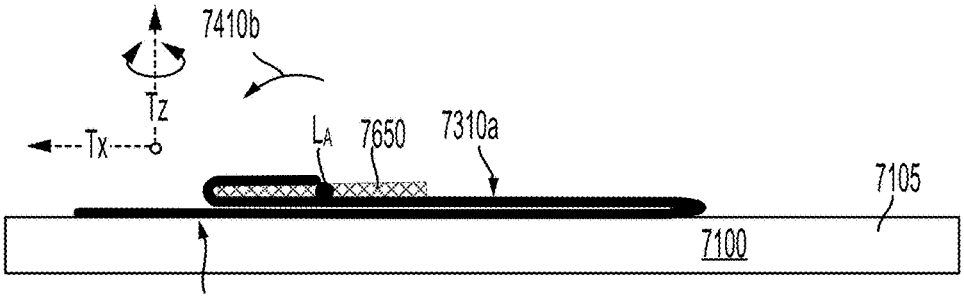
Figure 31D:
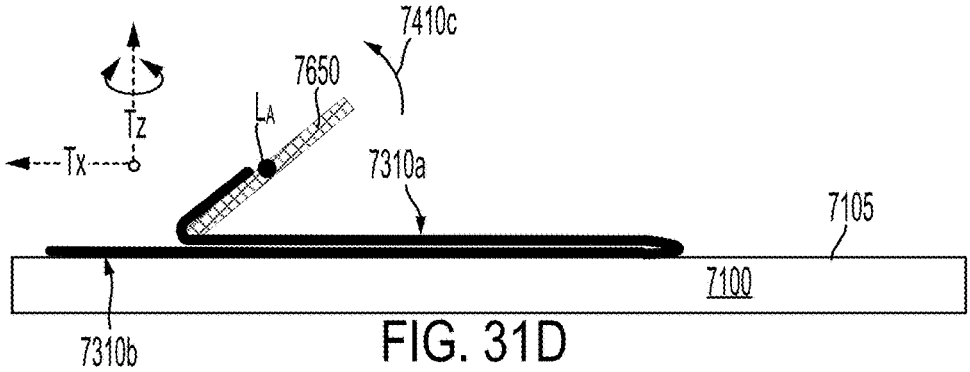
Figure 31E:
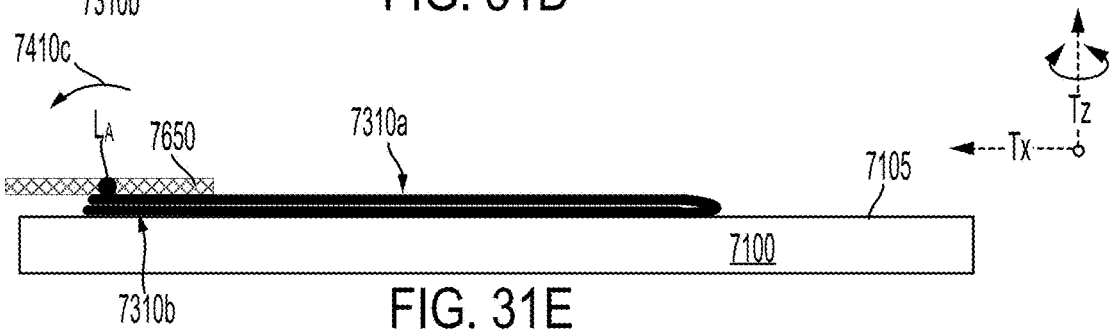
Figure 32:
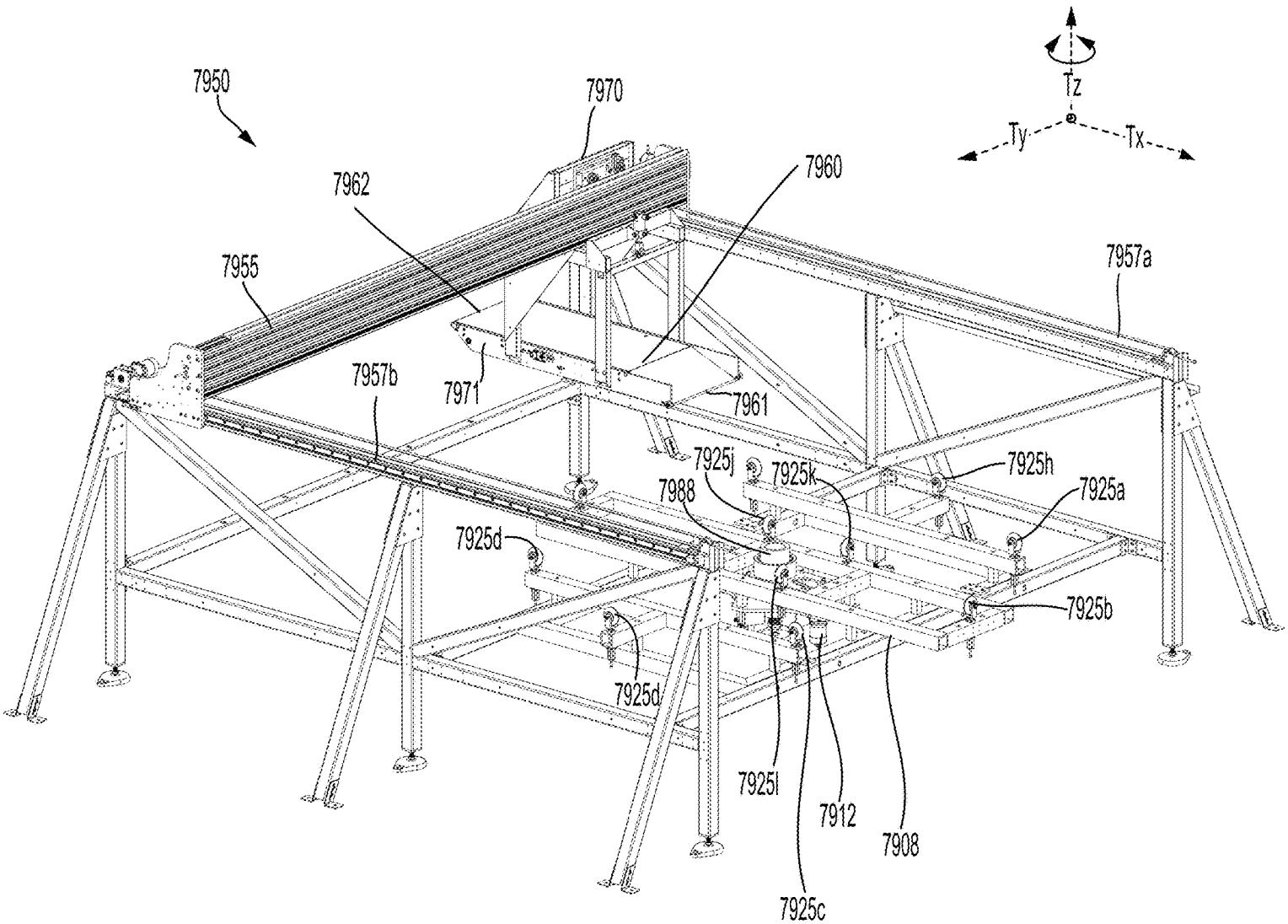
FIG. 32 depicts an example folded garment unloading station of the autonomous robotic laundry process line of FIGS. 5-8 without a movable platter disposed therein.

For example, as shown in FIGS. 30A-31E, the blade 7560 is depicted in a series of sequential positions depicting an example folding sequence. In FIG. 30A, the blade 7560 slides beneath an edge of a laundry article 7300 disposed on a platter 7100 engaged within a folding bay 7505. As depicted in FIGS. 30B-C, the blade 7560 lifts a first portion 7310*a* of the article up in the direction of arrow Lz and simultaneously rotates while sweeping an arc 7410*a* such that the blade angle passes an inflection point as it passes the top of the arc. Alternatively in implementations, the blade 7650 is configured to rotate without sweeping an arc. Additionally or alternately, the blade 7650 is configured to translate in the Tx direction while rotating about its central longitudinal axis LA. The blade 7560 continues to rotate as it moves through the arc 7410 (or additionally or alternatively, as it translates in the Tx direction) so that the blade and first portion 7310*a* are horizontally oriented (180 degrees flipped from their initial positions in FIG. 30A) as they comes to rest atop a second portion 7310*b* of the laundry article disposed on the platter 7100 as shown in FIG. 31A. A first portion 7310*a* of the laundry article is wrapped around the blade 7560 and resting atop the second portion 7310*b*. The blade 7560 can then rotate 180 degrees one or more times as shown in FIGS. 31B to 31E in the direction of arrows 7410*b-c* until the blade 756' is free of the first portion 7310*a* of the article, and the first portion 7310*a* of the article is laid flat atop the second portion 7310*b* to complete the fold. In implementations as shown in FIGS. 30A-31E, the blade 7560 performs the sequential maneuvers without an additional clamp rod. In other implementations, a retractable clamp rod (e.g., clamp rods 7200*a-b*), blade, or plate can be placed on the laundry article prior to folding by the blade 7560.

In implementations, the blade 7650 is configured to fold a portion of an article 7300 on top of itself without a clamp rod 7200, 7200*a-b* clamping the article. Optionally, at least one clamp rod 7200, 7200*a-b* is configured to first clamp a deformable article 7300 to the platter 7100 prior to the blade 7650 performing folding operations. Based on received sensor signals, the at least one controller 7005, 205 is configured to determine whether an article 7300 requires clamping prior to each folding pass. Blade folding operations may be repeated with the platter 7100 optionally rotating before one or more folding passes.

The blade 7650 can be used with folding any deformable article, but is particularly useful in operations involving heavier fabrics, such as denim, to form fold lines or to reduce wrinkles and smooth deformable articles 7300 as described herein. In implementations, the blade 7650 and the sweep rod 7400 are provided on the same folding robot 7000 (e.g., within the same folding bay 7505 of the plurality of folding bays 7505*a-n*) with an optional at least one clamp rod 7200, 7200*a-b*. In implementations, the at least one controller 7005, 205 selects one or both of the blade 7650 and the sweep rod 7400 to form fold lines. In implementations, selecting one or the other of the blade 7650 or sweep rod 7400 for executing a fold is dependent on detected or provided characteristics of the deformable article, such as at least one of fabric type, weight, article size, and shape of the deformable article. For example, the legs of a pair of stiff, heavy jeans would be more easily lifted and folded by a planar blade than by a sweep rod.

Additionally or alternatively to folding, the blade 7650 may be used to manipulate deformable articles using various operations. In examples, the blade 7650 is configured to sweep beneath and atop a deformable article 7300 to remove wrinkles and unfurl folded over portions. In examples, the blade 7650 is configured to transit at an angle over a top of a deformable article such that at least an edge of the blade 7650 contacts the deformable article to reduce folds or wrinkles in the deformable article and unfurl any folded over portions. In implementations, the article can be clamped prior to a sweep pass by the blade 7650. In implementations, a topside sweep angle of the blade 7650 comprises a range of between about 5 to 90 degrees (with vertical being 0 degrees) formed between the plane of the tilted blade and the top surface of the platter 7100 and an article disposed thereon. In implementations, the top side sweep angle comprises a range of between about 15 to 45 degrees. In implementations, the top side sweep angle can be preset to an angle suitable for all article materials and types. Additionally or alternatively, the blade 7650 further comprises one or more feedback sensors configured to output measurements to the at least one controller 7005, 205 for dynamic control. Based on output signals received from the one or more sensors 7160*a-n*, the at least one controller 7005, 205 is configured to dynamically control the angle of the blade 7650 to ride up and over protrusions (e.g., buttons, sequins, embellishments) and not run into them and potentially damage the deformable article 7300.

In implementations, the at least one controller 7005, 205 determines, in response to receiving sensor signals from the one or more sensors 7160*a-n*, a location of an edge of a folded article and operably controls the blade 7650 to slide under the edge. In implementations, the blade 7650 is configured to lift the fully folded deformable article and maintain the folded configuration while moving the deformable article to another location (e.g., onto an unloading elevator or packing station conveyor). In implementations, the blade 7650 is configured to contact the top surface 7105 of the platter 7100 or lower to just about the top surface while the platter 7100 rotates with an article thereon abutting the blade 7650 such that the article twists into a rolled spiral. This could be useful, for example, for spiral "folding" a large, heavy beach towel or a pair of pants that is otherwise unfoldable because one leg is inside out, for example.

Figure 33:
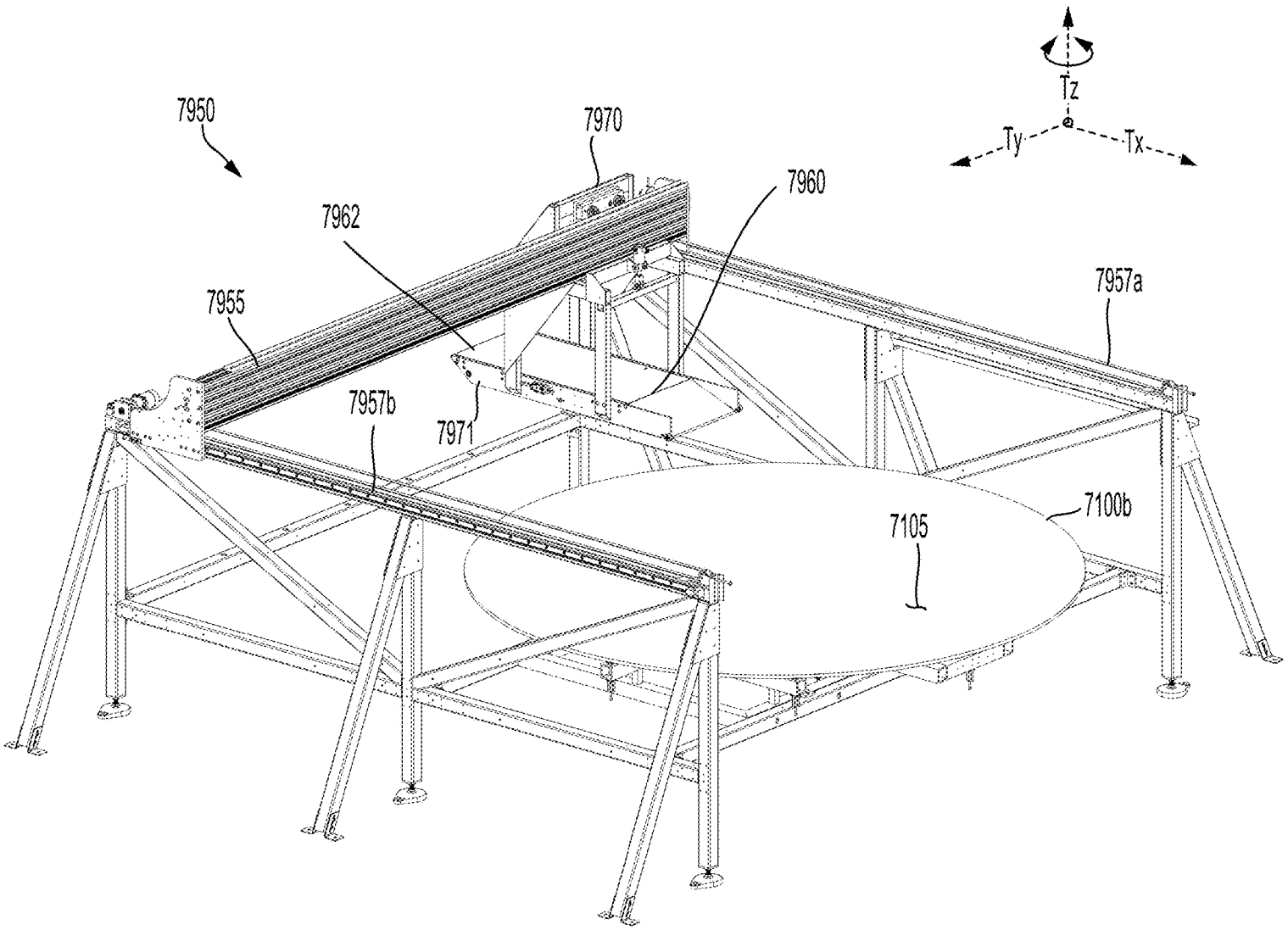
FIG. 33 depicts the example folded garment unloading station of FIG. 32 with a movable platter disposed therein and a folded article retrieval conveyor disposed in a first position.
Figure 34:
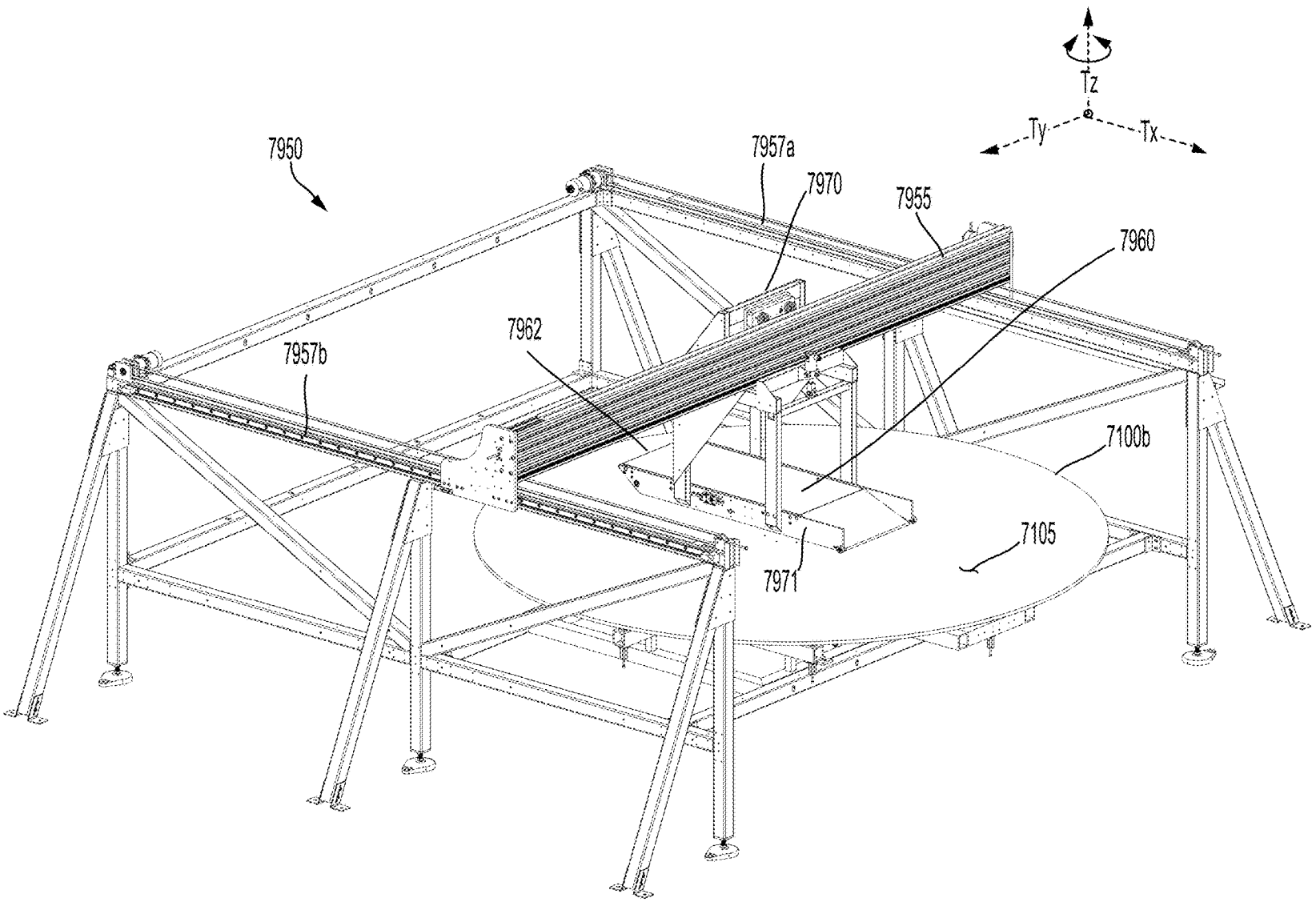
FIG. 34 depicts the example folded garment unloading station of FIG. 33 with the folded article retrieval conveyor moved over the platter to a second position.
Figure 35:
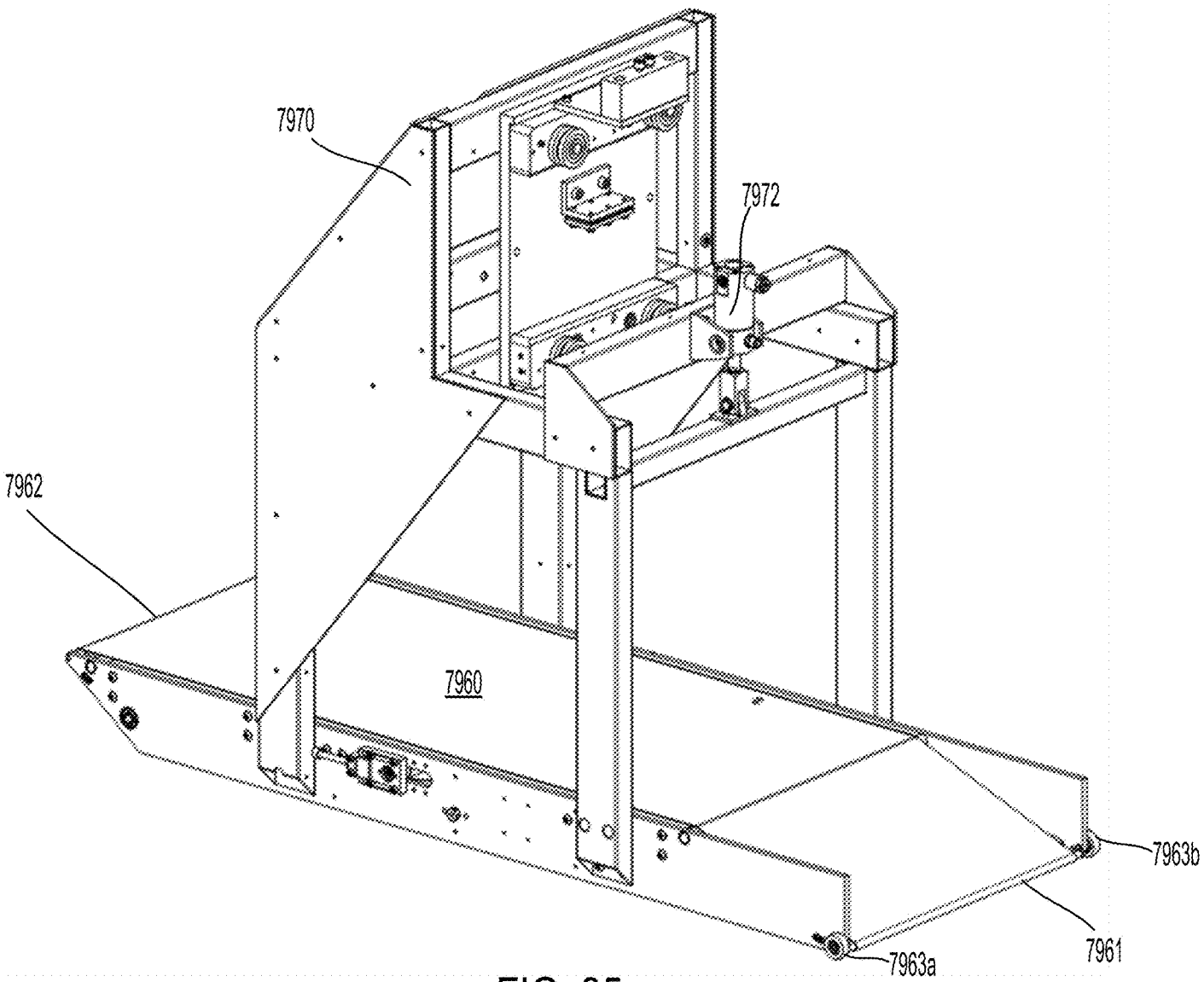
FIG. 35 depicts a perspective view of an example of an autonomous gantry mounted folded article retrieval conveyor.

As previously described with regard to implementations, once folding operations are determined to be completed, the folded article 7300 is transferred to an unloading elevator 7900 for delivery to an unloading station 7950. As shown in FIGS. 5-8 and 32-37, in implementations, the unloading station 7950 comprises a folded laundry article retrieval conveyor 7960 (herein after referred to as the "conveyor 7960") suspended from a gantry rail 7955 by a carriage 7970. The carriage 7970 is configured to move in the y-axis direction Ty along the gantry rail 7955, and the gantry rail 7955 is configured to transit on a stationary pair of parallel rails 7957*a-b* in the x-axis Tx direction over a platter 7100 received within the unloading station 7950. As shown in FIGS. 33-34, the suspended conveyor 7960 is thus able to move in X and Y directions, Tx and Ty, and lower to the platter top surface 7105 to retrieve a folded article 7300 disposed anywhere on the top surface 7105 of the platter 7100. Although the various controls of the unloading station are not shown in the controls system 400 of FIG. 4, the unloading station controls are analogous to those of the folding bay 7505 and the at least one controller 7005, 205 is in operative communication with the unloading station sensors and drive elements.

Once the carriage 7970 transits the conveyor 7960 to a location adjacent and above a folded article 7300, the controller 7005 instructs an actuator of the carriage 7970 to lower a leading edge 7961 of the conveyor 7960 onto the top surface 7105 of the platter 7100. In implementations, the leading edge 7961 is configured to be advanced to a position adjacent a folded edge of the folded article. Once the leading edge 7961 contacts the folded article, a rotating belt of the conveyor 7960 advances the article up onto the conveyor 7960. By contacting a folded edge, the conveyor 7960 is less likely to unfold the folded article 7300 than if the rotating conveyor were to contact a single, lower layer of the folded article and potentially unravel one or more folds of the article, pulling on one edge, while another slides off to lay the article out flat. In implementations, the leading edge 7961 is at the bottom of a downwardly sloped end portion of the conveyor 7960. In implementations, a trailing edge 7962 of the conveyor 7960 is sloped inwardly from the top of the conveyor to the bottom to create an overhanding portion. That inwardly sloped portion is configured to nest with a downwardly sloped end of a stacking conveyor (not shown) of the packing robot 8000 and form a continuous overlapping surface to hand off a folded article between the conveyors without the article toppling and/or unfolding. Alternatively, in implementations, a trailing edge 7962 of the conveyor 7960 is downwardly sloped similar to the leading edge 7961 such that a folded article can be handed off to a stacking conveyor (not shown) of the packing robot 8000 without a folded article toppling and/or unfolding.

Figure 36A:
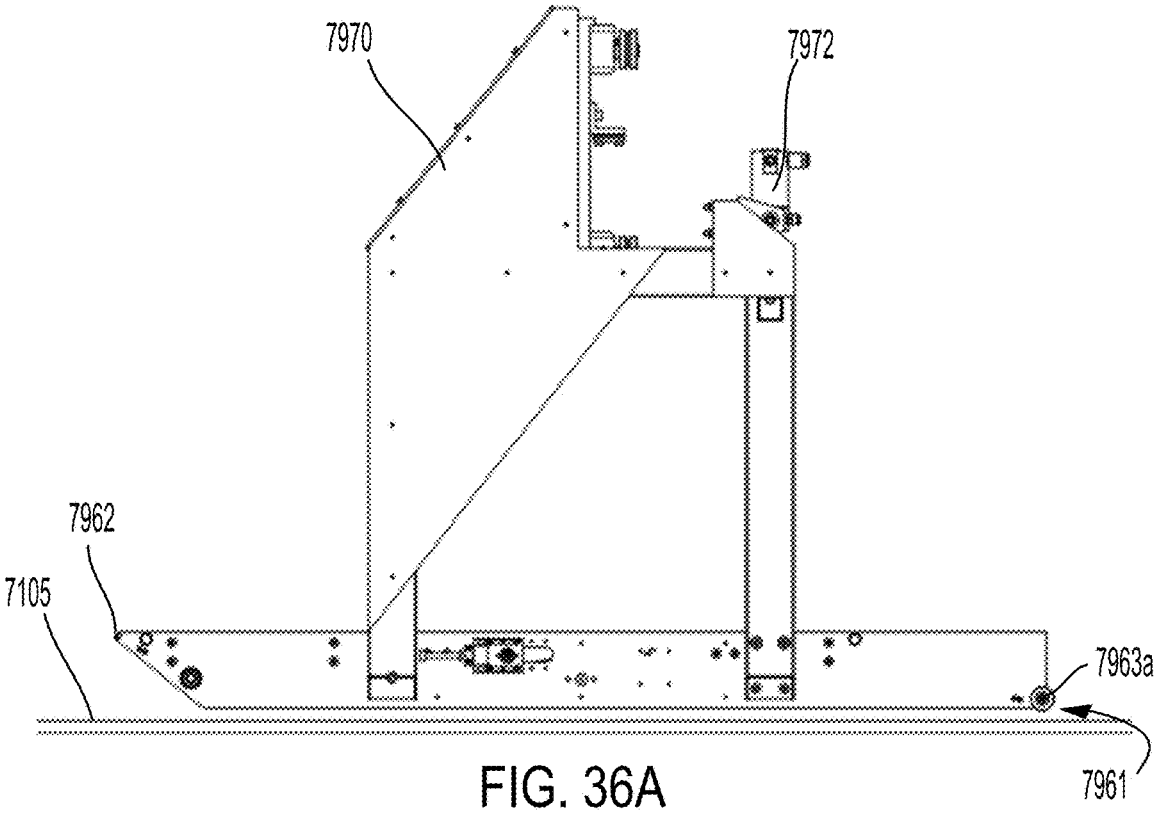
FIG. 36A depicts an example gantry mounted conveyor carriage and folded article retrieval conveyor of the folded garment unloading station of FIGS. 32-35.
Figure 36B:
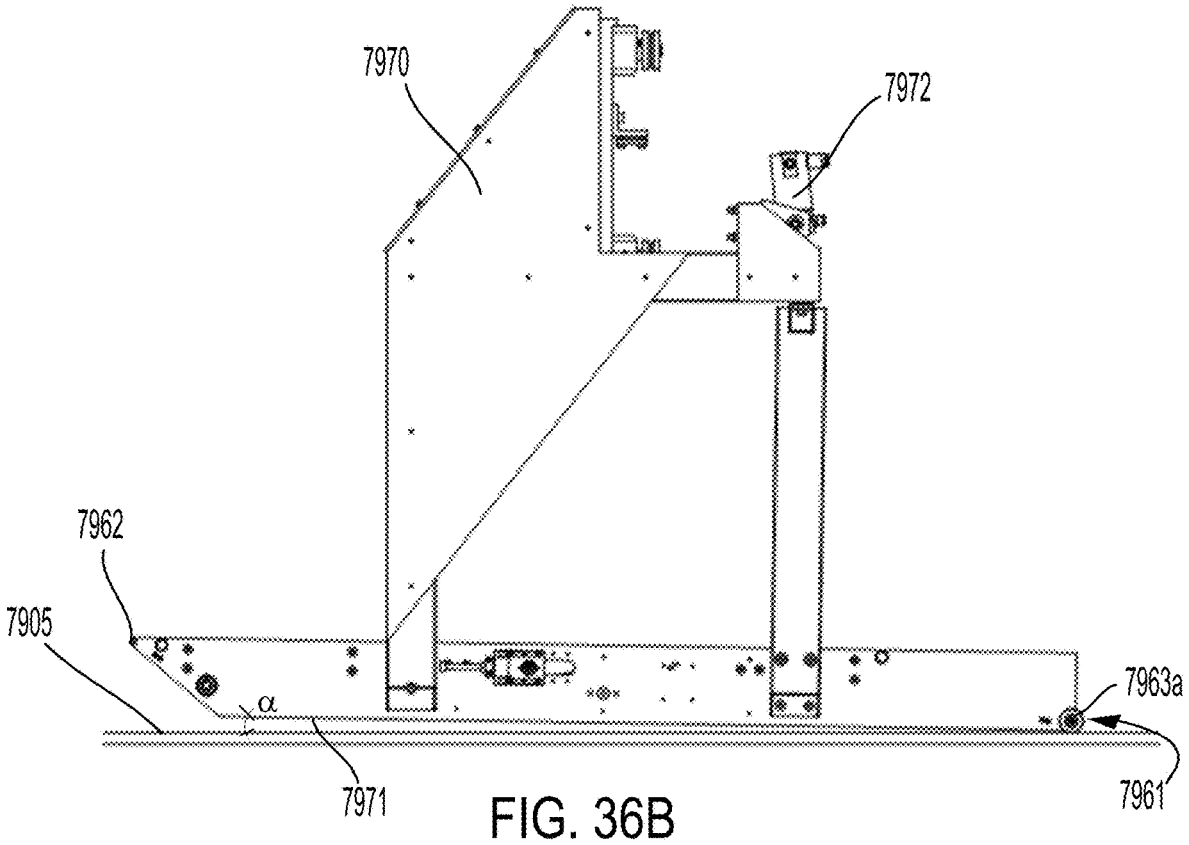
FIG. 36B depicts the gantry mounted conveyor carriage and folded article retrieval conveyor of FIG. 35 with a retrieving end of the conveyor lowered to a platter surface.

In order to position the leading edge 7961 of the conveyor 7960 adjacent the folded article 7300 on the top surface 7105 of the platter 7100, the carriage 7970 is configured to pivot the leading edge 7961 of the conveyor 7960 down from a pivot shaft) adjacent the trailing edge of the conveyor 7960. As shown in FIGS. 36A-B a linkage 7972 near the leading edge 7961 lowers the leading edge 7961 of the conveyor 7960 down onto the platter 7100 top surface 7105 such that a bottom edge 7971 of the carriage 7970 is at an angle $\alpha$ relative to the top surface 7105 as viewed from the side (FIG. 36B) and oriented from the trailing edge 7962 to the leading edge 7961. In implementations, the conveyor 7960 further comprises one or more wheels 7963*a-b* disposed in line with the leading edge 7961 configured to rotate and enable the leading edge 7961 to slide along the top surface 7105 of the platter 7100 while the belt of the conveyor 7960 rotates. The one or more wheels 7963*a-b* are configured to raise the leading edge 7961 above the top surface 7105 by between about 0.0254 mm to 5 mm (e.g., about 0.001 inch to 0.2 inch) such that the leading edge 7961 can slide up against and/or beneath an edge of the folded article 7300. In implementations, the linkage 7972 comprises a piston (e.g., a piston comprising a valve relief) configured to enable the leading edge 7961 of the conveyor 7960 to lower to the top surface 7105 under gravitational force. In implementations, the piston linkage 7972 is in operable communication with the controller 7005 and is configured to lift the leading edge 7961 back to a horizontal position under power once the laundry article is detected to be fully disposed on the conveyor 7960.

In implementations, as shown in FIG. 8, the unloading station 7950 comprises one or more sensors 7952*a-c* configured to detect at least one of the presence, orientation, and height of the folded article disposed on a platter 7100 received within the unloading station 7950 and output a signal to the at least one controller 7005, 205 indicative of the at least one detected characteristic. In implementations, the one or more sensors 7952*a-c* comprise one or more optical sensors disposed at least one of above and adjacent to the unloading station 7950. In implementations, the one or more sensors 7952*a-c* comprise one or more optical sensors disposed on at least one of the gantry rail 7955 and the carriage 7970. Additionally or alternatively, in implementations, the one or more sensors 7952*a-n* comprise one or more optical sensors 7952*a-c* disposed on at least one of the unloading elevator 7900 and an unloading elevator cantilever 7901 extended about the unloading station. Additionally or alternatively, in implementations, the one or more sensors 7952*a-c* comprise one or more optical sensors disposed on a rail mounted above the unloading station 9750. In implementations, the one or more sensors 7952*a-c* are configured to detect one or more edges of the folded article disposed on a platter 7100 at the unloading station 7950. Additionally, in implementations, the controller 7005 is configured to determine a location and orientation of a folded edge along the top surface 7105 of the platter 7100 based on one or more received signals output by the one or more sensors 7952*a-c*.

Based on the received output signal of the one or more sensors 7952*a-c*, the at least one controller 7005 is configured to communicate with one or more drive motors configured to move the carriage 7970 and the conveyor 7960 thereon in the X-axis and Y-axis directions (Tx and Ty) and position the leading edge 7961 of the conveyor 7960 adjacent an identified and located edge of the folded article. Additionally, in implementations, the unloading station 7950 comprises a receiving coupling 7988 (FIG. 32) similar to that disposed within each one of the tiered folding bays 7505*a-n*. A drive motor 7912 of the receiving coupling 7988 of the unloading station 7950 is configured to be in operative communication with at least one controller, e.g., controller 7005 and remote terminal 205. In implementations, based on one or more received signals from the one or more sensors 7952*a-n*, the at least one controller 7005, 205 can instruct the drive motor of the receiving coupling 7988 of the unloading station 7905 to rotate the platter 7100 coupled thereto (e.g., by a platter coupling 7165 seating in the receiving coupling 7988 in mated engagement) until the one or more sensors 7952*a-n*, detect an edge of the folded article 7300 being parallel with the leading edge 7961 of the conveyor 7960.

Alternatively, in implementations, the system comprises one or more robotic members configured to retrieve the folded laundry article from a platter in the unloading station. In implementations, the unloading station includes at least one retrieval arm configured to retrieve for delivery to a packing robot. In implementations, the retrieval arm comprises the same construction of the arms of the repositioning station. Additionally or alternatively, the at least one retrieval arm can include at least one of a 3 or more degree of freedom robotic arm and gripper. Additionally or alternatively, the one or more robotic members comprises at least one of a movable conveyor disposed on a gantry, one or more suction elements, and one or more clamps configured scoop and clamp the folded article from a top surface of the platter.

As described previously, in implementations, the unloading elevator 7900 is configured to lower the platter 7100 into the unloading station 7950, and the unloading conveyors 7915*a-b* of the unloading elevator 7900 are configured to move the platter coupling 7165 into position over the receiving coupling 7988 within the unloading station 7950. The unloading elevator 7900 then lowers the unloading elevator conveyors 7915*a-b* below the support frame 7908 of the unloading station and the platter 7100 rests on a plurality of support wheels 7925*a*-1 for level rotation. After a folded article has been retrieved by the retrieval conveyor, the unloading elevator 7900 is configured to raise the unloading conveyors 7915*a-b* to reengage an underside surface 7106 of the platter and lift the empty platter to a height of the return conveyors 7992*a-b, a'-b'* for returning the empty platter to the repositioning station 7705. Alternatively, in implementations, the unloading station 7950 comprises a pair of unloading station conveyors (not shown) similar in form and function to the pair transfer conveyors 7515*a-b* disposed within each folding bay 7505, and the unloading conveyors 7915*a-b* are configured to align with the return conveyors for handing off an empty platter for return to the repositioning station 7705 Additionally or alternatively, the system 500 further comprises a pair of unloading station conveyors (not shown) similar in form and function to the pair transfer conveyors 7515*a-b* disposed within each folding bay 7505, and a pair of folded article retrieval conveyors (not shown) configured to transit a platter and folded article thereon to a packing robot 8000. Aligning a retrieved platter and folded article thereon to the folded article retrieval conveyor comprises lowering the elevator unloading conveyors into alignment with the pair of folded article retrieval conveyors to create a continuous or substantially continuous surface that maintains the platter in a level state when passed between pairs of conveyors as described previously with regard to implementations.

Figure 37:
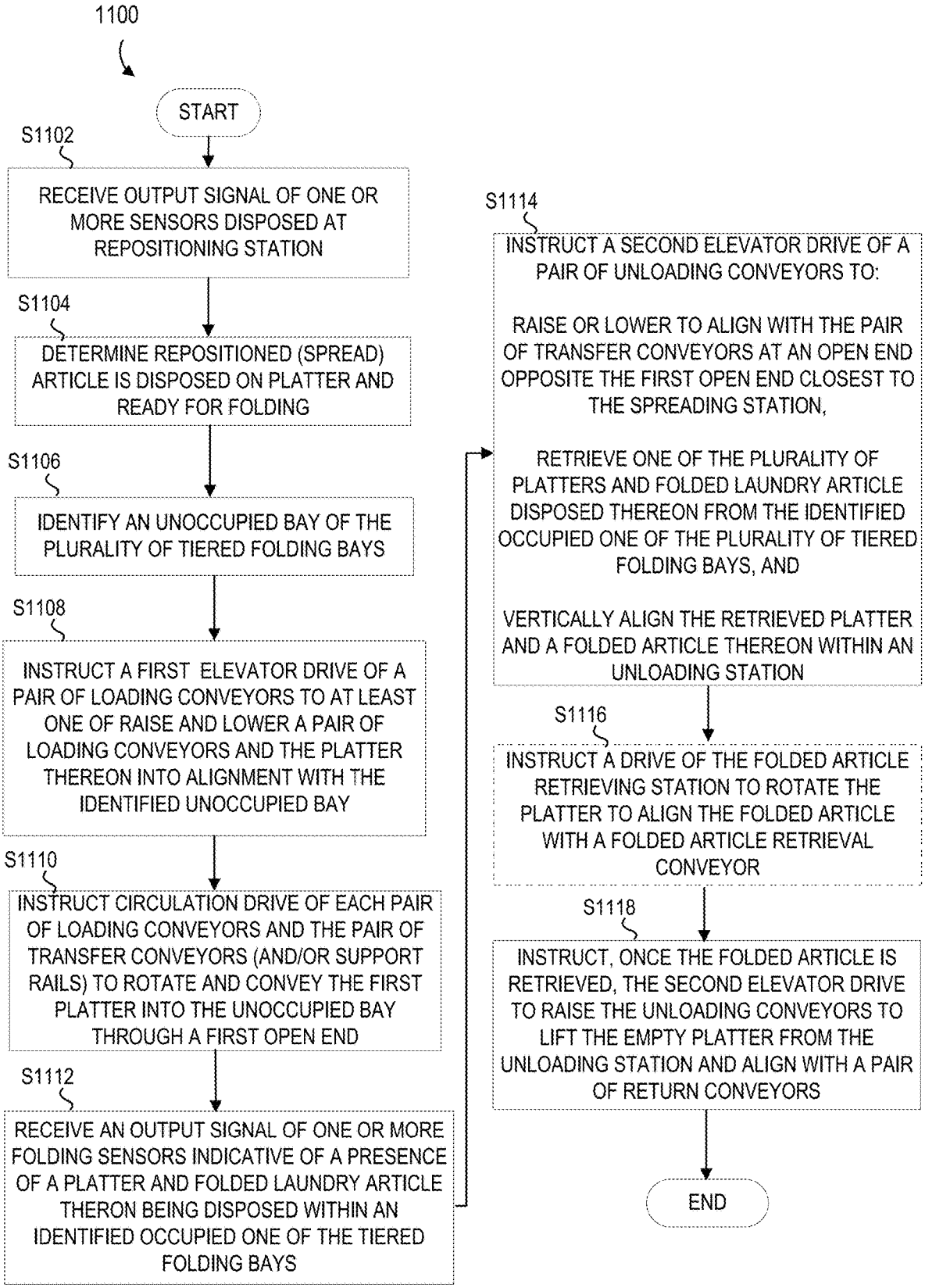
FIG. 37 depicts an example method of shuffling a plurality of rotatable platters into and out of a plurality of tiered laundry folding bays in the system of FIGS. 5-8.
Figure 38:
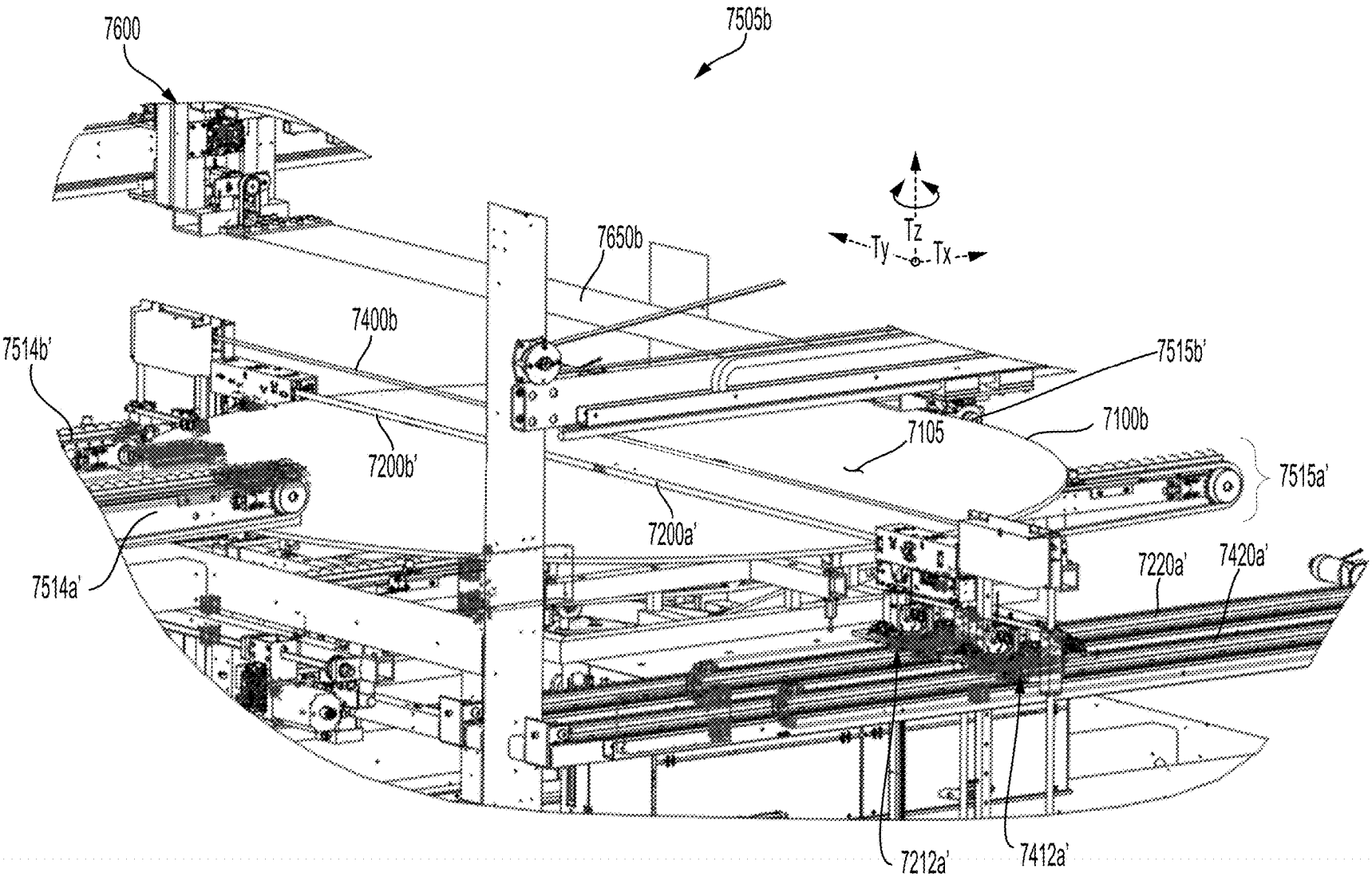
FIG. 38 depicts a front partial cutaway perspective view from a loading end (e.g., first open end) of an example folding bay of an autonomous tiered folding system comprising a folding blade suspended above a platter from the top of a folding bay and a clamp rod and a sweep rod movably supported on rails disposed on both sides of the platter adjacent the bottom portion of the folding bay.
Figure 39:
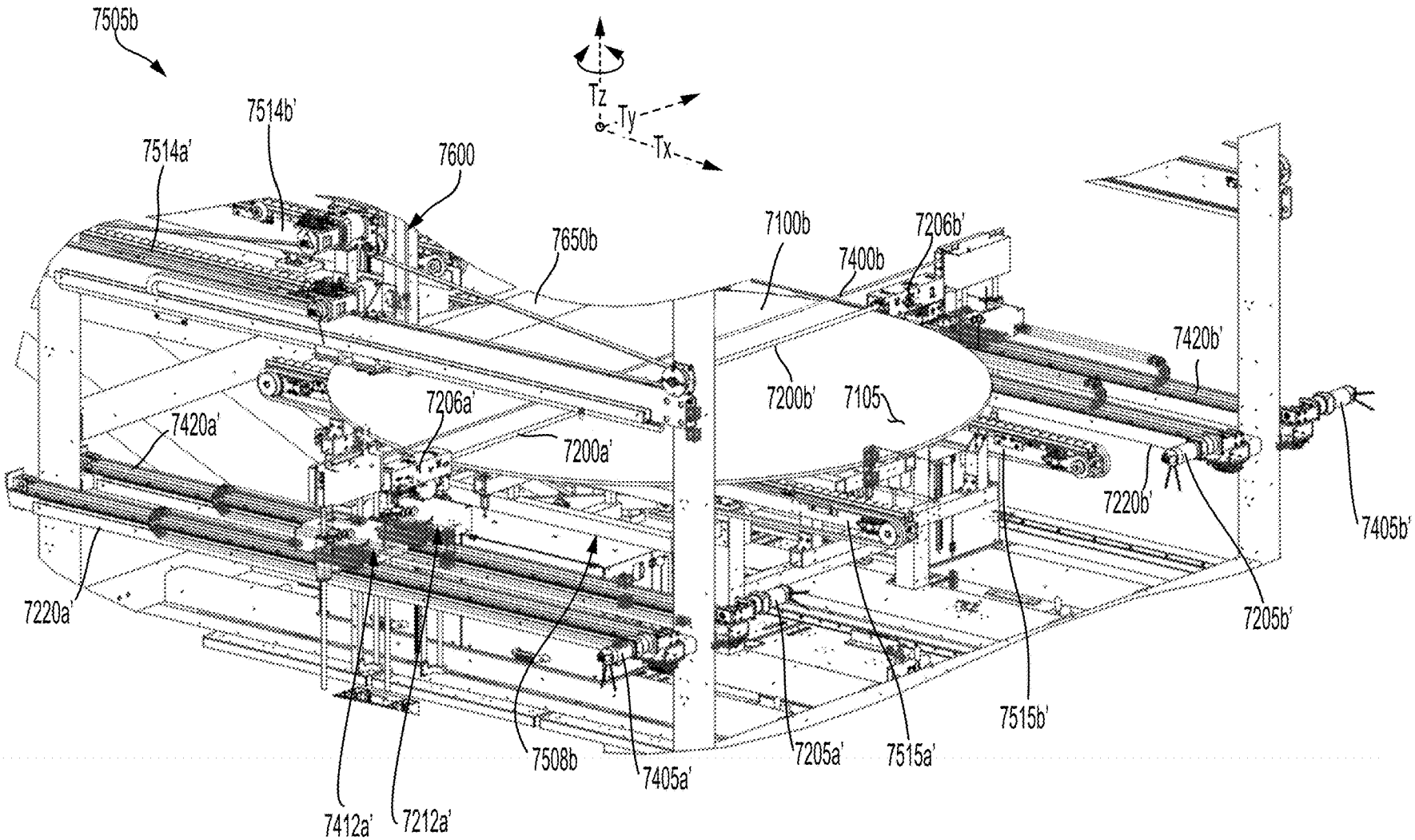
FIG. 39 depicts a partial cutaway perspective view of a portion of the example folding bay of FIG. 38 from a vantage of an unloading end (e.g., second open end) of the folding bay.

Referring now to FIG. 37, any of the examples and implementations described previously with regard to an autonomously operated tiered folding system 500 are applicable to implementations described herein with regard to a method 1100 of autonomously shuffling a plurality of rotatable platters 7300*a-n* into and out of a plurality of tiered laundry folding bays 7505*a-n*.

In implementations, the method 1100 is configured to be executed autonomously by the at least one controller 7005, 205. As previously described with regard to implementations, one or more controllers (e.g., the controller 7005, remote terminal controller 205) is configured to be in operative communication with at least the one or more sensors 7160, 7160*a-c* of the plurality of folding bays, the one or more sensors 7952*a-c* of the unloading station, the drive motor 7110 of the rotatable platter 7100, the conveyor drive motors of all of the previously described pairs of conveyors, the one or more lift actuators 7520, 7520*a-n* of each folding bay support frame 7508, 7508*a-n*, one or more attachment sensors (not shown) of each receiving coupling 7510, one or more position sensors of each pair of transfer conveyors 7515*a-b*, the drive motors and position sensors of the at least one clamp 7200, the drive motors and position sensors of the elongated sweep rod 7400 and the drive motors and position sensors of the blade 7650. In examples, the controller 7005 is configured to communicate with a network 230 via at least one of wired and wireless communication protocols. In implementations, the method 1100 further comprises receiving one or more instructions (e.g., folding completion and/or non-acceptance) from a remote device (e.g., handheld device 245) in operable communication with the network 230.

In implementations, as shown in FIG. 37, the method 1100, comprises receiving S1102 an output signal from one or more sensors disposed about a first platter 7100 at the repositioning station 7705 (e.g., a station for spreading apart and flattening a clean laundry article) and an output signal of one or more folding sensors 7160*a-n* of each one of the plurality of tiered folding bays 7505*a-n* disposed in a tower 7500 adjacent the repositioning station. The first platter is one of the plurality of rotatable platters. The method comprises determining S1104 the first platter has disposed thereon a spread laundry article 7300 ready for folding. The method comprises identifying S1106, based on the received output signal of the one or more folding sensors, an unoccupied bay of the plurality of tiered folding bays 7505*a-n*, and instructing S1108 a first elevator drive of a pair of loading conveyors 7715*a-b* disposed at the repositioning station to at least one of raise and lower the pair of loading conveyors and the first platter and spread apart laundry article disposed thereon to a height of at least one of a pair of support rails 7514*a-b* and a pair of transfer conveyors 7515*a-b* disposed within the identified unoccupied bay.

As described previously with regard to implementations, the pair of loading conveyors are configured to align with the transfer conveyors 7515*a-b* and/or cantilevered support rails 7514*a-b* aligned with the transfer conveyors 7515*a-b* to create a continuous or substantially continuous surface for moving the platter into the identified unoccupied bay in a level, supported orientation. As described previously with regard to implementations, the pair of transfer conveyors either extend from the identified unoccupied bay or align with cantilevered support rails 7514*a-b* extending from the bay, the cantilevered support rails 7514*a-b* being configured to feed a platter 7100 to the transfer conveyors 7515*a-b, a'-b'* within the identified unoccupied bay. The method comprises instructing S1110 a circulation drive of the pair of loading conveyors and a circulation drive of the pair of transfer conveyors (and, in some implementations as previously described, a circulation drive of an intervening pair of cantilevered support rails 7514*a-b*) to rotate in a coordinated timing (e.g., for aligning centering pins 7734*a-n*. 7534*a-n*, 7533*a-n*) and convey the first platter into the unoccupied bay. In implementations, coordinated timing comprises operating the pairs of conveyors at identical rotational speeds.

Alternatively, based on received output signals of the one or more sensors 7160, 7160*a-c* the at least one controller 7005 is configured to detect no unoccupied folding bays and instruct the loading elevator 7700 to hold the platter at the spreading station until a folding bay 7505 becomes unoccupied. The controller is configured to receive continuous or periodic output signals from the one or more sensors 7160, 7160*a-n* of each of the plurality of folding bays 7505*a-n*. Additionally or alternatively, in implementations, the controller is configured to request a status periodically from the one or more sensors 7160, 7160*a-n* of each of the plurality of folding bays. Additionally or alternatively, in implementations, the one or more sensors 7160, 7160*a-n* are configured to automatically send an unoccupied signal to the controller when a platter therein is transferred to or in the process of transferring to an unloading elevator 7900.

The method comprises receiving S1112 an output signal of one or more folding sensors 7160, 7160*a-n* indicative of a presence of a folded laundry article disposed within an identified occupied one of the plurality of tiered folding bays 7505*a-n*. The method comprises instructing S1114 a second elevator drive of a pair of unloading conveyors to: raise or lower to align with the pair of transfer conveyors at an end opposite the spreading station, retrieve one of the plurality of platters and a folded laundry article disposed thereon from the identified occupied one of the plurality of tiered folding bays, and vertically, and optionally horizontally, align the retrieved plater and a folded article thereon into an unloading station 7950. In implementations, the retrieved platter comprises at least one of the first platter 7100*a* and another of the plurality of platters 7100*b-n* disposed within the plurality of tiered folding bays. Aligning vertically comprises lowering, raising, or staying at a height of the folding bay from which the folded article was transferred. Aligning horizontally comprises transiting the platter and folded laundry article there on along the unloading conveyors such that a platter coupling 7165 aligns with a rotatable receiving coupling 7988 of the unloading station for enabling a mated engagement. Optionally, in implementations, the method comprise instructing S1116 a drive of the folded article retrieving station to rotate a platter engaged with an unloading station coupling 7988 to align the folded article disposed on the platter with a retrieval end of a folded article retrieval conveyor. Once the folded article is retrieved by the folded article retrieval conveyor 7960, the method comprises 1118 instructing the second elevator drive to lift the empty platter (e.g., platter without a folded article thereon) from the unloading station coupling 7988 and align the platter with a return conveyor 7990 for return to the spreading station 7705.

In implementations, the unloading elevator can deliver the platter and the folded laundry thereon to the unloading station 7950 while another one or more processes are simultaneously occurring in the system. For example, the loading elevator can be raising a platter into the top unoccupied folding bay while the unloading elevator is lowering (or raising) a platter and folded laundry thereon into the unloading station 7950 and another deformable laundry article is being folded in another occupied folding bay of the plurality of folding bays 7505*a-n*.

In implementations, the first elevator drive and second elevator drive are configured to operate concurrently to deliver the first platter of the plurality of platters from the loading elevator to the identified unoccupied bay and retrieve by the unloading elevator 7900 another platter of the plurality of platters and the folded laundry article thereon from an occupied bay following completion of a folding routine.

In implementations, the repositioning station 7705 comprises a plurality of grippers 6105*a-n* disposed about an outer bound of the repositioning station 7705. The plurality of grippers are configured to spread a laundry article apart to a repositioned state and lower the spread apart (e.g., flattened or substantially flattened) article onto a platter in a spread configuration. In implementation, engaged ones of the plurality of grippers can sweep the spread article back as they lower the spread article onto the platter in a substantially spread state for folding. Additionally or alternatively, in implementations the method further comprises identifying an article type and instructing some or all of the plurality of grippers to partially fold the laundry article before depositing the article on the platter. For example, the controller can instruct some or all of the plurality of grippers to close the front of a button-down shirt (e.g., closed but unbuttoned) before sweeping it flat.

As previously described, in implementations, the method further comprises instructing the second elevator drive of the unloading elevator to lower or raise the pair of unloading conveyors and an empty platter thereon from a height of the folded article retrieval conveyor to a height of a return conveyor configured to receive the empty platter and at least one of store and return the empty platter to the repositioning station 7705. The return conveyor is configured to store a queue of one or more empty platters of the plurality of platters. As described previously with regard to implementations, the method comprises simultaneously instructing the second elevator drive to move while at least one of processing input signals from one or more sensors in the spreading station and plurality of folding bays and instructing other motor drives and actuators within the system to operate. The method therefore comprises concurrently executing processes at various locations throughout the autonomously operating tiered folding system 500. For example, the repositioning station 7705 can be spreading a laundry article for folding while one or more of the tiered folding bays 7505*a-n* are in various stages of folding operations. Furthermore, by stacking the plurality of folding bays 7505*a-n* in a tower 7500, the plurality of tiered folding bays 7505*a-n* occupies no more floor space in a facility than a single folding robot 7000.

Additionally, in any of the preceding implementations, a total number of platters of the plurality of movable platters comprises at least a total number of tiered folding bays, and the total number of tiered folding bays is two or more. Therefore, the total number of platters is at least two, and preferably three to increase throughput by concurrently running repositioning (spreading), folding, and unloading processes. By increasing the ratio from a paired single repositioning station 7705 to a single folding robot 7000 to a paired single repositioning station 7705 to two or more folding robots 7000, the system 500 is configured to fold an entire load of laundry (e.g., a plurality of laundry articles 7300*a-n*) more efficiently than in a 1:1 ratio of a single repositioning station 7505 (e.g., repositioning robot 6000) servicing a single folding robot 7000.

In implementations, each laundry article is one of a plurality of laundry articles from a load comprising a plurality of washed and dried household laundry. The controller is configured to simultaneously instruct various drives of the system 500 to perform simultaneously at least two of the following actions: spreading (e.g., repositioning) a laundry article, folding another laundry article of the plurality of laundry articles in one or more folding bays, aligning one of the plurality of platters and a folded laundry article disposed thereon with a folded article retrieval conveyor, and conveying an empty platter on a return conveyor disposed at least one of below and adjacent the plurality of tiered folding bays for at least one of storage and return to the repositioning station.

In implementations, the folded laundry article retrieval conveyor 7960 is disposed within an unloading station 7950 adjacent the unloading elevator 7900. The method comprises instructing the unloading elevator 7900 to lower the platter on unloading conveyors 7915*a-b* into the unloading station 7950. The method further comprises driving he unloading conveyors 7915*a-b* of the unloading elevator 7900 to move the platter coupling 7165 into position over the receiving coupling within the unloading station 7950. Alternatively, in implementations, aligning the retrieved platter and folded article thereon with the folded article retrieval conveyor comprises lowering the elevator unloading conveyors into alignment with a pair unloading station conveyors (not shown) to create a continuous or substantially continuous (e.g., small end gap between pairs of conveyors is no larger than 25 cm) surface that maintains the platter in a level state when passed between pairs of conveyors as described previously with regard to implementations.

After a folded article has been retrieved by the retrieval conveyor, the unloading elevator 7900 can raise the unloading conveyors 7915*a-b* and empty platter disposed thereon to a height of the return conveyors 7815*a-b* for returning the empty platter to the spreading station 7705. Alternatively, in implementations, the unloading station comprises a pair of discharge conveyors (not shown) configured to receive a platter and folded laundry article from the unloading conveyors, and the method further comprises aligning the platter vertically within the unloading station at a height for the discharge conveyors to receive the platter and the folded article. In implementations, the method comprises transferring the empty platter to a return conveyor configured to receive the empty platter and at least one of store and return the empty platter to the spreading station.

Alternatively, in implementations, the folded article retrieval conveyor is configured to align vertically with each of the plurality of tiered folding bays to receive a folded article from a platter. In implementations, the folded article retrieval conveyor is configured to extend into at least one of the unloading elevator and each folding bay to retrieve the folded article. Alternatively, in implementations, the folded article retrieval conveyor is configured to retrieve the folded article form a platter supported on unloading conveyors extending from the unloading elevator. In implementations, the folded article retrieval conveyor is supported by a carriage mounted to a gantry that is mounted to an elevator such that the conveyor is configured to move vertically and in the Ty direction to align with a folded laundry article on the platter disposed in one of the plurality of tiered folding bays. Additionally, the method further comprises instructing a spin drive motor of a folding bay to rotate a platter and a folded laundry article thereon to align an edge of the folded article (e.g., a folded edge) substantially parallel to a leading edge of the retrieval conveyor before at least one of instructing transferring the platter and folded laundry article thereon to at least one of the pair of unloading conveyors and instructing the retrieval conveyor to retrieve the folded laundry article from the platter.

In implementations, the method 1100 further comprises instructing the first elevator drive of the loading elevator 7700, upon transfer of a first platter and repositioned article disposed thereon into an identified bay, to lower the pair of loading conveyors to at or below the repositioning station, retrieve an empty platter of the plurality of platters from the return conveyors 7990, and raise the empty platter to the repositioning station. The method 1100 further comprises instructing one or more of a pan drive, a tilt drive, and an extend drive of a plurality of arms 6110 disposed about the spreading station to move their terminal grippers within a work volume above the empty platter received at the repositioning station to spread apart a laundry article suspended by and spread between two of the plurality of grippers. The method 1100 further comprises determining the laundry article is spread, and instructing one or more of a pan drive, a tilt drive, and an extend drive of two engaged ones of the plurality of grippers to lower the spread laundry article onto the platter at the bottom of a work volume in a spread state. The work volume is the volume of space extending from a platter to a maximal reach of the arms 6110 working above the platter to spread apart (repositioning) a deformable article for subsequent folding. Additionally, in implementations, the method further comprises instructing one or more of a pan drive, a tilt drive, and an extend drive to store the plurality of arms 6110 and grippers 6105 outside a boundary of the platter disposed at the repositioning station 7705 (e.g., outside a work volume 7707) before instructing the first elevator drive to raise the pair of loading conveyors and the platter and spread laundry article disposed thereon to an identified unoccupied folding bay. This prevents a collision of the platter with the plurality of grippers and therefore prevents jostling the spready laundry article and/or damaging the plurality of grippers.

In implementations, the method further comprises determining, based on at least one of the one or more sensor signals of a folding bay and a user input, that a folded laundry article disposed in one of the plurality of tiered folding bays comprises one or more unacceptable folding conditions. For example, as previously described, the controller 7005 is configured to utilize a neural network to determine whether a laundry article is or is not acceptably folded. The system can learn over time to autonomously detect an unacceptable fold and an acceptable fold of various types of laundry articles based on inputs including at least one of detecting a fold that unfolds itself, detecting one or more dimensions of the folded article exceeding a standardized threshold size compatible with packing in a container of known dimensions, and receiving a remote user input indicative of an unacceptable fold based on visual appearance. Additionally, in implementations, a database in communication with the controller 7005 can store article type, size, and quantity data along with acceptable fold images for each repeat customer so that preferences can be personalized and optimized per user.

The method 1100 further comprises, upon determining of one or more unacceptable folding conditions based upon receipt of a signal indicative of one or more unacceptable folding conditions, instructing the pair of transfer conveyors to transfer the platter and laundry article disposed thereon to the pair of loading conveyors for return to the repositioning station. Additionally or alternatively, determining of one or more unacceptable folding conditions based upon receipt of a signal indicative of one or more unacceptable folding conditions, the controller can instruct the pair of transfer conveyors to transfer the platter and laundry article disposed thereon to the pair of unloading conveyors for return to the spreading station via the return conveyors 7990. In implementations, the method further comprises identifying the most efficient flow path for returning a platter and unacceptably folded article to the spreading station and subsequently instructing the transfer conveyors to transfer the platter and unacceptably folded article to one of the loading and unloading elevators. In implementations, the one or more unacceptable folding conditions comprise at least one of folding dimensions not matching an acceptable bounding box limit (e.g., volumetric dimensions required for a folded article to fit within a packing container for return shipment to a household), a top surface tilt angle exceeding a threshold, and an appearance acceptable for customer satisfaction as indicated by a user input to the system in response to a real-time image delivery or based on a stored image flagged asynchronously via a customer portal by a household customer after receiving the returned, folded article. The user input can be a screen button tap or toggle button selection on a user interface screen of an application running on a portable device (e.g., tablet, smartphone, smart watch, etc.) and/or a remote computing device. In implementations, the method comprises instructing the loading elevator to operate in reverse, retrieving a platter and a laundry article thereon from a folding bay and returning the platter and laundry article to the repositioning station if a folded state of a laundry article is determined to be unacceptable either by sensor detection or customer input.

Additionally or alternatively, the method can include instructing one or more of the arms and associated grippers of the repositioning station to reach back into an adjacent folding bay to retrieve an unacceptably folded article to redo the spreading operation before folding is attempted again. Alternatively, in implementations, the method comprises instructing arms and associated grippers of a repositioning robot 6000 adjacent the loading elevator to reach into the loading elevator to retrieve an unacceptably folded article to redo the spreading operation before folding is attempted again.

In implementations, the method is configured to iterate on an unacceptable fold a threshold number of times before determining the article should be delivered to a packing robot either with an unacceptable fold or alternatively delivered to a packing robot to be loaded into a packing container in an unfolded state.

In all of the preceding implementations of the folding robot 7000 (e.g., a movable, rotatable platter 7100 installed in a folding bay 7505 and the corresponding folding rods and blades in that folding bay 7505), the controller 7005 of the folding device is configured to communicate at least one of a predicted or achieved footprint area and folded article height to the at least one controller 8005 of the packing and queuing system 8000.

Additionally or alternatively, in implementations, as described previously with regard to the method 1100 of autonomously shuffling a plurality of rotatable platters 7300*a-n* into and out of a plurality of tiered laundry folding bays 7505*a-n*, the controller 7005 of system 500 can determine based on one or more received signals that a laundry article is too small for folding. For example, the article could be one of a baby sock, a pair of underwear, and a long, thin article like a scarf. In such instances, the controller 7005 is configured to instruct at least one of the repositioning station 7705 (e.g., repositioning robot 6000) and the folding robot 7000 (e.g., a movable, rotatable platter 7100 installed in a folding bay 7505 and the corresponding folding rods and blades in that folding bay 7505) to forgo folding the laundry article 7300 and instead pass the unfolded laundry article through the remainder of the process line 100 unfolded. A packing robot conveyor or queue platform can receive the unfolded articles and deposit the unfolded laundry articles into one or more packing containers such that the unfolded articles are deposited in a container prior to loading the one or more folded laundry articles and/or stacks of folded laundry articles from a queue platform into the conveyor. Additionally or alternatively, a packing robot conveyor can deposit the unfolded laundry articles in one or more piles on the queue platform for conveyance in aggregate into a container.

In embodiments, any of the one or more robots in the process line 100 preceding the queueing and packing robot 8000 can determine that one or more articles of household laundry is too small for folding and provide the one or more too small for folding laundry articles to the packing station for loading into an empty packing container. For example, the spreading station 7705 (e.g., repositioning robot 6000) can identify and collect in a container the one or more too small for folding laundry articles and the collection container can transit on rails to the packing station, skipping any processing by subsequent robots in the process line and eliminating the time those subsequent robots would have expended handling the article.

All of the methods and tasks described herein may be performed and fully automated by a computer system. The computer system may, in some cases, include multiple distinct computers or computing devices (e.g., physical servers, workstations, storage arrays, etc.) that communicate and interoperate over a network to perform the described functions. Each such computing device typically includes a processor (or multiple processors or circuitry or collection of circuits, e.g., a module) that executes program instructions or modules stored in a memory or other non-transitory computer-readable storage medium. The various functions disclosed herein may be embodied in such program instructions, although some or all of the disclosed functions may alternatively be implemented in application-specific circuitry (e.g., ASICs or FPGAs) of the computer system. Where the computer system includes multiple computing devices, these devices may, but need not, be co-located. The results of the disclosed methods and tasks may be persistently stored by transforming physical storage devices, such as solid-state memory chips and/or magnetic disks, into a different state.

Although the subject matter contained herein has been described in detail for the purpose of illustration, it is to be understood that such detail is solely for that purpose and that the present disclosure is not limited to the disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

Other examples are within the scope and spirit of the description and claims. Additionally, certain functions described above can be implemented using software, hardware, firmware, hardwiring, or combinations of any of these. Features implementing functions can also be physically located at various positions, including being distributed such that portions of functions are implemented at different physical locations.

Example embodiments of the present inventive concepts may be embodied in various devices, apparatuses, and/or methods. For example, example embodiments of the present inventive concepts may be embodied in hardware and/or in software (including firmware, resident software, microcode, etc.). Furthermore, example embodiments of the present inventive concepts may take the form of a computer program product comprising a non-transitory computer-usable or computer-readable storage medium having computer-usable or computer-readable program code embodied in the medium for use by or in connection with an instruction execution system. In the context of this document, a computer-usable or computer-readable medium may be any medium that can contain, store, communicate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, or device. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Example embodiments of the present inventive concepts are described herein with reference to flowchart and/or block diagram illustrations. It will be understood that each block of the flowchart and/or block diagram illustrations, and combinations of blocks in the flowchart and/or block diagram illustrations, may be implemented by computer program instructions and/or hardware operations. These computer program instructions may be provided to a processor of a general purpose computer, a special purpose computer, or other programmable data processing apparatus to produce a machine, such that the instructions, which execute via the processor of the computer or other programmable data processing apparatus, create means and/or circuits for implementing the functions specified in the flowchart and/or block diagram block or blocks.

These computer program instructions may also be stored in a computer usable or computer-readable memory that may direct a computer or other programmable data processing apparatus to function in a particular manner, such that the instructions stored in the computer usable or computer-readable memory produce an article of manufacture including instructions that implement the functions specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart and/or block diagram block or blocks.

All of the methods and tasks described herein may be performed and fully automated by a computer system. The computer system may, in some cases, include multiple distinct computers or computing devices (e.g., physical servers, workstations, storage arrays, etc.) that communicate and interoperate over a network to perform the described functions. Each such computing device typically includes a processor (or multiple processors or circuitry or collection of circuits, e.g., a module) that executes program instructions or modules stored in a memory or other non-transitory computer-readable storage medium. The various functions disclosed herein may be embodied in such program instructions, although some or all of the disclosed functions may alternatively be implemented in application-specific circuitry (e.g., ASICs or FPGAs) of the computer system. Where the computer system includes multiple computing devices, these devices may, but need not, be co-located. The results of the disclosed methods and tasks may be persistently stored by transforming physical storage devices, such as solid-state memory chips and/or magnetic disks, into a different state.

As used herein, a "neural network" refers to machine learning structures. Neural networks include one or more layers of "neurons" that each receive input information and produce an output as, for example, a weighted sum of the inputs with an optional internal bias value within the neuron, or some other predetermined function that produces an output numeric value based on a combination of the input values to the neuron. The weights that are assigned to different inputs in the structure of the neural network are produced during a training process for the neural network. A simple neural network includes an input layer of neurons connected to an output layer of neurons. The output layer of neurons is configured to produce outputs based on numeric functions applied to the inputs received at the output layer such as threshold functions with parameters that are produced during a training process. A neural network may include "deep" neural networks in which multiple layers of "hidden" neurons are arranged between the input layer and the output layer with varying structures for the hidden layers including fully connected layers where the output of a neuron in a first layer is connected to an input of each neuron in the next layer or partially connected layers where the outputs of neurons in a first layer are only connected to inputs of a portion of the neurons in the next layer.

A "pose" is the position and orientation of an object in a reference frame. In some embodiments, the pose is a position and orientation of a deformable laundry article. The pose can be specified by a position in two- (x,y) or three-dimensions (x,y,z) and a heading (θ). The pose can also be further specified by an orientation including a deformable shape or volume of the laundry article, which may take into account folds, creases, curves or other shapes and positions of the laundry article. The reference frame may be a global reference frame that is fixed to the environment or may be a relative reference frame that is in relationship to another object in the environment.

"Deformable" means that a shape of an article can be bent or folded. Deformable laundry articles are typically fabric clothing or washable household items as described herein. Deformable laundry articles do not typically hold a particular or stiff shape when lifted or manipulated.

"Intelligently sorted" refers to grouping or ordering articles, for example, by size, weight, shape, function, color, fabric type, washing and/or drying requirements or other characteristics.

Although the terms "first" and "second" may be used herein to describe elements of the systems and devices herein, this does not necessarily imply an order unless the context indicates otherwise. The terms "first" and "second" are intended to distinguish one element from another element. Thus, a first element could be termed a second element, and similarly, a second element could be termed a first element without departing from the teachings of the present invention.

What is claimed is:

1. An autonomous folding device comprising:

a plurality of tiered folding bays configured to independently and simultaneously fold a plurality of household laundry articles, each of the plurality of tiered folding bays comprising a rotatable coupling configured to receive a rotatable platter in reversible engagement, the rotatable coupling being in operative engagement with a drive motor, an extendable and retractable support configured to transit the rotatable platter into and out of the folding bay in a level orientation and align a protrusion extending from an underside surface of the rotatable platter with the rotatable coupling, and at least one of a folding blade and folding rod configured to engage a laundry article of the plurality of household laundry articles disposed on a top surface of the rotatable platter engaged with the rotatable coupling; and at least one elevator configured to raise and lower the rotatable platter into and out of one of the plurality of tiered folding bays, wherein the rotatable platter is one of a plurality of rotatable platters and the rotatable platter and one or more of the plurality of rotatable platters are configured to occupy simultaneously two or more of the plurality of tiered folding bays.

2. The device of claim 1, wherein the plurality of tiered folding bays are vertically stacked to form a tower comprising an area footprint on a floor of one folding bay.

3. The device of claim 1, wherein the extendable and retractable support further comprises a pair of spaced apart transfer conveyers configured to support in an extending state the rotatable platter thereon with the rotatable platter therebetween.

4. The device of claim 3, wherein the pair of spaced apart transfer conveyers comprise centering pins configured to abut one or more edge locations of the rotatable platter and center the rotatable platter, and the protrusion extending therefrom, above the rotatable coupling for mating alignment.

5. The device of claim 4, wherein the protrusion comprises a conical shape and the rotatable coupling comprises a conically shaped receiving bore.

6. The device of claim 1, wherein each tiered folding bay of the plurality of tiered folding bays comprises a first open end opposite a second open end, the open ends disposed adjacent the ends of a pair of spaced apart transfer conveyers.

7. The device of claim 6, wherein the at least one elevator comprises a loading elevator adjacent the first open end and an unloading elevator adjacent the second open end.

8. The device of claim 7, further comprising a pair of driven support rails extending from the first open end configured to transit the rotatable platter and a spread laundry article of the plurality of household laundry articles thereon onto a pair of spaced apart driven transfer conveyors disposed on the extendable and retractable support.

9. The device of claim 8, wherein the loading elevator is configured to raise and lower the rotatable platter to an unoccupied bay for transiting the rotatable platter onto the driven support rails.

10. The device of claim 8, wherein the unloading elevator comprises a pair of unloading conveyors configured to transit the rotatable platter at least one of into and out of the folding bay in a level orientation and deliver a folded article of the plurality of household laundry articles to an unloading station.

11. The device of claim 10, wherein the unloading station comprises a retrieval arm configured to retrieve for delivery to a packing robot.

12. The device of claim 11, wherein the retrieval arm comprises at least one of a 3 or more degree of freedom robotic arm and gripper, a movable conveyor disposed on a gantry, one or more suction elements, and one or more clamps configured scoop and clamp the folded article from a top surface of the rotatable platter.

13. The device of claim 10, further comprising a return conveyor disposed between the loading elevator and the unloading elevator for returning the rotatable platter in an empty state from the unloading station to the loading elevator, wherein the plurality of tiered folding bays are vertically stacked to form a tower and the return conveyor is disposed at least one of below or aside the tower.

14. The device of claim 13, wherein the loading elevator is configured to raise the rotatable platter in an empty state to a repositioning station for receiving a spread apart laundry article of the plurality of household laundry articles to deliver to an unoccupied one of the plurality of tiered folding bays.

15. The device of claim 1, wherein the at least one of the folding blade and folding rod is configured to raise from, lower to, and move along the surface of the rotatable platter to at least one of fold, sweep, and clamp a laundry article of the plurality of household laundry articles.

16. The device of claim 15, further comprising a compression sensor configured to detect an amount of downward force applied by the at least one of the folding blade and folding rod to at least one of a top surface of the rotatable platter and a laundry article of the plurality of household laundry articles thereon.

17. The device of claim 1, wherein a total number of the plurality of rotatable platters comprises at least a number of tiered folding bays of the plurality of tiered folding bays for simultaneous folding laundry articles of the plurality of household laundry articles within every bay.

18. The device of claim 1, further comprising a plurality of support wheels disposed throughout each folding bay of the plurality of tiered folding bays, the plurality of support wheels being configured to support thereon the rotatable platter when the extendable and retractable support is in a retracted state.

19. The device of claim 18, wherein the retracted state comprises the extendable and retractable support not touching the rotatable platter while the protrusion is engaged with the rotatable coupling.

20. The device of claim 1, further comprising one or more sensors configured to output a signal indicative of a folding state of a laundry article of the plurality of household laundry articles.

21. The device of claim 20, further comprising a controller in operative communication with the one or more sensors and one or more drives of the at least one elevator and the at least one extendable and retractable support, the controller being configured to determine, based on received output signals of the one or more sensors, an unoccupied bay and article folding completion, and to instruct the at least one elevator to retrieve the rotatable platter and a folded laundry article of the plurality of household laundry articles thereon for delivery to an unloading station.

* * * * *